US010747149B2

(12) United States Patent
Hano et al.

(10) Patent No.: US 10,747,149 B2
(45) Date of Patent: Aug. 18, 2020

(54) IMAGE FORMING APPARATUS AND IMAGE FORMING SYSTEM

(71) Applicant: CANON KABUSHIKI KAISHA, Tokyo (JP)

(72) Inventors: Masami Hano, Abiko (JP); Takahito Fuse, Nagareyama (JP); Tadashi Fukuda, Tokyo (JP); Shota Soda, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/205,701

(22) Filed: Nov. 30, 2018

(65) Prior Publication Data

US 2019/0171134 A1 Jun. 6, 2019

(30) Foreign Application Priority Data

Dec. 1, 2017 (JP) ..... 2017-231567

(51) Int. Cl.

| | |
|---|---|
| ***G03G 15/16*** | (2006.01) |
| ***G03G 15/01*** | (2006.01) |
| ***G03G 15/00*** | (2006.01) |
| ***G03G 21/08*** | (2006.01) |

(52) U.S. Cl.

CPC ..... *G03G 15/1665* (2013.01); *G03G 15/0189* (2013.01); *G03G 15/553* (2013.01); *G03G 21/08* (2013.01)

(58) Field of Classification Search

CPC .... G03G 15/043; G03G 15/045; G03G 21/08; G03G 21/06

See application file for complete search history.

(56) References Cited

U.S. PATENT DOCUMENTS

| | | | | |
|---|---|---|---|---|
| 8,750,738 | B2 | 6/2014 | Hano et al. | |
| 9,835,970 | B2 | 12/2017 | Shibuya et al. | |
| 9,915,889 | B2 | 3/2018 | Soda | |
| 2014/0093264 | A1* | 4/2014 | Matsushita | G03G 15/065 399/55 |
| 2016/0291499 | A1* | 10/2016 | Shibuya | G03G 15/0275 |

FOREIGN PATENT DOCUMENTS

| | | | |
|---|---|---|---|
| JP | 2003-295717 | A | 10/2003 |

* cited by examiner

*Primary Examiner* — Walter L Lindsay, Jr.
*Assistant Examiner* — Jessica L Eley
(74) *Attorney, Agent, or Firm* — Venable LLP

(57) ABSTRACT

An image forming apparatus includes a rotatable intermediate transfer member; a first image forming portion having a first photosensitive member which rotates, a first developing unit, and a first charge eliminating unit; a second image forming portion that is located on a downstream side of the first image forming portion in a rotational direction of the intermediate transfer member, and that has a second photosensitive member which rotates, a second developing unit, and a second charge eliminating unit; a transfer unit; and a switching unit that switches a light amount of the second charge eliminating unit when a usage amount of the second image forming portion reaches a predetermined amount to a value that is greater than a light amount of the first charge eliminating unit when a usage amount of the first image forming portion reaches the predetermined amount.

10 Claims, 34 Drawing Sheets

FIG. 10

| | | CUMULATIVE PRINT COUNT (k PRINTS) | | | | | | | | | | |
|---|---|---|---|---|---|---|---|---|---|---|---|---|
| | | 0 | 50 | 100 | 150 | 200 | 250 | 300 | 350 | 400 | 450 | 500 |
| | 0 | 1 | 1 | 1 | 1 | 1 | 1 | 1 | 1.1 | 1.1 | 1.1 | 1.1 |
| CUMULATIVE IMAGE RATIO | 50 | 1 | 1 | 1 | 1 | 1 | 1.1 | 1.1 | 1.1 | 1.1 | 1.1 | 1.1 |
| | 100 | 1 | 1 | 1 | 1.1 | 1.1 | 1.1 | 1.1 | 1.1 | 1.1 | 1.1 | 1.1 |
| | 150 | 1.1 | 1.1 | 1.1 | 1.1 | 1.1 | 1.1 | 1.1 | 1.1 | 1.1 | 1.2 | 1.2 |
| | 200 | 1.1 | 1.1 | 1.1 | 1.1 | 1.1 | 1.1 | 1.1 | 1.2 | 1.2 | 1.2 | 1.2 |
| | 250 | 1.1 | 1.1 | 1.1 | 1.1 | 1.1 | 1.2 | 1.2 | 1.2 | 1.2 | 1.2 | 1.2 |
| | 300 | 1.1 | 1.1 | 1.1 | 1.2 | 1.2 | 1.2 | 1.2 | 1.2 | 1.2 | 1.3 | 1.3 |
| | 350 | 1.2 | 1.2 | 1.2 | 1.2 | 1.2 | 1.2 | 1.2 | 1.3 | 1.3 | 1.3 | 1.3 |
| | 400 | 1.2 | 1.2 | 1.2 | 1.2 | 1.2 | 1.3 | 1.3 | 1.3 | 1.3 | 1.3 | 1.3 |
| | 450 | 1.2 | 1.2 | 1.2 | 1.3 | 1.3 | 1.3 | 1.3 | 1.3 | 1.3 | 1.3 | 1.3 |
| | 500 | 1.3 | 1.3 | 1.3 | 1.3 | 1.3 | 1.3 | 1.3 | 1.3 | 1.3 | 1.3 | 1.3 |

FIG. 11

| | | CUMULATIVE PRINT COUNT (k PRINTS) | | | | | | | | | | |
|---|---|---|---|---|---|---|---|---|---|---|---|---|
| | | 0 | 50 | 100 | 150 | 200 | 250 | 300 | 350 | 400 | 450 | 500 |
| | 0 | 1 | 1 | 1 | 1 | 1 | 1.1 | 1.1 | 1.1 | 1.1 | 1.1 | 1.1 |
| CUMULATIVE IMAGE RATIO | 50 | 1 | 1 | 1 | 1.1 | 1.1 | 1.1 | 1.1 | 1.1 | 1.1 | 1.1 | 1.1 |
| | 100 | 1.1 | 1.1 | 1.1 | 1.1 | 1.1 | 1.1 | 1.1 | 1.1 | 1.1 | 1.2 | 1.2 |
| | 150 | 1.1 | 1.1 | 1.1 | 1.1 | 1.1 | 1.1 | 1.1 | 1.2 | 1.2 | 1.2 | 1.2 |
| | 200 | 1.1 | 1.1 | 1.1 | 1.1 | 1.1 | 1.2 | 1.2 | 1.2 | 1.2 | 1.2 | 1.2 |
| | 250 | 1.1 | 1.1 | 1.1 | 1.2 | 1.2 | 1.2 | 1.2 | 1.2 | 1.2 | 1.3 | 1.3 |
| | 300 | 1.2 | 1.2 | 1.2 | 1.2 | 1.2 | 1.2 | 1.2 | 1.3 | 1.3 | 1.3 | 1.3 |
| | 350 | 1.2 | 1.2 | 1.2 | 1.2 | 1.2 | 1.3 | 1.3 | 1.3 | 1.3 | 1.3 | 1.3 |
| | 400 | 1.2 | 1.2 | 1.2 | 1.3 | 1.3 | 1.3 | 1.3 | 1.3 | 1.3 | 1.3 | 1.3 |
| | 450 | 1.3 | 1.3 | 1.3 | 1.3 | 1.3 | 1.3 | 1.3 | 1.3 | 1.3 | 1.3 | 1.3 |
| | 500 | 1.3 | 1.3 | 1.3 | 1.3 | 1.3 | 1.3 | 1.3 | 1.3 | 1.3 | 1.3 | 1.3 |

FIG. 12

| | | CUMULATIVE PRINT COUNT (k PRINTS) | | | | | | | | | | |
|---|---|---|---|---|---|---|---|---|---|---|---|---|
| | | 0 | 50 | 100 | 150 | 200 | 250 | 300 | 350 | 400 | 450 | 500 |
| | 0 | 1 | 1 | 1 | 1.1 | 1.1 | 1.1 | 1.1 | 1.1 | 1.1 | 1.2 | 1.2 |
| CUMULATIVE IMAGE RATIO | 50 | 1.1 | 1.1 | 1.1 | 1.1 | 1.1 | 1.1 | 1.1 | 1.2 | 1.2 | 1.2 | 1.2 |
| | 100 | 1.1 | 1.1 | 1.1 | 1.1 | 1.1 | 1.2 | 1.2 | 1.2 | 1.2 | 1.2 | 1.2 |
| | 150 | 1.1 | 1.1 | 1.1 | 1.2 | 1.2 | 1.2 | 1.2 | 1.2 | 1.2 | 1.3 | 1.3 |
| | 200 | 1.2 | 1.2 | 1.2 | 1.2 | 1.2 | 1.2 | 1.2 | 1.3 | 1.3 | 1.3 | 1.3 |
| | 250 | 1.2 | 1.2 | 1.2 | 1.2 | 1.2 | 1.3 | 1.3 | 1.3 | 1.3 | 1.3 | 1.3 |
| | 300 | 1.2 | 1.2 | 1.2 | 1.3 | 1.3 | 1.3 | 1.3 | 1.3 | 1.3 | 1.4 | 1.4 |
| | 350 | 1.3 | 1.3 | 1.3 | 1.3 | 1.3 | 1.3 | 1.3 | 1.4 | 1.4 | 1.4 | 1.4 |
| | 400 | 1.3 | 1.3 | 1.3 | 1.3 | 1.3 | 1.4 | 1.4 | 1.4 | 1.4 | 1.4 | 1.4 |
| | 450 | 1.3 | 1.3 | 1.3 | 1.4 | 1.4 | 1.4 | 1.4 | 1.4 | 1.4 | 1.4 | 1.4 |
| | 500 | 1.4 | 1.4 | 1.4 | 1.4 | 1.4 | 1.4 | 1.4 | 1.4 | 1.4 | 1.4 | 1.4 |

FIG. 13

| | LED WAVELENGTH BAND | | |
|---|---|---|---|
| | 400＜λD≦500 | 500＜λD≦610 | 610＜λD≦760 |
| YELLOW | FIG. 12 | FIG. 10 | FIG. 11 |
| MAGENTA | FIG. 12 | FIG. 11 | FIG. 10 |
| CYAN | FIG. 10 | FIG. 12 | FIG. 12 |
| BLACK | FIG. 12 | FIG. 12 | FIG. 12 |

FIG. 19

| | | CUMULATIVE PRINT COUNT (k PRINTS) | | | | | | | | | | |
|---|---|---|---|---|---|---|---|---|---|---|---|---|
| | | 0 | 50 | 100 | 150 | 200 | 250 | 300 | 350 | 400 | 450 | 500 |
| | 0 | 0 | 0 | 0 | 0 | 0 | 0 | 0 | -25 | -25 | -25 | -25 |
| CUMULATIVE IMAGE RATIO | 50 | 0 | 0 | 0 | 0 | 0 | -25 | -25 | -25 | -25 | -25 | -25 |
| | 100 | 0 | 0 | 0 | -25 | -25 | -25 | -25 | -25 | -25 | -25 | -25 |
| | 150 | -25 | -25 | -25 | -25 | -25 | -25 | -25 | -25 | -25 | -50 | -50 |
| | 200 | -25 | -25 | -25 | -25 | -25 | -25 | -25 | -50 | -50 | -50 | -50 |
| | 250 | -25 | -25 | -25 | -25 | -25 | -50 | -50 | -50 | -50 | -50 | -50 |
| | 300 | -25 | -25 | -25 | -50 | -50 | -50 | -50 | -50 | -50 | -75 | -75 |
| | 350 | -50 | -50 | -50 | -50 | -50 | -50 | -50 | -75 | -75 | -75 | -75 |
| | 400 | -50 | -50 | -50 | -50 | -50 | -75 | -75 | -75 | -75 | -75 | -75 |
| | 450 | -50 | -50 | -50 | -75 | -75 | -75 | -75 | -75 | -75 | -75 | -75 |
| | 500 | -75 | -75 | -75 | -75 | -75 | -75 | -75 | -75 | -75 | -75 | -75 |

FIG. 20

| | | CUMULATIVE PRINT COUNT (k PRINTS) | | | | | | | | | | |
|---|---|---|---|---|---|---|---|---|---|---|---|---|
| | | 0 | 50 | 100 | 150 | 200 | 250 | 300 | 350 | 400 | 450 | 500 |
| | 0 | 0 | 0 | 0 | 0 | 0 | -25 | -25 | -25 | -25 | -25 | -25 |
| CUMULATIVE IMAGE RATIO | 50 | 0 | 0 | 0 | -25 | -25 | -25 | -25 | -25 | -25 | -25 | -25 |
| | 100 | -25 | -25 | -25 | -25 | -25 | -25 | -25 | -25 | -25 | -50 | -50 |
| | 150 | -25 | -25 | -25 | -25 | -25 | -25 | -25 | -50 | -50 | -50 | -50 |
| | 200 | -25 | -25 | -25 | -25 | -25 | -50 | -50 | -50 | -50 | -50 | -50 |
| | 250 | -25 | -25 | -25 | -50 | -50 | -50 | -50 | -50 | -50 | -75 | -75 |
| | 300 | -50 | -50 | -50 | -50 | -50 | -50 | -50 | -75 | -75 | -75 | -75 |
| | 350 | -50 | -50 | -50 | -50 | -50 | -75 | -75 | -75 | -75 | -75 | -75 |
| | 400 | -50 | -50 | -50 | -75 | -75 | -75 | -75 | -75 | -75 | -75 | -75 |
| | 450 | -75 | -75 | -75 | -75 | -75 | -75 | -75 | -75 | -75 | -75 | -75 |
| | 500 | -75 | -75 | -75 | -75 | -75 | -75 | -75 | -75 | -75 | -75 | -75 |

FIG. 21

| | | CUMULATIVE PRINT COUNT (k PRINTS) | | | | | | | | | | |
|---|---|---|---|---|---|---|---|---|---|---|---|---|
| | | 0 | 50 | 100 | 150 | 200 | 250 | 300 | 350 | 400 | 450 | 500 |
| | 0 | 0 | 0 | 0 | -25 | -25 | -25 | -25 | -25 | -25 | -50 | -50 |
| CUMULATIVE IMAGE RATIO | 50 | -25 | -25 | -25 | -25 | -25 | -25 | -25 | -50 | -50 | -50 | -50 |
| | 100 | -25 | -25 | -25 | -25 | -25 | -50 | -50 | -50 | -50 | -50 | -50 |
| | 150 | -25 | -25 | -25 | -50 | -50 | -50 | -50 | -50 | -50 | -75 | -75 |
| | 200 | -50 | -50 | -50 | -50 | -50 | -50 | -50 | -75 | -75 | -75 | -75 |
| | 250 | -50 | -50 | -50 | -50 | -50 | -75 | -75 | -75 | -75 | -75 | -75 |
| | 300 | -50 | -50 | -50 | -75 | -75 | -75 | -75 | -75 | -75 | -75 | -75 |
| | 350 | -75 | -75 | -75 | -75 | -75 | -75 | -75 | -75 | -75 | -75 | -75 |
| | 400 | -75 | -75 | -75 | -75 | -75 | -75 | -75 | -75 | -75 | -75 | -75 |
| | 450 | -75 | -75 | -75 | -75 | -75 | -75 | -75 | -75 | -75 | -75 | -75 |
| | 500 | -75 | -75 | -75 | -75 | -75 | -75 | -75 | -75 | -75 | -75 | -75 |

FIG. 22

| | LED WAVELENGTH BAND | | |
|---|---|---|---|
| | 400＜λD≦500 | 500＜λD≦610 | 610＜λD≦760 |
| YELLOW | FIG. 21 | FIG. 19 | FIG. 20 |
| MAGENTA | FIG. 21 | FIG. 20 | FIG. 19 |
| CYAN | FIG. 19 | FIG. 21 | FIG. 21 |
| BLACK | FIG. 21 | FIG. 21 | FIG. 21 |

FIG. 28

| | | CUMULATIVE PRINT COUNT (k PRINTS) | | | | | | | | | | |
|---|---|---|---|---|---|---|---|---|---|---|---|---|
| | | 0 | 50 | 100 | 150 | 200 | 250 | 300 | 350 | 400 | 450 | 500 |
| CUMULATIVE IMAGE RATIO | 0 | 0 | 0 | 0 | 0 | 0 | 0 | 0 | 0 | 0 | 0 | 0 |
| | 50 | 1 | 0 | 0 | 0 | 0 | 0 | 0 | 0 | 0 | 0 | 0 |
| | 100 | 1 | 0 | 0 | 0 | 0 | 0 | 0 | 0 | 0 | 0 | 0 |
| | 150 | 1 | 0 | 0 | 0 | 0 | 0 | 0 | 0 | 0 | 0 | 0 |
| | 200 | 1 | 0 | 0 | 0 | 0 | 0 | 0 | 0 | 0 | 0 | 0 |
| | 250 | 1 | 0 | 0 | 0 | 0 | 0 | 0 | 0 | 0 | 0 | 0 |
| | 300 | 1 | 0 | 0 | 0 | 0 | 0 | 0 | 0 | 0 | 0 | 0 |
| | 350 | 1 | 0 | 0 | 0 | 0 | 0 | 0 | 0 | 0 | 0 | 0 |
| | 400 | 1 | 0 | 0 | 0 | 0 | 0 | 0 | 0 | 0 | 0 | 0 |
| | 450 | 1 | 0 | 0 | 0 | 0 | 0 | 0 | 0 | 0 | 0 | 0 |
| | 500 | 1 | 0 | 0 | 0 | 0 | 0 | 0 | 0 | 0 | 0 | 0 |
| | 550 | 1 | 0 | 0 | 0 | 0 | 0 | 0 | 0 | 0 | 0 | 0 |
| | 600 | 1 | 0 | 0 | 0 | 0 | 0 | 0 | 0 | 0 | 0 | 0 |
| | 650 | 1 | 0 | 0 | 0 | 0 | 0 | 0 | 0 | 0 | 0 | 0 |
| | 700 | 1 | 0 | 0 | 0 | 0 | 0 | 0 | 0 | 0 | 0 | 0 |
| | 750 | 1 | 0 | 0 | 0 | 0 | 0 | 0 | 0 | 0 | 0 | 0 |
| | 800 | 1 | 0 | 0 | 0 | 0 | 0 | 0 | 0 | 0 | 0 | 0 |
| | 850 | 1 | 0 | 0 | 0 | 0 | 0 | 0 | 0 | 0 | 0 | 0 |
| | 900 | 1 | 0 | 0 | 0 | 0 | 0 | 0 | 0 | 0 | 0 | 0 |
| | 950 | 1 | 0 | 0 | 0 | 0 | 0 | 0 | 0 | 0 | 0 | 0 |
| | 1000 | 1 | 0 | 0 | 0 | 0 | 0 | 0 | 0 | 0 | 0 | 1 |
| | 1050 | 1 | 0 | 0 | 0 | 0 | 0 | 0 | 0 | 0 | 1 | 1 |
| | 1100 | 1 | 0 | 0 | 0 | 0 | 0 | 0 | 0 | 1 | 1 | 1 |
| | 1150 | 1 | 0 | 0 | 0 | 0 | 0 | 0 | 1 | 1 | 1 | 1 |
| | 1200 | 1 | 0 | 0 | 0 | 0 | 0 | 1 | 1 | 1 | 1 | 1 |
| | 1250 | 1 | 0 | 0 | 0 | 0 | 1 | 1 | 1 | 1 | 1 | 1 |
| | 1300 | 1 | 0 | 0 | 0 | 1 | 1 | 1 | 1 | 1 | 1 | 1 |
| | 1350 | 1 | 0 | 0 | 1 | 1 | 1 | 1 | 1 | 1 | 1 | 1 |
| | 1400 | 1 | 0 | 1 | 1 | 1 | 1 | 1 | 1 | 1 | 1 | 1 |
| | 1450 | 1 | 1 | 1 | 1 | 1 | 1 | 1 | 1 | 1 | 1 | 1 |
| | 1500 | 1 | 1 | 1 | 1 | 1 | 1 | 1 | 1 | 1 | 1 | 1 |
| | 1550 | 1 | 1 | 1 | 1 | 1 | 1 | 1 | 1 | 1 | 1 | 1 |
| | 1600 | 1 | 1 | 1 | 1 | 1 | 1 | 1 | 1 | 1 | 1 | 1 |
| | 1650 | 1 | 1 | 1 | 1 | 1 | 1 | 1 | 1 | 1 | 1 | 1 |
| | 1700 | 1 | 1 | 1 | 1 | 1 | 1 | 1 | 1 | 1 | 1 | 1 |
| | 1750 | 1 | 1 | 1 | 1 | 1 | 1 | 1 | 1 | 1 | 1 | 1 |
| | 1800 | 1 | 1 | 1 | 1 | 1 | 1 | 1 | 1 | 1 | 1 | 1 |
| | 1850 | 1 | 1 | 1 | 1 | 1 | 1 | 1 | 1 | 1 | 1 | 1 |
| | 1900 | 1 | 1 | 1 | 1 | 1 | 1 | 1 | 1 | 1 | 1 | 1 |
| | 1950 | 1 | 1 | 1 | 1 | 1 | 1 | 1 | 1 | 1 | 1 | 1 |
| | 2000 | 1 | 1 | 1 | 1 | 1 | 1 | 1 | 1 | 1 | 1 | 1 |

FIG. 29

| | | CUMULATIVE PRINT COUNT (k PRINTS) | | | | | | | | | | |
|---|---|---|---|---|---|---|---|---|---|---|---|---|
| | | 0 | 50 | 100 | 150 | 200 | 250 | 300 | 350 | 400 | 450 | 500 |
| CUMULATIVE IMAGE RATIO | 0 | 0 | 0 | 0 | 0 | 0 | 0 | 0 | 0 | 0 | 0 | 0 |
| | 50 | 1 | 0 | 0 | 0 | 0 | 0 | 0 | 0 | 0 | 0 | 0 |
| | 100 | 1 | 0 | 0 | 0 | 0 | 0 | 0 | 0 | 0 | 0 | 0 |
| | 150 | 1 | 0 | 0 | 0 | 0 | 0 | 0 | 0 | 0 | 0 | 0 |
| | 200 | 1 | 0 | 0 | 0 | 0 | 0 | 0 | 0 | 0 | 0 | 0 |
| | 250 | 1 | 0 | 0 | 0 | 0 | 0 | 0 | 0 | 0 | 0 | 0 |
| | 300 | 1 | 0 | 0 | 0 | 0 | 0 | 0 | 0 | 0 | 0 | 0 |
| | 350 | 1 | 0 | 0 | 0 | 0 | 0 | 0 | 0 | 0 | 0 | 0 |
| | 400 | 1 | 0 | 0 | 0 | 0 | 0 | 0 | 0 | 0 | 0 | 0 |
| | 450 | 1 | 0 | 0 | 0 | 0 | 0 | 0 | 0 | 0 | 0 | 0 |
| | 500 | 1 | 0 | 0 | 0 | 0 | 0 | 0 | 0 | 0 | 0 | 0 |
| | 550 | 1 | 0 | 0 | 0 | 0 | 0 | 0 | 0 | 0 | 0 | 0 |
| | 600 | 1 | 0 | 0 | 0 | 0 | 0 | 0 | 0 | 0 | 0 | 0 |
| | 650 | 1 | 0 | 0 | 0 | 0 | 0 | 0 | 0 | 0 | 0 | 0 |
| | 700 | 1 | 0 | 0 | 0 | 0 | 0 | 0 | 0 | 0 | 0 | 0 |
| | 750 | 1 | 0 | 0 | 0 | 0 | 0 | 0 | 0 | 0 | 0 | 0 |
| | 800 | 1 | 0 | 0 | 0 | 0 | 0 | 0 | 0 | 0 | 0 | 0 |
| | 850 | 1 | 0 | 0 | 0 | 0 | 0 | 0 | 0 | 0 | 0 | 0 |
| | 900 | 1 | 0 | 0 | 0 | 0 | 0 | 0 | 0 | 0 | 0 | 0 |
| | 950 | 1 | 0 | 0 | 0 | 0 | 0 | 0 | 0 | 0 | 0 | 0 |
| | 1000 | 1 | 0 | 0 | 0 | 0 | 0 | 0 | 0 | 0 | 0 | 0 |
| | 1050 | 1 | 0 | 0 | 0 | 0 | 0 | 0 | 0 | 0 | 0 | 0 |
| | 1100 | 1 | 0 | 0 | 0 | 0 | 0 | 0 | 0 | 0 | 0 | 0 |
| | 1150 | 1 | 0 | 0 | 0 | 0 | 0 | 0 | 0 | 0 | 0 | 0 |
| | 1200 | 1 | 0 | 0 | 0 | 0 | 0 | 0 | 0 | 0 | 0 | 0 |
| | 1250 | 1 | 0 | 0 | 0 | 0 | 0 | 0 | 0 | 0 | 0 | 0 |
| | 1300 | 1 | 0 | 0 | 0 | 0 | 0 | 0 | 0 | 0 | 0 | 0 |
| | 1350 | 1 | 0 | 0 | 0 | 0 | 0 | 0 | 0 | 0 | 0 | 0 |
| | 1400 | 1 | 0 | 0 | 0 | 0 | 0 | 0 | 0 | 0 | 0 | 0 |
| | 1450 | 1 | 0 | 0 | 0 | 0 | 0 | 0 | 0 | 0 | 0 | 0 |
| | 1500 | 1 | 0 | 0 | 0 | 0 | 0 | 0 | 0 | 0 | 0 | 1 |
| | 1550 | 1 | 0 | 0 | 0 | 0 | 0 | 0 | 0 | 0 | 1 | 1 |
| | 1600 | 1 | 0 | 0 | 0 | 0 | 0 | 0 | 0 | 1 | 1 | 1 |
| | 1650 | 1 | 0 | 0 | 0 | 0 | 0 | 0 | 1 | 1 | 1 | 1 |
| | 1700 | 1 | 0 | 0 | 0 | 0 | 0 | 1 | 1 | 1 | 1 | 1 |
| | 1750 | 1 | 0 | 0 | 0 | 0 | 1 | 1 | 1 | 1 | 1 | 1 |
| | 1800 | 1 | 0 | 0 | 0 | 1 | 1 | 1 | 1 | 1 | 1 | 1 |
| | 1850 | 1 | 0 | 0 | 1 | 1 | 1 | 1 | 1 | 1 | 1 | 1 |
| | 1900 | 1 | 0 | 1 | 1 | 1 | 1 | 1 | 1 | 1 | 1 | 1 |
| | 1950 | 1 | 1 | 1 | 1 | 1 | 1 | 1 | 1 | 1 | 1 | 1 |
| | 2000 | 1 | 1 | 1 | 1 | 1 | 1 | 1 | 1 | 1 | 1 | 1 |

FIG. 30

| | | CUMULATIVE PRINT COUNT (k PRINTS) | | | | | | | | | | |
|---|---|---|---|---|---|---|---|---|---|---|---|---|
| | | 0 | 50 | 100 | 150 | 200 | 250 | 300 | 350 | 400 | 450 | 500 |
| CUMULATIVE IMAGE RATIO | 0 | 0 | 0 | 0 | 0 | 0 | 0 | 0 | 0 | 0 | 0 | 0 |
| | 50 | 1 | 0 | 0 | 0 | 0 | 0 | 0 | 0 | 0 | 0 | 0 |
| | 100 | 1 | 0 | 0 | 0 | 0 | 0 | 0 | 0 | 0 | 0 | 0 |
| | 150 | 1 | 0 | 0 | 0 | 0 | 0 | 0 | 0 | 0 | 0 | 0 |
| | 200 | 1 | 0 | 0 | 0 | 0 | 0 | 0 | 0 | 0 | 0 | 0 |
| | 250 | 1 | 0 | 0 | 0 | 0 | 0 | 0 | 0 | 0 | 0 | 0 |
| | 300 | 1 | 0 | 0 | 0 | 0 | 0 | 0 | 0 | 0 | 0 | 0 |
| | 350 | 1 | 0 | 0 | 0 | 0 | 0 | 0 | 0 | 0 | 0 | 0 |
| | 400 | 1 | 0 | 0 | 0 | 0 | 0 | 0 | 0 | 0 | 0 | 0 |
| | 450 | 1 | 0 | 0 | 0 | 0 | 0 | 0 | 0 | 0 | 0 | 0 |
| | 500 | 1 | 0 | 0 | 0 | 0 | 0 | 0 | 0 | 0 | 0 | 0 |
| | 550 | 1 | 0 | 0 | 0 | 0 | 0 | 0 | 0 | 0 | 0 | 0 |
| | 600 | 1 | 0 | 0 | 0 | 0 | 0 | 0 | 0 | 0 | 0 | 0 |
| | 650 | 1 | 0 | 0 | 0 | 0 | 0 | 0 | 0 | 0 | 0 | 0 |
| | 700 | 1 | 0 | 0 | 0 | 0 | 0 | 0 | 0 | 0 | 0 | 0 |
| | 750 | 1 | 0 | 0 | 0 | 0 | 0 | 0 | 0 | 0 | 0 | 0 |
| | 800 | 1 | 0 | 0 | 0 | 0 | 0 | 0 | 0 | 0 | 0 | 0 |
| | 850 | 1 | 0 | 0 | 0 | 0 | 0 | 0 | 0 | 0 | 0 | 0 |
| | 900 | 1 | 0 | 0 | 0 | 0 | 0 | 0 | 0 | 0 | 0 | 0 |
| | 950 | 1 | 0 | 0 | 0 | 0 | 0 | 0 | 0 | 0 | 0 | 0 |
| | 1000 | 1 | 0 | 0 | 0 | 0 | 0 | 0 | 0 | 0 | 0 | 0 |
| | 1050 | 1 | 0 | 0 | 0 | 0 | 0 | 0 | 0 | 0 | 0 | 0 |
| | 1100 | 1 | 0 | 0 | 0 | 0 | 0 | 0 | 0 | 0 | 0 | 0 |
| | 1150 | 1 | 0 | 0 | 0 | 0 | 0 | 0 | 0 | 0 | 0 | 0 |
| | 1200 | 1 | 0 | 0 | 0 | 0 | 0 | 0 | 0 | 0 | 0 | 0 |
| | 1250 | 1 | 0 | 0 | 0 | 0 | 0 | 0 | 0 | 0 | 0 | 1 |
| | 1300 | 1 | 0 | 0 | 0 | 0 | 0 | 0 | 0 | 0 | 1 | 1 |
| | 1350 | 1 | 0 | 0 | 0 | 0 | 0 | 0 | 0 | 1 | 1 | 1 |
| | 1400 | 1 | 0 | 0 | 0 | 0 | 0 | 0 | 1 | 1 | 1 | 1 |
| | 1450 | 1 | 0 | 0 | 0 | 0 | 0 | 1 | 1 | 1 | 1 | 1 |
| | 1500 | 1 | 0 | 0 | 0 | 0 | 1 | 1 | 1 | 1 | 1 | 1 |
| | 1550 | 1 | 0 | 0 | 0 | 1 | 1 | 1 | 1 | 1 | 1 | 1 |
| | 1600 | 1 | 0 | 0 | 1 | 1 | 1 | 1 | 1 | 1 | 1 | 1 |
| | 1650 | 1 | 0 | 1 | 1 | 1 | 1 | 1 | 1 | 1 | 1 | 1 |
| | 1700 | 1 | 1 | 1 | 1 | 1 | 1 | 1 | 1 | 1 | 1 | 1 |
| | 1750 | 1 | 1 | 1 | 1 | 1 | 1 | 1 | 1 | 1 | 1 | 1 |
| | 1800 | 1 | 1 | 1 | 1 | 1 | 1 | 1 | 1 | 1 | 1 | 1 |
| | 1850 | 1 | 1 | 1 | 1 | 1 | 1 | 1 | 1 | 1 | 1 | 1 |
| | 1900 | 1 | 1 | 1 | 1 | 1 | 1 | 1 | 1 | 1 | 1 | 1 |
| | 1950 | 1 | 1 | 1 | 1 | 1 | 1 | 1 | 1 | 1 | 1 | 1 |
| | 2000 | 1 | 1 | 1 | 1 | 1 | 1 | 1 | 1 | 1 | 1 | 1 |

FIG. 31

| | LED WAVELENGTH BAND | | |
|---|---|---|---|
| | 400＜λD≦500 | 500＜λD≦610 | 610＜λD≦760 |
| YELLOW | FIG. 28 | FIG. 29 | FIG. 30 |
| MAGENTA | FIG. 28 | FIG. 30 | FIG. 29 |
| CYAN | FIG. 29 | FIG. 28 | FIG. 28 |
| BLACK | FIG. 28 | FIG. 28 | FIG. 28 |

FIG. 32

| TYPE OF RECORDING MATERIAL | CONVEYANCE DIRECTION (mm) | VERTICAL (WIDTH) (mm) | 1 | 2 | 3 | 4 | 5 | 6 | 7 | 8 | 9 | 10 | 11 |
|---|---|---|---|---|---|---|---|---|---|---|---|---|---|
| B5 | 182.0 | 257.0 | | ● | ● | ● | ● | ● | ● | ● | ● | ● | |
| Executive | 184.2 | 266.7 | | ● | ● | ● | ● | ● | ● | ● | ● | ● | |
| A4 | 210.0 | 297.0 | ● | ● | ● | ● | ● | ● | ● | ● | ● | ● | ● |
| LTR | 215.9 | 279.4 | | ● | ● | ● | ● | ● | ● | ● | ● | ● | |
| A4-Tab | 223.0 | 297.0 | ● | ● | ● | ● | ● | ● | ● | ● | ● | ● | ● |
| LTR-Tab | 228.9 | 279.4 | | ● | ● | ● | ● | ● | ● | ● | ● | ● | |
| B5R | 257.0 | 182.0 | | | ● | ● | ● | ● | ● | ● | ● | | |
| LTRR | 279.4 | 215.9 | | | ● | ● | ● | ● | ● | ● | ● | | |
| A4R | 297.0 | 210.0 | | | ● | ● | ● | ● | ● | ● | ● | | |
| LGLR | 355.6 | 215.9 | | | ● | ● | ● | ● | ● | ● | ● | | |
| B4R | 364.0 | 257.0 | | ● | ● | ● | ● | ● | ● | ● | ● | ● | |
| 8KR | 390.0 | 270.0 | | ● | ● | ● | ● | ● | ● | ● | ● | ● | |
| A3R | 420.0 | 297.0 | ● | ● | ● | ● | ● | ● | ● | ● | ● | ● | ● |
| LDRR | 431.8 | 279.4 | | ● | ● | ● | ● | ● | ● | ● | ● | ● | |
| SRA3R | 450.0 | 320.0 | ● | ● | ● | ● | ● | ● | ● | ● | ● | ● | ● |
| 12 × 18R | 457.2 | 304.8 | ● | ● | ● | ● | ● | ● | ● | ● | ● | ● | ● |
| 13 × 19 | 482.6 | 330.2 | ● | ● | ● | ● | ● | ● | ● | ● | ● | ● | ● |
| 13 × 19.2 | 487.7 | 330.2 | ● | ● | ● | ● | ● | ● | ● | ● | ● | ● | ● |
| 30inch | 762.0 | 330.2 | ● | ● | ● | ● | ● | ● | ● | ● | ● | ● | ● |

IMAGE FORMING APPARATUS AND IMAGE FORMING SYSTEM

BACKGROUND OF THE INVENTION

Field of the Invention

The present invention relates to an image forming apparatus such as a copier, a printer, a facsimile machine, or a multifunction peripheral that has a plurality of the aforementioned functions, and to an image forming system that includes such an image forming apparatus.

Description of the Related Art

In an image forming apparatus that employs an electrophotographic method, after charging the surface of a photosensitive member, the surface is exposed to light, and an electrostatic latent image is formed. The electrostatic latent image is then developed as a toner image using toner, and the toner image on the photosensitive member is transferred onto an intermediate transfer belt or a recording material. Residual potential remains on the surface of the photosensitive member after the toner image is transferred, and if the next image forming operation is performed in a state in which the residual potential remains on the surface, in some cases the residual potential may appear as an afterimage on the next image.

Therefore, Japanese Patent Application Laid-Open No. 2003-295717 discloses a configuration which includes a charge eliminating unit that irradiates light onto the surface of a photosensitive member after a transfer process to thereby eliminate a charge so that the electric potential on the surface of the photosensitive member is equal to or less than a predetermined potential.

In this case, toner adheres to the charge eliminating unit accompanying image formation, and therefore the amount of light irradiated onto the photosensitive member decreases and hence the charge eliminating capability of the charge eliminating unit decreases. As a result, there is a risk that charge elimination unevenness will occur on the surface of the photosensitive member, and the quality of an image that is formed will decrease.

SUMMARY OF THE INVENTION

An object of the present invention is to provide an image forming apparatus that can suppress the influence of charge elimination unevenness on an image that accompanies image formation.

An image forming apparatus of the present invention includes: a rotatable intermediate transfer member; a first image forming portion having a first photosensitive member which rotates, a first developing unit which develops an electrostatic latent image formed on the first photosensitive member, and a first charge eliminating unit which eliminates a charge from the first photosensitive member by exposing the first photosensitive member to light after a toner image formed by the first developing unit is transferred onto the intermediate transfer member; a second image forming portion that is located on a downstream side relative to the first image forming portion in a rotational direction of the intermediate transfer member and that has a second photosensitive member which rotates, a second developing unit which develops an electrostatic latent image formed on the second photosensitive member, and a second charge eliminating unit which eliminates a charge from the second photosensitive member by exposing the second photosensitive member to light after a toner image formed by the second developing unit is transferred onto the intermediate transfer member; a transfer unit that transfers a toner image which is formed on the intermediate transfer member onto a transfer material; and a switching unit that switches a light amount of the second charge eliminating unit when a usage amount of the second image forming portion reaches a predetermined amount to a value that is greater than a light amount of the first charge eliminating unit when a usage amount of the first image forming portion reaches the predetermined amount.

Further features of the present invention will become apparent from the following description of exemplary embodiments with reference to the attached drawings.

BRIEF DESCRIPTION OF THE DRAWINGS

FIG. 10 is a view showing coefficients for light amount settings according to the first exemplary embodiment.

FIG. 11 is a view showing first light amount setting coefficients according to a second exemplary embodiment.

FIG. 12 is a view showing second light amount setting coefficients according to the second exemplary embodiment.

FIG. 13 is a view showing combinations of wavelengths of light of a charge eliminating apparatus and light amount settings with respect to image forming portions of respective colors according to the second exemplary embodiment.

FIG. 19 is a view illustrating correction amounts for a charging bias setting according to the third exemplary embodiment.

FIG. 20 is a view illustrating first charging bias setting correction amounts according to a fourth exemplary embodiment.

FIG. 21 is a view illustrating second charging bias setting correction amounts according to the fourth exemplary embodiment.

FIG. 22 is a view showing combinations of wavelengths of light of a charge eliminating apparatus and charging bias settings with respect to respective colors according to the fourth exemplary embodiment.

FIG. 28 is a view showing information transmission flags according to the fifth exemplary embodiment.

FIG. 29 is a view showing first information transmission flags according to a sixth exemplary embodiment.

FIG. 30 is a view showing second information transmission flags according to the sixth exemplary embodiment.

FIG. 31 is a view showing combinations of wavelengths of light of a charge eliminating apparatus and information transmission with respect to respective colors according to the sixth exemplary embodiment.

FIG. 32 is a view showing divided regions with respect to sizes of recording materials according to a seventh exemplary embodiment.

DESCRIPTION OF THE EMBODIMENTS

Figure 1:
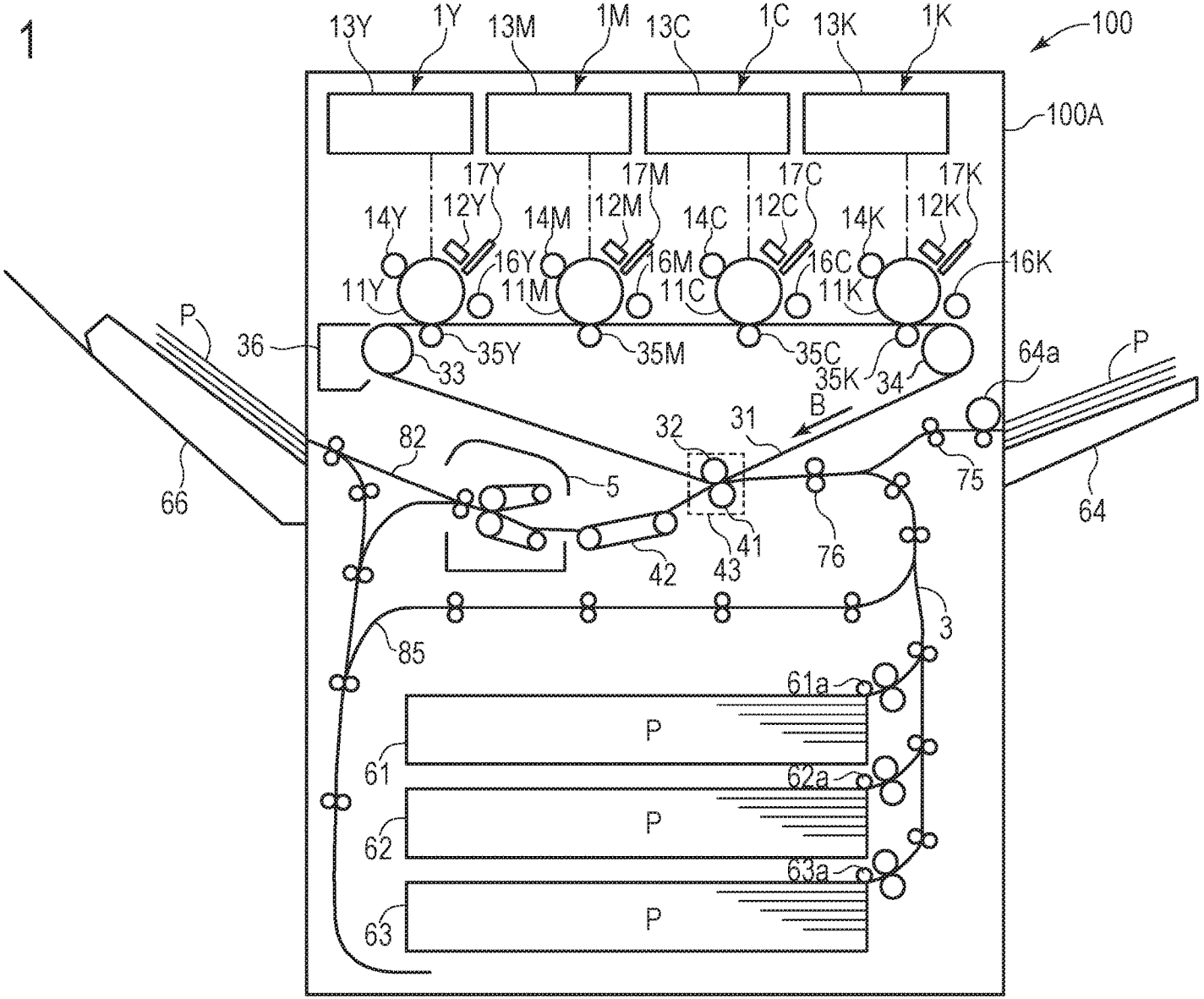
FIG. 1 is a schematic configuration sectional diagram of an image forming apparatus according to a first exemplary embodiment.

Preferred embodiments of the present invention will now be described in detail in accordance with the accompanying drawings.

First Exemplary Embodiment

A first exemplary embodiment will be described using FIG. 1 to FIG. 10. First, a schematic configuration of an image forming apparatus according to the present exemplary embodiment will be described using FIG. 1.

[Image Forming Apparatus]

An image forming apparatus 100 is a tandem intermediate transfer-type image forming apparatus having image forming portions 1Y, 1M, 1C and 1K that are arranged in series along a horizontal portion of an intermediate transfer belt 31. This type of image forming apparatus 100 forms a full-color image on a recording material P by an electrophotographic method in accordance with an image signal transmitted from an external device such as a personal computer or an image signal (image information) from a document reading apparatus. A sheet material made of paper, plastic film, cloth or the like may be mentioned as an example of the recording material.

The image forming portions 1Y, 1M, 1C and 1K form toner images of the respective colors of yellow (Y), magenta (M), cyan (C), and black (K) on photosensitive drums 11Y, 11M, 11C and 11K as cylindrical photosensitive members, and subject the toner images to primary transfer to the same image position on the intermediate transfer belt 31. The intermediate transfer belt 31 as an intermediate transfer member is stretched and rotated by a drive roller 33, a tension roller 34 and a secondary transfer inner roller 32. Primary transfer rollers 35Y, 35M, 35C and 35K as transfer units are arranged on an inner circumferential side of the intermediate transfer belt 31 at positions opposing the photosensitive drums 11Y, 11M, 11C and 11K, respectively.

The surface of the photosensitive drum 11Y is charged uniformly by a charging apparatus 12Y as a charging unit. An exposure apparatus 13Y as an exposure unit exposes the charged surface of the photosensitive drum 11Y to light based on image information to form an electrostatic latent image on the surface of the photosensitive drum 11Y. A developing apparatus 14Y as a developing unit transfers yellow toner onto the electrostatic latent image formed on the surface of the photosensitive drum 11Y to thereby develop the electrostatic latent image as a yellow toner image. The yellow toner image formed on the surface of the photosensitive drum 11Y is subjected to primary transfer onto the intermediate transfer belt 31 as a transfer material by application of a primary transfer bias to the primary transfer roller 35Y. A charge eliminating apparatus 16Y as a charge eliminating unit irradiates light onto the surface of the photosensitive drum 11Y after the toner image is transferred onto the intermediate transfer belt 31, to thereby eliminate a charge on the surface of the photosensitive drum 11Y so that the electric potential on the surface of the photosensitive drum 11Y becomes equal to or less than a predetermined electric potential (for example, −100 V or a value less than −100 V in terms of absolute value). Toner remaining on the photosensitive drum 11Y after the primary transfer of the toner image is removed by a cleaning member 17Y.

At the image forming portions 1M, 1C and 1K, toner images of magenta, cyan and black are formed on the photosensitive drums 11M, 11C and 11K, respectively, in the same manner as for the image forming portion 1Y. The respective toner images are then transferred in a superposed manner onto the yellow toner image on the intermediate transfer belt 31, to thereby form a full-color toner image on the intermediate transfer belt 31. Note that, a description of the configurations of the respective parts of the image forming portions 1M, 1C and 1K is omitted herein, and instead the characters M, C and K are respectively substituted for the suffix "Y" of reference numbers assigned to the corresponding parts in the configuration of the image forming portion 1Y.

The image forming apparatus 100 includes a plurality of cassettes 61, 62 and 63 which store the recording material P and also has a manual feed tray 64. The recording material P that is stored in the respective cassettes 61, 62 and 63 is conveyed to a recording material conveyance path 3 by rotation of any one of feeding rollers 61*a*, 62*a* and 63*a*, and arrives at a registration roller 76. The recording material P that is loaded on the manual feed tray 64 is conveyed to conveying rollers by rotation of a feeding roller 64*a*, and arrives at the registration roller 76.

The registration roller 76 feeds the recording material P to a secondary transfer portion 43 that is formed by contact between a secondary transfer outer roller 41 and the secondary transfer inner roller 32, at a timing that is synchronized with the timing of the passage of a toner image on the intermediate transfer belt 31. Then, at the secondary transfer portion 43, the toner image on the intermediate transfer belt 31 is transferred onto the recording material P by application of a predetermined pressure force and secondary transfer bias. Toner remaining on the intermediate transfer belt 31 after the transfer is thereafter removed by a belt cleaning member 36.

Next, the recording material P onto which the toner image was transferred is conveyed to a fixing device 5 by a conveyance belt 42. The recording material P is heated and pressed at the fixing device 5 to thereby fix a full-color toner image onto the surface of the recording material P. The recording material P onto which the toner image has been fixed is passed along a discharge conveyance path 82 and is discharged onto a discharge tray 66. Note that, in the case of performing duplex printing, the recording material P having the toner image fixed on the surface thereof is conveyed to a duplex conveyance path 85, and is then sent to the secondary transfer portion 43 again so that a toner image is formed on the rear surface of the recording material P.

Next, the configuration of each part of the image forming portions will be described in detail. Note that, hereinafter the image forming portion 1C is described as a representative of the image forming portions 1C, 1Y, 1M and 1K, and the description of the image forming portion 1C similarly applies with respect to the other image forming portions 1Y, 1M and 1K.

[Drum Cartridge]

The image forming portion 1C includes a drum cartridge 10C (FIG. 2) and a developing apparatus 14C as separate members, and each of these members is detachably attachable to a main body 100A (FIG. 1) of the image forming apparatus 100. As illustrated in FIG. 2, in the drum cartridge 10C, a charging apparatus (in the present exemplary embodiment, a charging roller) 12C, a cleaning member 17C, a scooping sheet 101C, a conveying screw 103C and a charge eliminating apparatus 16C are disposed around a photosensitive drum 11C. A cleaning roller 121C is caused to contact against the surface of the charging apparatus 12C.

The cleaning member 17C has a blade that contacts the surface of the photosensitive drum 11C. The cleaning member 17C uses the blade to scrape off transfer residual toner that remains on the surface of the photosensitive drum 11C after the transfer process. The scooping sheet 101C scoops the transfer residual toner that was scraped off by the cleaning member 17C, and ensures that transfer residual toner does not fall down onto the intermediate transfer belt 31 or the like. The conveying screw 103C conveys toner that was scraped off by the cleaning member 17C or toner that was scooped by the scooping sheet 101C to an unshown recovery container.

In the case of the present exemplary embodiment, the photosensitive drum 11C, the charging apparatus 12C, the cleaning roller 121C, the cleaning member 17C, the scooping sheet 101C, the conveying screw 103C and the charge eliminating apparatus 16C are integrated as the drum cartridge 10C by means of a casing 102C. Note that, although in the present exemplary embodiment the developing apparatus 14C and the drum cartridge 10C are provided as separate members, a configuration may also be adopted in which a process cartridge obtained by integrating the developing apparatus 14C and the drum cartridge 10C is detachably attachable to the main body 100A.

[Photosensitive Drum]

The photosensitive drum 11C is a rotating drum-type electrophotographic photosensitive member, and has a photosensitive layer that is formed of an OPC (organic photoconductor) having a negative charging characteristic. In the present exemplary embodiment, the photosensitive drum 11C has a diameter of 30 mm, and a length of the photosensitive drum 11C in a longitudinal direction (rotation axis direction; main scanning direction) that intersects with the rotational direction is 370 mm. The photosensitive drum 11C is rotationally driven in the counterclockwise direction in FIGS. 1 and 2 at a process speed (circumferential speed) of approximately 350 mm/sec around the center of the drum as an axis.

The photosensitive drum 11C will now be described in more detail. The photosensitive drum 11C of the present exemplary embodiment has a layer structure of a common organic photosensitive member. Specifically, the photosensitive drum 11C has a cylinder made of aluminum that is a conductive substrate on the inner side in the radial direction. An undercoat layer, an injection prevention layer, a charge generation layer, a charge transport layer and a surface protection layer are provided in that order on the cylinder.

The undercoat layer is a layer for suppressing interference of light and ensuring that the transportation of charges generated in an upper layer is not obstructed. The injection prevention layer is a layer for suppressing the passage of holes that were produced in the charge generation layer, and permitting only the passage of electrons. The charge generation layer is a layer that generates charges by means of light irradiation. The charge transport layer is a layer for transporting charges. The surface protection layer is a layer for improving a cleaning characteristic.

[Charging Apparatus]

The charging apparatus 12C is a member that contacts or comes near to the surface of the photosensitive drum 11C and charges the photosensitive drum 11C. In the present exemplary embodiment, the charging apparatus 12C is a roller shape. In the charging apparatus 12C, two end portions in the longitudinal direction (rotation axis direction) of a cored bar (supporting member) are rotatably held by a bearing member, respectively, and the charging apparatus 12C is urged towards the photosensitive drum 11C by a pressing spring as an urging unit. By this means, the charging apparatus 12C is pressed into contact with the surface of the photosensitive drum 11C with a predetermined pressing force. The charging apparatus 12C follows the rotation of the photosensitive drum 11C to rotate in the clockwise direction in FIGS. 1 and 2.

In the present exemplary embodiment, the length in the longitudinal direction (rotation axis direction) of the charging apparatus 12C is 330 mm, and the diameter of the charging apparatus 12C is 14 mm. The charging apparatus 12C has a triple-layer structure which consists of a lower layer, an intermediate layer and a surface layer that are sequentially laminated on the outer circumference of a cored bar. In the present exemplary embodiment, a round bar made of stainless steel having a diameter of 6 mm is applied as the cored bar. The lower layer is an electron-conducting layer formed of carbon-dispersed foam EPDM (ethylene propylene diene monomer), which has a specific gravity of 0.5 $g/cm^3$, a volume resistivity of $10^7$ to $10^9$ Ω·cm, and a layer thickness of approximately 3.5 mm.

The intermediate layer is formed of carbon-dispersed NBR (nitrile rubber), and has a volume resistivity of $10^2$ to $10^5$ Ω·cm, and a layer thickness of approximately 500 μm. The surface layer is an ion conducting layer formed by dispersing tin oxide and carbon in a fluorine-compound alcohol-soluble nylon resin, and has a volume resistivity of $10^7$ to $10^{10}$ Ω·cm, a surface roughness (JIS standard ten-point average surface roughness Rz) of 1.5 μm, and a layer thickness of approximately 5 μm.

The present exemplary embodiment includes a charging high-voltage power supply 120C that is capable of applying a charging bias (in the present exemplary embodiment, a charging voltage) to the charging apparatus 12C. The charging high-voltage power supply 120C has an AC power supply 122 as an alternating current generating portion, and a DC power supply 123 as a direct current generating portion. When an oscillating voltage in the form of an AC voltage superposed on a DC voltage is applied as a charging bias from the charging high-voltage power supply 120C, the charging apparatus 12C charges the surface of the rotating photosensitive drum 11C to a predetermined electric potential of negative polarity. Specifically, a DC voltage of −850 V and an AC voltage whose peak-to-peak voltage (Vpp) is 1500 V with a frequency f of 2.9 kHz are applied so that a charging potential on the photosensitive drum 11C becomes approximately −800 V at a developing position.

Note that, although in the present exemplary embodiment a charging roller is applied as a contact-type charging apparatus, the present invention is not limited thereto, and a non-contact-type corona discharge charging apparatus may be used.

[Exposure Apparatus]

An exposure apparatus 13C is a laser-beam-scanning exposure apparatus that uses a semiconductor laser beam source and a polygon mirror optical system. A laser beam amount control circuit of a controller 500 (FIG. 5) that is described later determines the exposure output of the exposure apparatus 13C so that a desired image density level is obtained with respect to a laser output signal. In the present exemplary embodiment, the exposure output is determined so that a toner image is formed that has a desired density gradation by means of binary area coverage modulation using PWM (pulse width modulation) control.

[Developing Apparatus]

The developing apparatus 14C supplies developer (toner) to an electrostatic latent image formed on the photosensitive drum 11C, and thereby visualizes the electrostatic latent image as a toner image. In the present exemplary embodiment, a reversal developing apparatus which employs a two-component magnetic brush development method that uses two-component developer including non-magnetic toner and a magnetic carrier is applied as the developing apparatus 14C.

The developing apparatus 14C includes a developing container and a developing sleeve, and the two-component developer is stored inside the developing container. The two-component developer of the present exemplary embodiment is formed as a mixture of the non-magnetic toner and the magnetic carrier, with the toner density (TD ratio) of the two-component developer that is used being made 9% by mixing at a ratio of approximately 9:91 with respect to the weight ratio between the toner and the carrier.

The toner which is used is particles obtained by kneading a pigment into a resin binder mainly consisting of polyester, and then pulverizing and classifying the kneaded product to have a mean particle diameter of approximately 6 μm.

Further, as the carrier, for example, in a surface oxidization region, unoxidized metals such as iron, nickel, cobalt, manganese, chromium, and rare earth, alloys thereof, or oxide ferrite or the like can be favorably used, and a method of manufacturing those magnetic particles is not particularly limited. Further, the carrier has a volume average particle size of 20 to 50 μm, preferably 30 to 40 μm, and a resistivity of $10^7$ Ω·cm or more, preferably $10^8$ Ω·cm or more. In the present exemplary embodiment, a carrier obtained by coating a silicon resin onto a core mainly consisting of ferrite is used, which has a volume average particle size of 35 μm, a resistivity of $5\times10^8$ Ω·cm, and a magnetization of 200 emu/cc.

The developing sleeve is arranged opposed to and close to the photosensitive drum 11C in a state of maintaining a distance of closest approach of 250 μm from the photosensitive drum 11C. A portion at which the photosensitive drum 11C and the developing sleeve are opposed to each other corresponds to a developing portion.

The surface of the developing sleeve is rotationally driven in a forward direction with respect to a moving direction of the surface of the photosensitive drum 11C at the developing portion. The developing sleeve includes a magnet roller therein. By means of the magnetic force of the magnet roller, the developing sleeve carries a two-component developer that is inside the developing container, and the two-component developer that is carried forms a magnetic brush and is rotationally conveyed to the developing portion accompanying rotation of the developing sleeve. The magnetic brush formed on the surface of the developing sleeve is regulated to a thin layer of a predetermined thickness by a regulating blade that is arranged so that a predetermined clearance exists between the regulating blade and the surface of the developing sleeve.

A predetermined developing bias is applied from a high voltage power supply (unshown) to the developing sleeve. The developing bias applied to the developing sleeve is an oscillating voltage obtained by superposing an AC voltage on a DC voltage. Specifically, when the charging potential on the photosensitive drum 11C is −800 V, a developing bias having a DC voltage of −620 V and an AC voltage whose peak-to-peak voltage (Vpp) is 1300 V with a frequency f of 10 kHz is applied.

Toner in the two-component developer is caused to selectively adhere onto the photosensitive drum 11C in correspondence with the electrostatic latent image by means of an electric field generated by the developing bias. By this means, the electrostatic latent image is developed as a toner image. At such time, the charge amount of the toner developed on the photosensitive drum 11C is approximately 30 μC/g. The developer on the developing sleeve that has passed through the developing portion is returned to a developer accumulation portion in the developing container accompanying subsequent rotation of the developing sleeve.

[Primary Transfer Roller]

In the present exemplary embodiment, a primary transfer roller 35C is applied as a device for transferring a toner image on the photosensitive drum 11C onto the intermediate transfer belt 31 as a transfer material. The primary transfer roller 35C is brought into pressure-contact with the surface of the photosensitive drum 11C across the intermediate transfer belt 31 with a predetermined pressure force. A pressure-contact nip portion formed between the primary transfer roller 35C and the surface of the photosensitive drum 11Y corresponds to primary a transfer portion at which the toner image is subjected to primary transfer from the photosensitive drum 11C to the intermediate transfer belt 31.

A roller made of a material having a resistance value of $1\times10^2$ to $1\times10^8\Omega$ when +2 kV is applied thereto under a measurement environment in which the temperature is 23° C. and the humidity is 50% can be used as the primary transfer roller 35C. In the present exemplary embodiment, an ion-conductive sponge roller which is formed of a mixture of nitrile rubber and ethylene-epichlorohydrin copolymer and which has an outer diameter of 16 mm and a cored bar diameter of 8 mm is used.

[Intermediate Transfer Belt]

The intermediate transfer belt 31 is rotationally conveyed while being nipped between the photosensitive drum 11C and the primary transfer roller 35C. As the intermediate transfer belt 31 used in the present exemplary embodiment, a belt having an elastic layer which has a soft surface is employed in order to be capable of handling a diverse range of recording materials. The aforementioned belt prevents transfer dropouts with respect to recording materials that have surface unevenness and also prevents transfer failures which are referred to as "hollow defects" which are liable to occur on coated paper, OHP paper or the like.

The intermediate transfer belt 31 has a three-layer structure of a base material, an elastic layer and a coat layer, and has a total thickness of approximately 360 μm. The base material is a conductive polyimide resin material having a thickness in a range of 80 to 90 μm. The elastic layer is formed by laminating chloroprene rubber on the base material to a thickness of 200 to 300 μm, and has a JIS-A hardness of 60°. The coat layer is configured to secure the release property of the carried toner particles or the recording material, and is an outermost layer having a thickness in a range of about 5 to 15 μm which is obtained by dispersing a fluorocarbon resin in a binder of polyurethane resin.

Regarding the resistances of the intermediate transfer belt 31, the volume resistivity is adjusted to within a range of $1\times10^9$ to $1\times10^{11}$ Ω·cm, and the surface resistivity is adjusted to within a range of $1\times10^{11}$ to $1\times10^{13}\Omega$. When performing image formation, a transfer bias (for example, +1500 V) of a positive polarity that is the opposite polarity to the negative polarity which is the normal charge polarity of the toner is applied to the primary transfer roller 35C. By this means, the toner images of the respective photosensitive drums 11Y, 11M, 11C and 11K are electrostatically transferred in sequence onto the surface of the intermediate transfer belt 31.

[Cleaning Member]

The cleaning member 17C is a member for cleaning transfer residual toner that was not transferred onto the intermediate transfer belt 31 and remains on the photosensitive drum 11C. Although blade cleaning as described above is applied in the present exemplary embodiment, the present invention is not limited thereto, and a problem will not arise if a fur brush or the like is added to the configuration.

[Charge Eliminating Apparatus]

The charge eliminating apparatus 16C has a function that eliminates a charge by utilizing light energy to remove residual potential on the photosensitive drum 11C that has passed through the primary transfer portion. The charge eliminating apparatus 16C will now be described in detail using FIG. 3 and FIG. 4. The charge eliminating apparatus 16C includes a light source portion 161C that emits light, a main light guide portion 162C, an auxiliary light guide portion 163C, and a cover member 164C as a re-reflecting portion. Further, a dominant wavelength λD of light that the charge eliminating apparatus 16C irradiates is within a range of 610 nm<λD≤760 nm.

Figure 3:
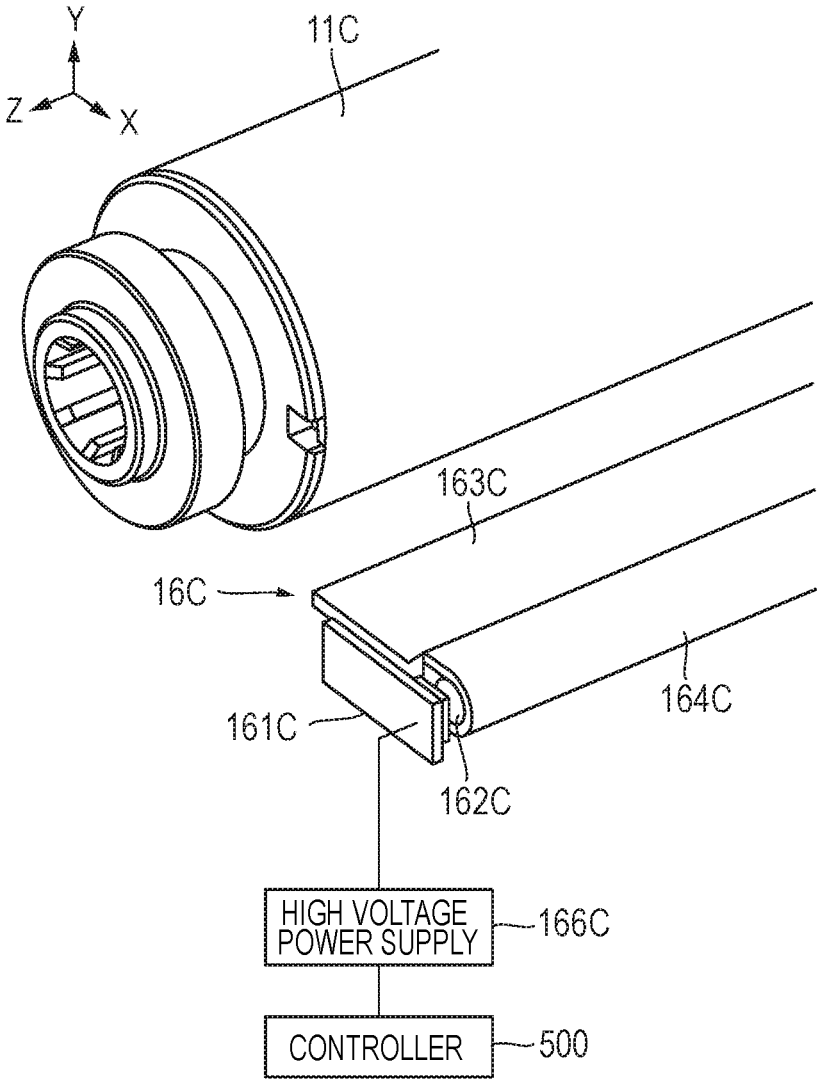
FIG. 3 is a perspective view illustrating one part of a photosensitive drum and a charge eliminating apparatus according to the first exemplary embodiment.

In the light source portion 161C, an LED that is a light source is disposed on an electric board. In the present exemplary embodiment, in the light source portion 161C, a red LED having a dominant wavelength λD=630 nm as an electro-optic property is adopted as a light emitting device. As illustrated in FIG. 3, an electric current is applied to the light source portion 161C by a high voltage power supply 166C as a high voltage application unit. The electric current that is applied is controlled to be a variable constant current, and is capable of changing the amount of light of the light source portion 161C. Note that, in the case of the present exemplary embodiment, in the high voltage power supply 166C, although it is possible to variably set the electric current, a configuration may also be adopted in which the amount of light of the light source portion 161C can be changed by constant voltage control whereby it is possible to variably set the voltage.

Figure 2:
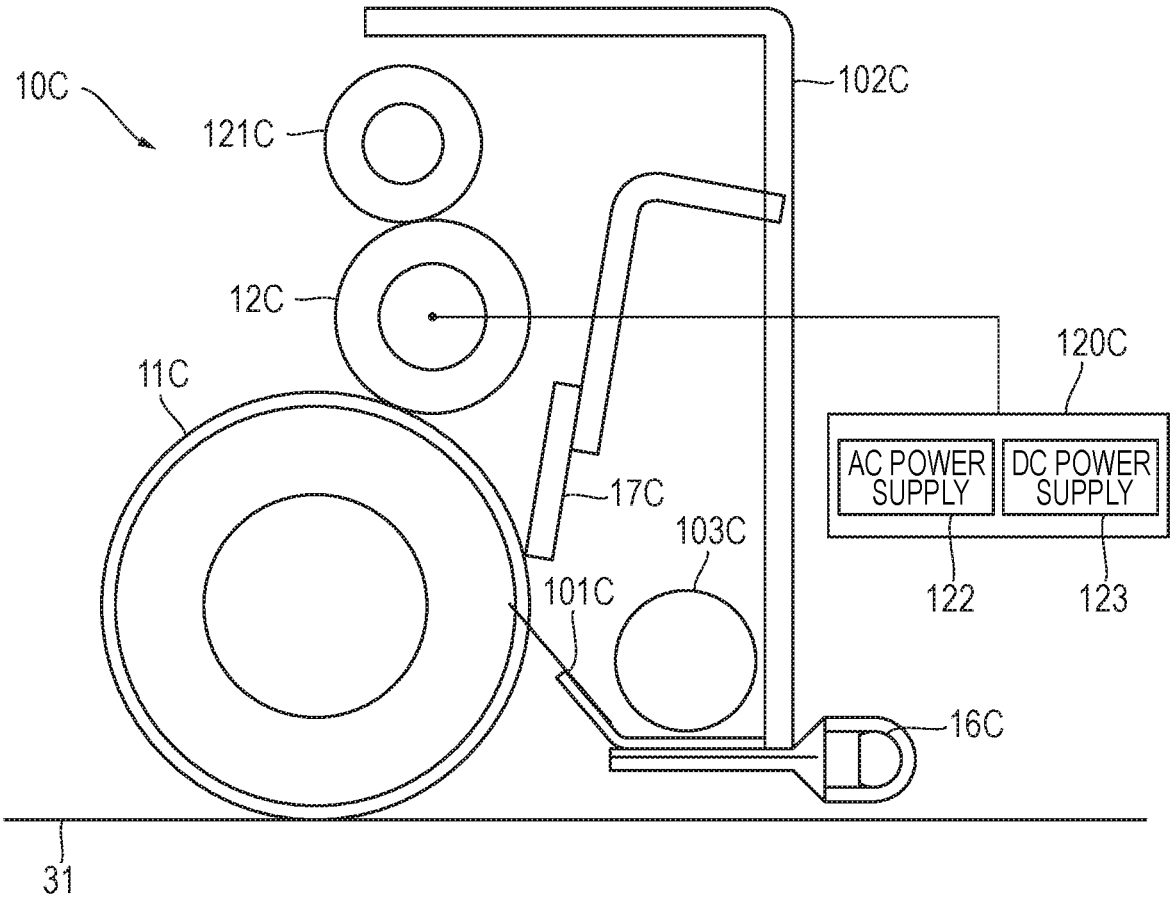
FIG. 2 is a schematic configuration sectional diagram of a drum cartridge according to the first exemplary embodiment.

In the present exemplary embodiment a configuration is adopted in which the charge eliminating apparatus 16C is integrally built into the drum cartridge 10C as described above, and is detachably attachable to the main body 100A (FIG. 1). After the drum cartridge 10C is mounted in the main body 100A, the light source portion 161C is connected to the high voltage power supply 166C that is connected to the main body 100A.

The main light guide portion 162C is an approximately cylindrical shape and is formed from polycarbonate or acryl that is an insulating material that has high optical transparency. The main light guide portion 162C is arranged so that the longitudinal direction thereof (z-direction in FIGS. 3 and 4) becomes substantially parallel with the longitudinal direction of the photosensitive drum 11C, and the light source portion 161C is provided at an end face thereof. Further, a configuration is adopted so that light emitted from the light source portion 161C is incident in the longitudinal direction from the end face of the main light guide portion 162C. The main light guide portion 162C configured in this manner guides incident light that is incident from the light source portion 161C, and also has a plurality of reflecting portions 165C (FIG. 4) which reflect incident light to the side opposite to the photosensitive drum 11C.

In the present exemplary embodiment, the reflecting portions 165C are constituted by forming slits at an angle of 45° with respect to the incident direction of light of the light source portion 161C in the main light guide portion 162C. By forming the slits, the reflecting portions 165C have a structure that totally reflects incident light by generating an air-layer boundary at the face of the polycarbonate or acryl that is the material of the main light guide portion 162C.

The cover member 164C causes light that was reflected by the plurality of reflecting portions 165C to be reflected once more. For this purpose, the cover member 164C has a substantially U-shaped cross-sectional shape, and is configured so as to cover, in the longitudinal direction, the entire portion of the main light guide portion 162C that is disposed outside of an auxiliary light guide portion 163C which is described later. Further, in the cover member 164C, at a face that faces the main light guide portion 162C, light of the light source portion 161C that was reflected by the aforementioned reflecting portions 165C is reflected again in the direction of the light incidence face of the auxiliary light guide portion 163C.

In the present exemplary embodiment, the cover member 164C is constituted as a single member made of a synthetic resin material such as acrylonitrile butadiene styrene which is formed to include a white coating. The cover member 164C is configured so that, by covering the main light guide portion 162C with a substantially U shape, the auxiliary light guide portion 163C is positioned via the cover member 164C. By this means, a loss of a part of the amount of light incident on the main light guide portion 162C due to stray light or leaked light can be reduced, and light can efficiently enter the auxiliary light guide portion 163C.

The auxiliary light guide portion 163C guides light that was reflected by the cover member 164C to the photosensitive drum 11C. For this purpose, the auxiliary light guide portion 163C is formed from polycarbonate or acryl that is an insulating material that has high optical transparency, and is disposed so as to guide reflected light that was reflected by the cover member 164C to the photosensitive drum 11C.

In the present exemplary embodiment, the auxiliary light guide portion 163C is formed in the shape of a thin flat plate having a thickness of approximately 2 mm, and is arranged so that the longitudinal direction thereof is approximately parallel to the longitudinal direction of the photosensitive drum 11C. Further, the auxiliary light guide portion 163C is arranged between the casing 102C of the drum cartridge 10C and the intermediate transfer belt 31 (see FIG. 2), and an end face on the opposite side to the main light guide portion 162C is caused to oppose the surface of the photosensitive drum 11C. The light that is incident on the auxiliary light guide portion 163C arrives at the end face on the photosensitive drum 11 side while repeating total reflection in the direction of the end face on the photosensitive drum 11C side within the thickness of the auxiliary light guide portion 163C. As a result, light is irradiated over the entire area in the longitudinal direction of the photosensitive drum 11C (z-direction in FIG. 3).

Figure 4:
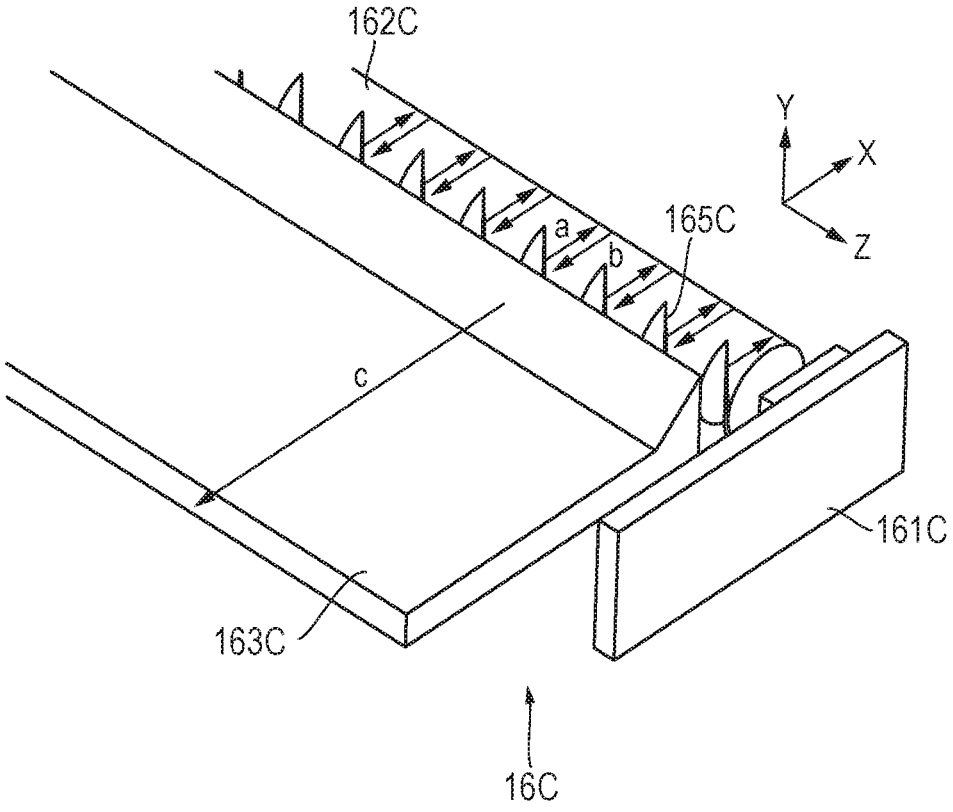
FIG. 4 is a perspective view for describing an optical path of the charge eliminating apparatus according to the first exemplary embodiment.

That is, the charge eliminating apparatus 16C causes incident light of the light source portion 161C that was incident from the end portion of the main light guide portion 162C to be guided as indicated by arrows a to c shown in FIG. 4 to thereby irradiate the light onto the photosensitive drum 11C. Further, the light that is incident on the main light guide portion 162C is reflected in the arrow a direction that is the reverse direction to the light incidence face of the auxiliary light guide portion 163C by the plurality of reflecting portions 165C that are provided in the longitudinal direction of the main light guide portion 162C. The light that is reflected in the arrow a direction is reflected again in the arrow b direction by the cover member 164C. Further, light that was incident on the main light guide portion 162C is, in this way, caused by the plurality of reflecting portions 165C and the cover member 164C to be incident on the auxiliary light guide portion 163C while spreading out over the entire area in the longitudinal direction of the main light guide portion 162C. The light that is incident on the auxiliary light guide portion 163C is guided in the arrow c direction and is irradiated onto the surface of the photosensitive drum 11C.

Note that, the charge eliminating apparatus is not limited to the above described configuration and, when taking into consideration omissions during assembly and molding and the like, may be constituted by a plurality of components. Further, with regard to the light source portion 161C, the light source portion 161C may be arranged on the main body 100A side, or a plurality of light sources may be used. Further, although a red LED is applied as a light emitting device as the light source portion 161C in the present exemplary embodiment, depending on the spectral responsivity distribution of the photosensitive drum, an LED of a different color (for example, a light emitting device having a dominant wavelength of blue or yellow) may be used.

[Controller]

Figure 5:
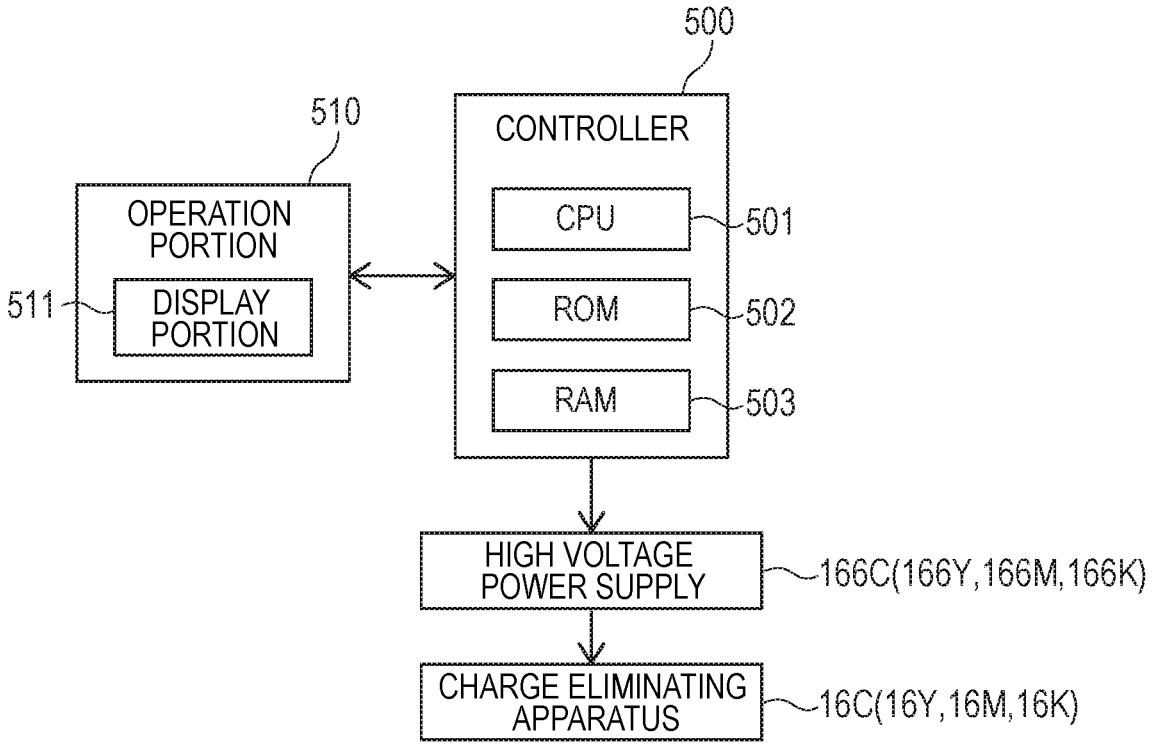
FIG. 5 is a control block diagram of the image forming apparatus according to the first exemplary embodiment.

Next, the controller 500 that performs control of the image forming apparatus 100 of the present exemplary embodiment will be described using FIG. 5. The controller 500 has a CPU (central processing unit) 501, a ROM (read only memory) 502, and a RAM (random access memory) 503. The CPU 501 performs control of each portion while reading a program corresponding to control procedures that is stored in the ROM 502. Further, work data and input data are stored in the RAM 503, and the CPU 501 performs control by referring to the data stored in the RAM 503 based on the aforementioned program and the like.

According to the present exemplary embodiment, information regarding a cumulative print count of image formation print counts, and information regarding a cumulative value relating to image information that is described in detail later are processed and stored as data by the ROM 502, the RAM 503 and the CPU 501. Further, during image formation, various processing is executed in a state in which change items are reflected.

Further, an operation portion 510 with which various settings and the like of the image forming apparatus 100 can be made is connected to the controller 500. The operation portion 510, for example, has various buttons and a display portion 511 such as a liquid crystal panel on which operations can be performed and which can display various kinds of information. The operation portion 510 is provided, for example, on the main body 100A at a position on a side on which a user performs operations. Note that the operation portion 510 may be an external device such as a personal computer.

[Light Amount Adjustment Control]

As described in the foregoing, in the charge eliminating apparatuses 16Y, 16M, 16C as 16K as charge eliminating units, toner adheres thereto accompanying image formation and the amount of light decreases, and consequently the charge eliminating capability decreases. Further, the light sources of the charge eliminating apparatuses 16Y, 16M, 16C and 16K deteriorate accompanying changes with time, and in some cases the amount of light that is irradiated onto the surfaces of the photosensitive drums 11Y, 11M, 11C and 11K also decreases. In such a case, charge elimination unevenness occurs on the surfaces of the photosensitive drums, and the image quality of an image that is formed next decreases due to an afterimage appearing in the image or the like. While it is also conceivable to set the light amount of the charge eliminating apparatuses to a large amount in advance in view of these circumstances, this is not preferable since a deterioration in the charging capability will be accelerated due to light-induced fatigue of the photosensitive drum.

Therefore, in the present exemplary embodiment, a configuration is adopted in which the contamination state at each charge eliminating apparatus is determined based on cumulative print count information and information regarding a cumulative value relating to image information, and the determined result is reflected in light amount adjustment control. That is, the controller 500 as a changing unit or switching unit is capable of changing a light amount setting of each charge eliminating apparatus based on a cumulative value relating to image information and a cumulative print count of image formation print counts. Hereunder, the flow of light amount setting control of the present exemplary embodiment is described using FIG. 6 to FIG. 9 while referring to FIG. 5.

Note that, the image forming apparatus 100 of the present exemplary embodiment adopts a system that performs image formation in the order of the colors Y, M, C and K, and the light source of each charge eliminating apparatus is set as a red LED with a dominant wavelength of 630 nm. Further, a cumulative image ratio is used as a cumulative value relating to image information.

[Light Amount Setting of Charge Eliminating Apparatus for Yellow (Y)]

Figure 6:
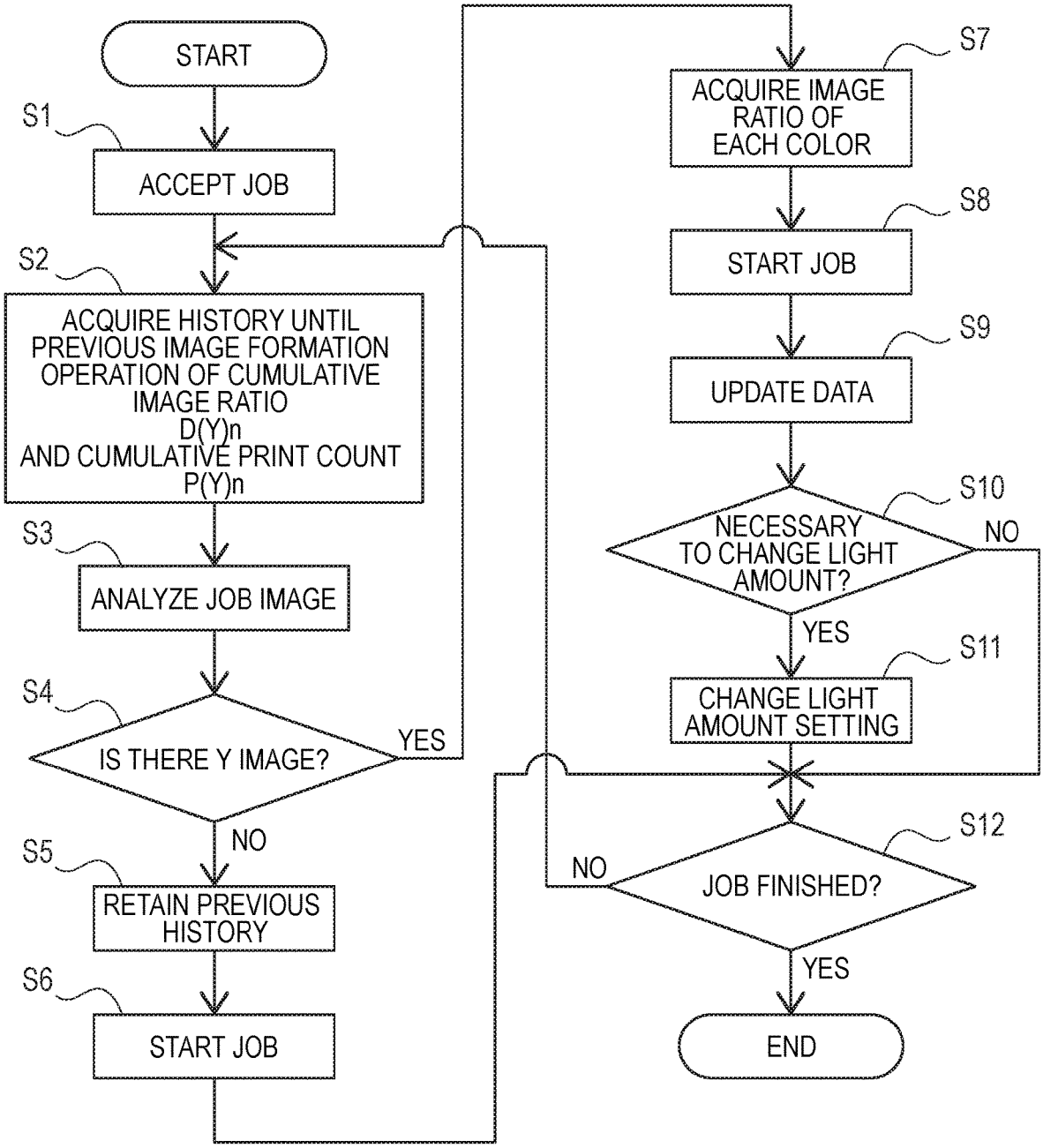
FIG. 6 is a flowchart of control for changing a light amount setting for yellow (Y) according to the first exemplary embodiment.

FIG. 6 is a flowchart illustrating the flow of control processing at the image forming portion 1Y that forms a yellow toner image. In this case, control is performed to change the light amount setting of the charge eliminating apparatus 16Y of the image forming portion 1Y. First, before accepting an image formation job (Job), the CPU 501 of the controller 500 determines whether the image forming portion 1Y is in a state in which image formation is possible, and if the state is one in which image formation is possible, the CPU 501 accepts a Job from a user (S1).

The term "image formation job" refers to a period from the start of image formation until the image formation is completed, that is based on a print signal (image formation signal) for performing image formation on a recording material. That is, an image formation job is a period in which a series of operations that include a pre-operation (pre-rotation) that is performed in advance of an image forming operation, an image forming operation, and a post-operation (post-rotation) that is performed after the image forming operation, are performed upon input of an image formation signal.

Next, the CPU 501 uses the ROM 502 and the RAM 503 to acquire the history at the time when the previous image formation ended (S2). The items that are acquired are a cumulative image ratio D(Y)n of yellow toner images and a cumulative print count P(Y)n for prints on which a yellow toner image was output at the time the previous image formation ended.

The definitions of the aforementioned acquisition items as used in the present exemplary embodiment will now be described. The term "cumulative image ratio" refers to the cumulative value of the usage ratios of the respective colors when image information for each image that is input at the time of image formation is separated into information for the colors Y/M/C/K, when taking the ratio when a solid image is formed over the entire surface (image ratio 100%) of one A4-sized recording material as 1/1000. In a case where a particular color is not used, the value for the relevant color is 0. Note that, the A4 size is a size that has a length of 297 mm in the main scanning direction (longitudinal direction of the photosensitive drum), and a length of 210 mm in the sub-scanning direction (rotational direction of photosensitive drum).

Further, the term "cumulative print count" refers to a value obtained by performing a scaling factor calculation with respect to the length in the conveyance direction (sub-scanning direction) of the size of recording materials during image formation when taking the A4 size as a reference, and obtaining a cumulative value of the thus-calculated values. Therefore, if the size of the recording materials is the A3 size, there will be an enlargement scaling factor of ×2, while in the case of a postcard or an envelope, there will be a reduction scaling factor. The above definitions similarly apply with respect to the descriptions hereinafter also.

Next, the CPU 501 analyzes the image information for the Job that was accepted as described above, and calculates an image ratio of each color (S3). The CPU 501 then determines whether or not the image information for the accepted Job includes information for an image in yellow (Y image) (S4). If there is no information for a Y image in the accepted Job (No in S4), the CPU 501 retains the history from the previous image formation time with regard to the cumulative image ratio relating to yellow in the RAM 503 (S5). The CPU 501 then starts the Job (S6).

On the other hand, in S4, if there is information for a Y image (Yes in S4), the CPU 501 acquires the image ratio of each color (S7), and the CPU 501 starts the Job (S8). Subsequently, the CPU 501 calculates an up-to-date cumulative image ratio and cumulative print count, and updates the data for the cumulative image ratio and the cumulative print count in the RAM 503 (S9).

Next, the CPU 501 acquires the updated cumulative image ratio D(Y)n and cumulative print count P(Y)n, and determines whether or not it is necessary to change the light amount of the charge eliminating apparatus 16Y based on the acquired data (S10). In other words, the CPU 501 determines the contamination state or the aged deterioration state of the charge eliminating apparatus 16Y based on the cumulative image ratio D(Y)n and the cumulative print count P(Y)n. The determination criterion is described later.

If the CPU 501 determines that it is necessary to change the light amount of the charge eliminating apparatus 16Y (Yes in S10), the CPU 501 changes the light amount setting (S11). In other words, in a case where the CPU 501 determines based on the contamination state or the state of aged deterioration that the amount of light from the charge eliminating apparatus 16Y that reaches the photosensitive drum 11Y is decreasing, the CPU 501 changes the light amount setting. The light amount setting will also be described later. Based on the changed setting value, the CPU 501 changes a voltage or an electric current that is applied to the charge eliminating apparatus 16Y from a high voltage power supply 166Y as a high voltage application unit.

On the other hand, if the CPU 501 determines in S10 that it is not necessary to change the light amount of the charge eliminating apparatus 16Y (No in S10), the CPU 501 leaves the light amount setting of the charge eliminating apparatus 16Y at the current setting, and proceeds to S12. The CPU 501 then determines whether or not the Job has ended. If the Job has not ended (No in S12), the CPU 501 returns to S2, while if the Job has ended (Yes in S12), the CPU 501 ends the control.

Note that, although in the above described flow the control from S2 to S12 is performed for each sheet on which image formation is to be performed, a configuration may also be adopted in which, for example, in S3, images of all the sheets of the relevant Job are analyzed, and control to change the light amount setting is conducted based on the information obtained as the analysis result. In this case, for example, light amount setting may be performed by taking into consideration all of the image information for the Job at the time of starting or ending the Job, or light amount setting may be performed by performing the determinations in S4 and S10 each time image formation is performed for one sheet during execution of the Job.

[Light Amount Setting of Charge Eliminating Apparatus for Magenta (M)]

Figure 7:
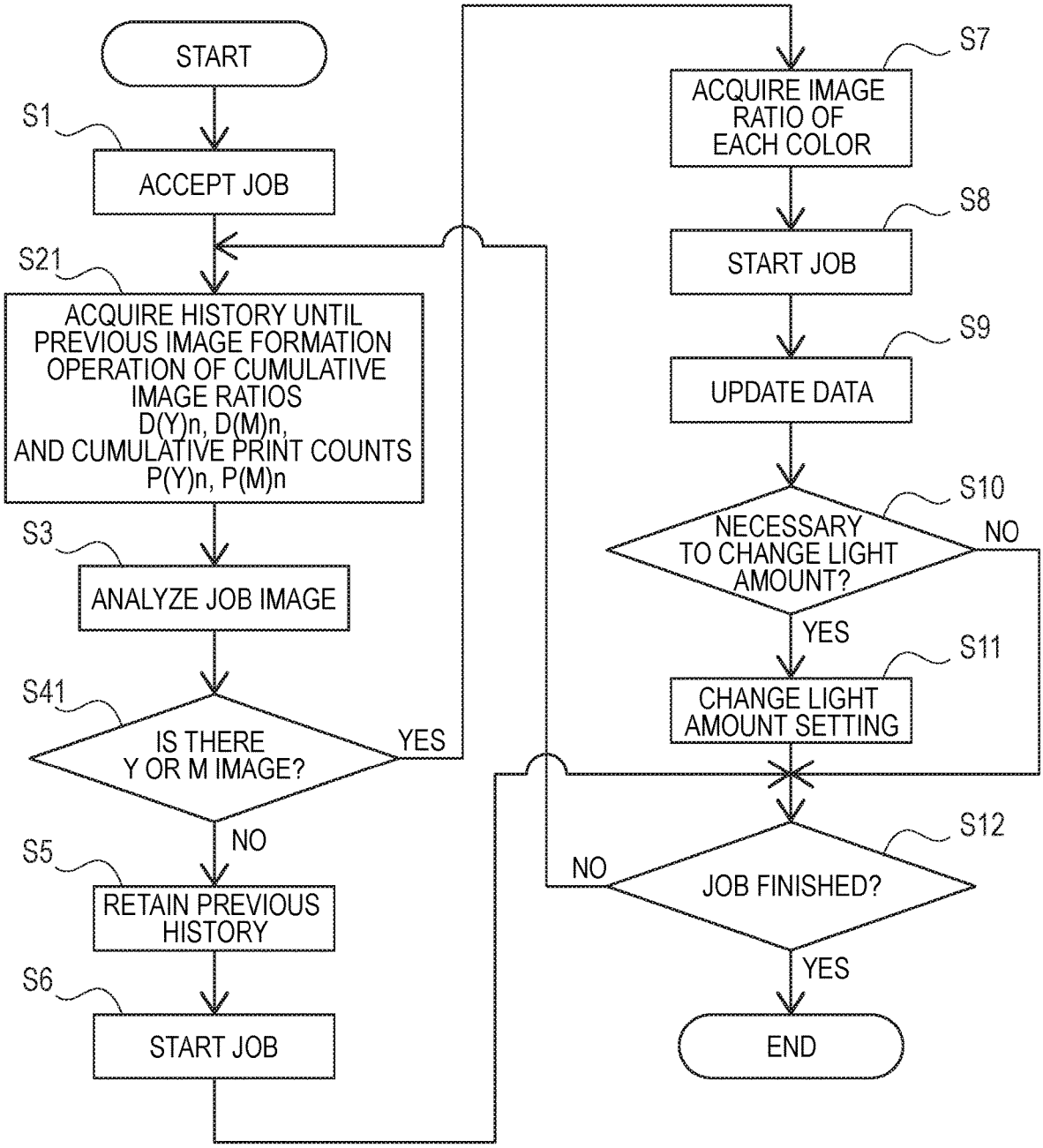
FIG. 7 is a flowchart of control for changing a light amount setting for magenta (M) according to the first exemplary embodiment.

Next, control to change the light amount setting of the charge eliminating apparatus 16M in the image forming portion 1M that forms a magenta toner image will be described using FIG. 7. Note that, steps other than S21 and S41 in FIG. 7 are fundamentally the same as the steps other than S2 and S4 described in FIG. 6, and therefore the following description centers on the parts that are different from FIG. 6.

First, upon accepting a Job in S1, the CPU 501 uses the ROM 502 and the RAM 503 to acquire the history at the time that the previous image formation ended (S21). The items that are acquired are the cumulative image ratio D(Y)n and a cumulative image ratio D(M)n for magenta toner images, and the cumulative print count P(Y)n and a cumulative print count P(M)n for prints on which a magenta toner image was output at the time the previous image formation ended.

Subsequently, the CPU 501 determines whether or not the image information analyzed in S3 includes information for an image of at least any one color among a yellow image (Y image) and a magenta image (M image) (S41). If there is no information for a Y image or an M image in the accepted Job (No in S41), the CPU 501 retains the history from the previous image formation time with regard to the cumulative image ratios relating to yellow and magenta in the RAM 503 (S5). The CPU 501 then starts the Job (S6).

On the other hand, in S41, if there is information for at least one of a Y image and an M image (Yes in S41), the CPU 501 acquires the image ratio of each color (S7), and the CPU 501 starts the Job (S8). Subsequently, the CPU 501 calculates up-to-date cumulative image ratios and cumulative print counts, and updates the data for the cumulative image ratios and the cumulative print counts in the RAM 503 (S9).

In this case, if there is information for both a Y image and an M image in S41, the CPU 501 updates the data for the cumulative image ratio and the cumulative print count of images of both colors, while on the other hand if there is information for only an image of one of the colors, the CPU 501 updates the data for the color for which there is an image, and retains the previous history with respect to the data for the color for which there is no image.

Next, the CPU 501 acquires the updated cumulative image ratios D(Y)n and D(M)n and cumulative print counts P(Y)n and P(M)n, and determines whether or not it is necessary to change the light amount of the charge eliminating apparatus 16M based on the acquired data (S10). In other words, the CPU 501 determines the contamination state and the aged deterioration state of the charge eliminating apparatus 16M based on the cumulative image ratios D(Y)n and D(M)n and the cumulative print counts P(Y)n and P(M)n.

In this case, when determining whether or not it is necessary to change the light amount of the charge eliminating apparatus 16M, a value obtained by adding the value of D(M)n to the cumulative image ratio D(Y)n (sum of D(Y)n and D(M)n) is used for the cumulative image ratio. The reason is as follows. As illustrated in FIG. 1, with respect to the rotational direction (conveyance direction) of the intermediate transfer belt 31, the image forming portion 1M (second image forming portion) is positioned on the downstream side of the image forming portion 1Y (first image forming portion). Therefore, the charge eliminating apparatus 16M of the image forming portion 1M receives the influence of toner images formed at the image forming portion 1Y that is on the upstream side thereof. In other words, it is possible for yellow toner and magenta toner to attach to the charge eliminating apparatus 16M. Therefore, in addition to the image ratio of M images which relates to the amount of magenta toner, the image ratio of Y images which relates to the amount of yellow toner is also taken into consideration when determining whether to change the light amount of the charge eliminating apparatus 16M.

If the CPU 501 determines that it is necessary to change the light amount of the charge eliminating apparatus 16M (Yes in S10), the CPU 501 changes the light amount setting (S11). Based on the changed setting value, the CPU 501 changes a voltage or an electric current that is applied to the charge eliminating apparatus 16M from a high voltage power supply 166M as a high voltage application unit.

[Light Amount Setting of Charge Eliminating Apparatus for Cyan (C)]

Figure 8:
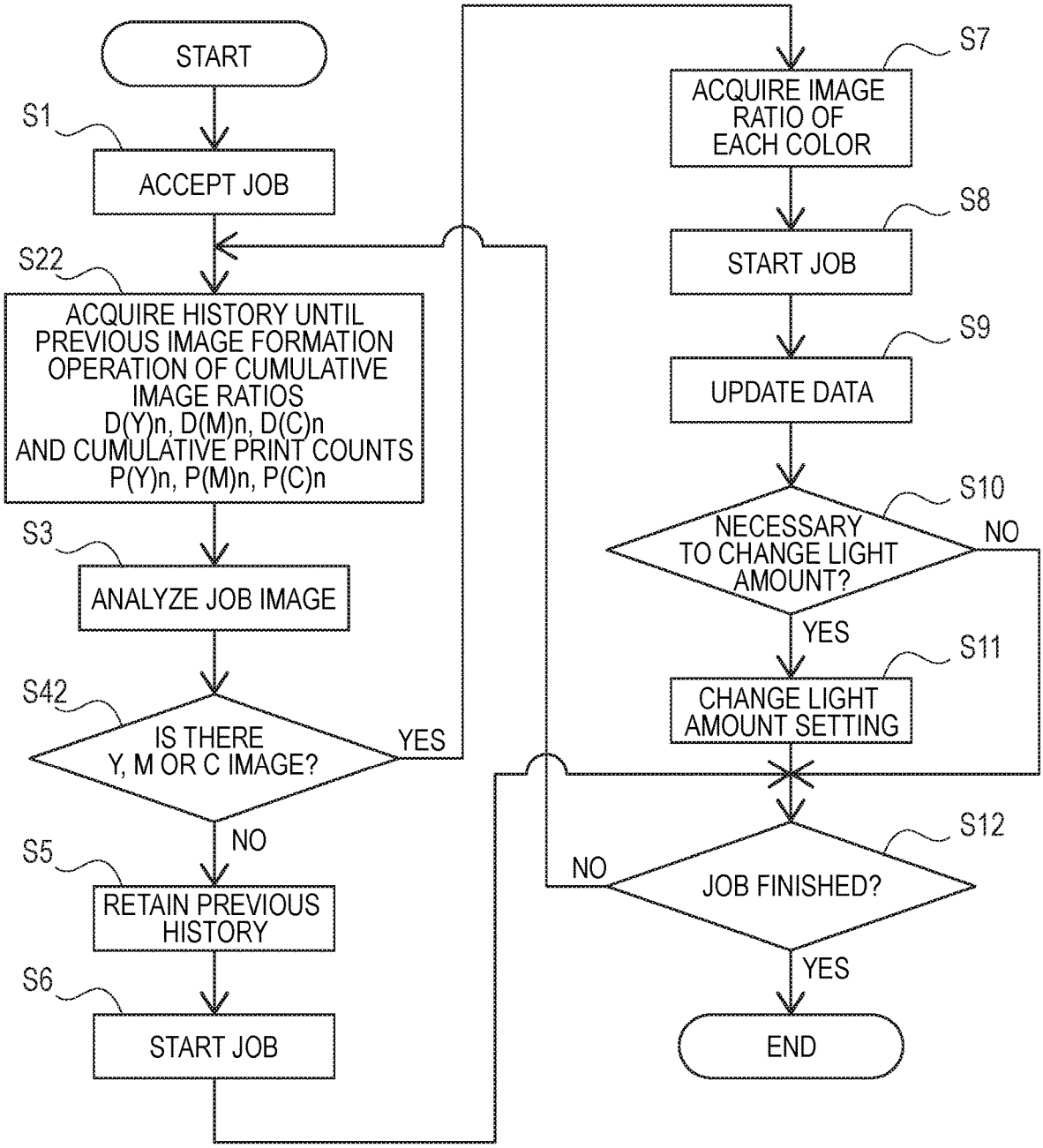
FIG. 8 is a flowchart of control for changing a light amount setting for cyan (C) according to the first exemplary embodiment.

Next, control to change the light amount setting of the charge eliminating apparatus 16C in the image forming portion 1C that forms a cyan toner image will be described using FIG. 8. Note that, steps other than S22 and S42 in FIG. 8 are fundamentally the same as the steps other than S2 and S4 described in FIG. 6, and therefore the following description centers on the parts that are different from FIG. 6.

First, upon accepting a Job in S1, the CPU 501 uses the ROM 502 and the RAM 503 to acquire the history at the time when the previous image formation ended (S22). The items that are acquired are the cumulative image ratios D(Y)n and D(M)n, a cumulative image ratio D(C)n for cyan toner images, and the cumulative print counts P(Y)n and P(M)n as well as a cumulative print count P(C)n for prints on which a cyan toner image was output at the time that the previous image formation ended.

Subsequently, the CPU 501 determines whether or not the image information analyzed in S3 includes information for an image of at least any one color among a yellow image (Y image), a magenta image (M image) and a cyan image (C image) (S42). If there is no information for a Y image, an M image or a C image in the accepted Job (No in S42), the CPU 501 retains the history from the previous image formation time with regard to the cumulative image ratios relating to yellow, magenta and cyan in the RAM 503 (S5). The CPU 501 then starts the Job (S6).

On the other hand, in S42, if there is information for at least one of a Y image, an M image and a C image (Yes in S42), the CPU 501 acquires the image ratio of each color (S7), and the CPU 501 starts the Job (S8). Next, the CPU 501 calculates up-to-date cumulative image ratios and cumulative print counts, and updates the data for the cumulative image ratios and the cumulative print counts in the RAM 503 (S9).

In this case, if there is information for any images among a Y image, an M image and a C image in S42, the CPU 501 updates the data for the color(s) for which there is an image, and retains the previous history with respect to the data for the color(s) for which there is no image. If there is information for images of all of the colors, the CPU 501 updates the data for all the images.

Next, the CPU 501 acquires the updated cumulative image ratios D(Y)n, D(M)n and D(C)n and cumulative print counts P(Y)n, P(M)n and P(C)n, and determines whether or not it is necessary to change the light amount of the charge eliminating apparatus 16C based on the acquired data (S10). In other words, the CPU 501 determines the contamination state and the aged deterioration state of the charge eliminating apparatus 16C based on the cumulative image ratios D(Y)n, D(M)n and D(C)n and the cumulative print counts P(Y)n, P(M)n and P(C)n.

In this case, when determining whether or not it is necessary to change the light amount of the charge eliminating apparatus 16C, a value obtained by adding together the cumulative image ratios D(Y)n, D(M)n and D(C)n (sum of D(Y)n, D(M)n and D(C)n) is used for the cumulative image ratio. Similarly to the case of the charge eliminating apparatus 16M, the reason is that the charge eliminating apparatus 16C of the image forming portion 1C (second image forming portion) receives the influence of toner images formed by the image forming portions 1Y and 1M (first image forming portions) that are on the upstream side thereof. In other words, it is possible for yellow toner, magenta toner and cyan toner to attach to the charge eliminating apparatus 16C. Therefore, in addition to the image ratio of C images which relates to the amount of cyan toner, the image ratio of Y images and the image ratio of M images which relate to the amounts of yellow toner and magenta toner are also taken into consideration when determining whether to change the light amount of the charge eliminating apparatus 16C.

If the CPU 501 determines that it is necessary to change the light amount of the charge eliminating apparatus 16C (Yes in S10), the CPU 501 changes the light amount setting (S11). Based on the changed setting value, the CPU 501 changes a voltage or an electric current that is applied to the charge eliminating apparatus 16C from a high voltage power supply 166C as a high voltage application unit.

[Light Amount Setting of Charge Eliminating Apparatus for Black (K)]

Figure 9:
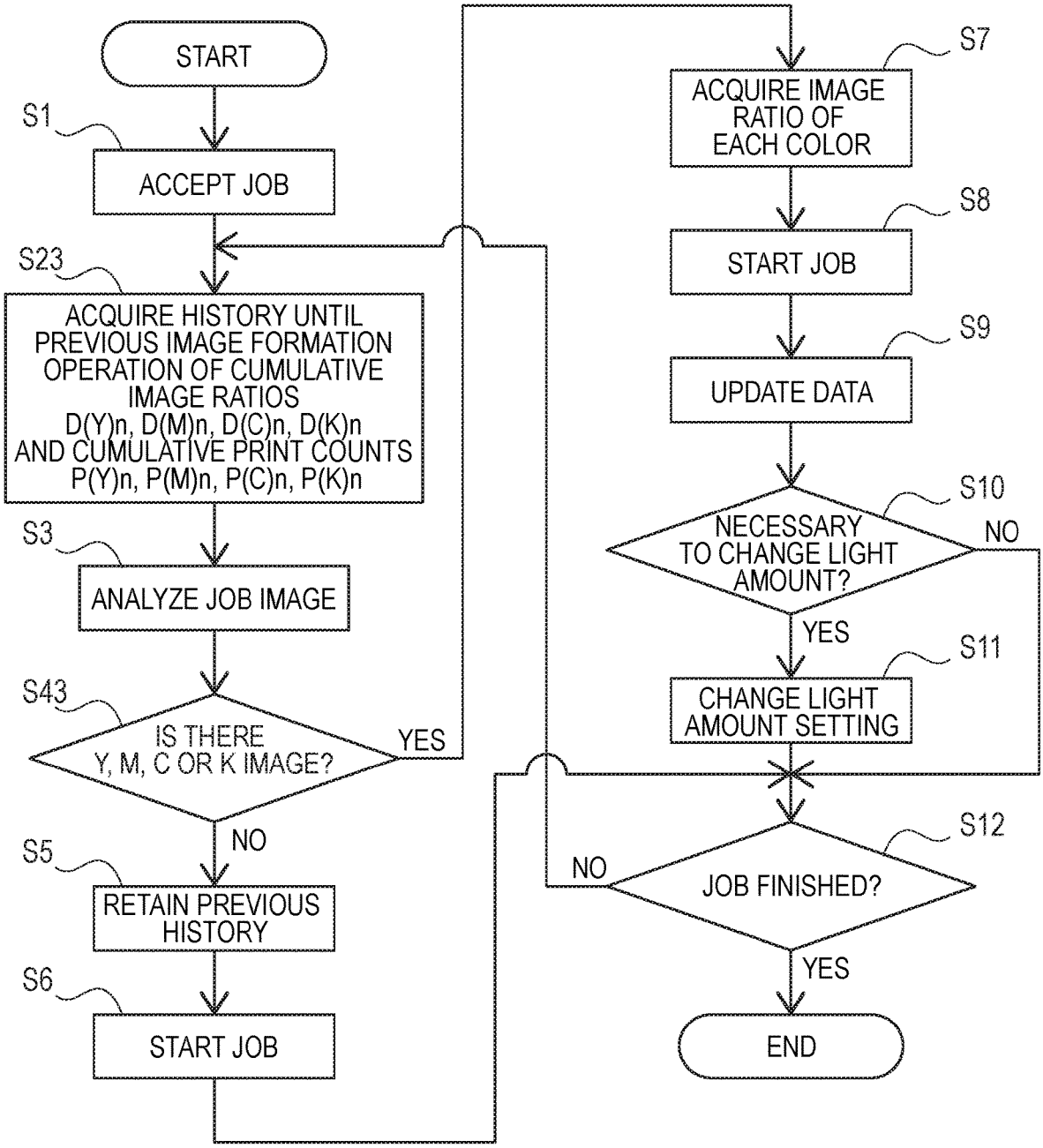
FIG. 9 is a flowchart of control for changing a light amount setting for black (K) according to the first exemplary embodiment.

Next, control to change the light amount setting of the charge eliminating apparatus 16K in the image forming portion 1K that forms a black toner image will be described using FIG. 9. Note that, steps other than S23 and S43 in FIG. 9 are fundamentally the same as the steps other than S2 and S4 described in FIG. 6, and therefore the following description centers on the parts that are different from FIG. 6.

First, upon accepting a Job in S1, the CPU 501 uses the ROM 502 and the RAM 503 to acquire the history at the time when the previous image formation ended (S23). The items that are acquired are the cumulative image ratios D(Y)n, D(M)n and D(C)n, a cumulative image ratio D(K)n for black toner images, and the cumulative print counts P(Y)n, P(M)n and P(C)n as well as a cumulative print count P(K)n for prints on which a black toner image was output at the time when the previous image formation ended.

Subsequently, the CPU 501 determines whether or not the image information analyzed in S3 includes information for an image of at least any one color among a yellow image (Y image), a magenta image (M image), a cyan image (C image) and a black image (K image) (S43). If there is no information for a Y image, an M image, a C image and a K image in the accepted Job (No in S43), the CPU 501 retains the history from the previous image formation time with regard to the cumulative image ratios relating to yellow, magenta, cyan and black in the RAM 503 (S5). The CPU 501 then starts the Job (S6).

On the other hand, in S43, if there is information for at least one of a Y image, an M image, a C image and a K image (Yes in S43), the CPU 501 acquires the image ratio of each color (S7), and the CPU 501 starts the Job (S8). Next, the CPU 501 calculates up-to-date cumulative image ratios and cumulative print counts, and updates the data for the cumulative image ratios and the cumulative print counts in the RAM 503 (S9).

In this case, if there is information for any images among a Y image, an M image, a C image and a K image in S43, the CPU 501 updates the data for the color(s) for which there is an image, and retains the previous history with respect to the data for the color(s) for which there is no image. If there is information for images of all of the colors, the CPU 501 updates the data for all the images.

Next, the CPU 501 acquires the updated cumulative image ratios D(Y)n, D(M)n, D(C)n and D(K)n and cumulative print counts P(Y)n, P(M)n, P(C)n and P(K)n. The CPU 501 then determines whether or not it is necessary to change the light amount of the charge eliminating apparatus 16K based on the acquired data (S10). In other words, the CPU 501 determines the contamination state and the aged deterioration state of the charge eliminating apparatus 16K based on the cumulative image ratios D(Y)n, D(M)n, D(C)n and D(K)n and the cumulative print counts P(Y)n, P(M)n, P(C)n and P(K)n.

In this case, when determining whether or not it is necessary to change the light amount of the charge eliminating apparatus 16K, a value obtained by adding together the cumulative image ratios D(Y)n, D(M)n, D(C)n and D(K)n (sum of D(Y)n, D(M)n, D(C)n and D(K)n) is used for the cumulative image ratio. Similarly to the case of the charge eliminating apparatus 16M, the reason is that the charge eliminating apparatus 16K of the image forming portion 1K (second image forming portion) receives the influence of toner images formed by the image forming portions 1Y, 1M and 1C (first image forming portions) that are on the upstream side thereof. In other words, it is possible for yellow toner, magenta toner, cyan toner and black toner to attach to the charge eliminating apparatus 16K. Therefore, in addition to the image ratio of K images which relates to the amount of black toner, the image ratios of Y images, M images and C images which relate to the amounts of yellow toner, magenta toner and cyan toner are also taken into consideration when determining whether to change the light amount of the charge eliminating apparatus 16K.

If the CPU 501 determines that it is necessary to change the light amount of the charge eliminating apparatus 16K (Yes in S10), the CPU 501 changes the light amount setting (S11). Based on the changed setting value, the CPU 501 changes a voltage or an electric current that is applied to the charge eliminating apparatus 16K from a high voltage power supply 166K as a high voltage application unit.

[Criteria for Determining Light Amount Setting]

The criteria for determining the light amount setting described in the aforementioned S10 of FIG. 6 to FIG. 9 will now be described using FIG. 10. FIG. 10 is a view that shows coefficients for the light amount setting with respect to the cumulative image ratio and the cumulative print count. That is, FIG. 10 is a table that shows an example of criteria for a making a determination regarding contamination of the charge eliminating apparatuses. The table shown in FIG. 10 is stored, for example, in the RAM 503, and in S10 the CPU 501 refers to the table shown in FIG. 10 and performs the light amount setting for the charge eliminating apparatus based on the coefficient corresponding to the cumulative image ratio and cumulative print count that were updated in S9.

Note that, the cumulative print count in the table is expressed as "k prints", and this means the print count is the relevant numerical value×1000 prints. For example, in the case of "50 k prints", it means the print count is 50×1000 prints. Further, with respect to the numerical values for the cumulative print counts in the table, for example, the value 0 indicates that the cumulative print count is within the range of 0 to less than 50 k prints, while the value 50 k prints indicates that the cumulative print count is within the range of 50 k prints to less than 100 k prints, and a similar meaning applies with respect to the other numerical values. Likewise, with respect to the numerical values for the cumulative image ratios within the table, for example, the value 0 indicates that the cumulative image ratio is within the range of 0 to less than 50, while the value 50 indicates that the cumulative image ratio is within the range of 50 to less than 100, and similar meanings apply with respect to the other numerical values.

The numerical values within the table indicate coefficients for light amount correction, with the value "1" indicating the initial state of the charge eliminating apparatus, and having the same meaning as "not contaminated". The other numerical values indicate changes in the amount of light of the charge eliminating apparatus from the initial state, and in the present exemplary embodiment indicate coefficients with respect to an electric current applied to the high voltage power supplies 166Y to 166K. That is, the numerical values other than "1" show coefficients with respect to an electric current that is applied to a charge eliminating apparatus in the initial state.

In the charge eliminating apparatuses 16Y to 16K of the present exemplary embodiment, the amounts of light emitted from the respective light source portions change when the electric currents are variably applied by the high voltage power supplies 166Y to 166K. For example, in the initial state of each charge eliminating apparatus, the electric current value is set in the range of 50 to 80 mA (50 mA or more to 80 mA or less). Therefore, if the electric current value in a case where the coefficient in FIG. 10 is "1" is assumed to be 50 μA, the electric current value in a case where the coefficient is "1.1" will be 55 μA. As the applied electric current value increases, the amount of light emitted from the light source portion also increases. Accordingly, the controller 500 changes the light amount setting by changing the electric current applied to the light source portion based on the coefficients in FIG. 10 in correspondence with the cumulative image ratio and the cumulative print count. Note that, the electric current applied to each charge eliminating apparatus can be increased up to the rated current (for example, 100 to 110 mA) of an LED constituting the light source portion.

As is clear from FIG. 10, according to the present exemplary embodiment, in a case where the cumulative print count is a predetermined number of prints, in a case where the cumulative image ratio is a second value that is greater than a first value, the controller 500 increases the value of the electric current that is applied to the charge eliminating apparatus relative to the value of the electric current that is applied in a case where the cumulative image ratio is the first value. Note that, in the case of variably applying a voltage to the charge eliminating apparatuses, the voltage is increased in a case where the cumulative image ratio is the second value in comparison to a case where the cumulative image ratio is the first value. In other words, when the cumulative print count is a predetermined number of prints, in a case where the cumulative image ratio is a second value that is greater than a first value, the controller 500 increases the amount of light of the charge eliminating apparatus relative to a case where the cumulative image ratio is the first value.

For example, in a case where the cumulative print count is 50 k prints, the coefficient is "1" in a case where the cumulative image ratio is 50, and the coefficient is "1.1" in a case where the cumulative image ratio is 150, and the electric current that is applied will be larger in the case where the cumulative image ratio is 150 relative to the case where the cumulative image ratio is 50. Therefore, in the case where the cumulative image ratio is the larger value of 150, the amount of light of the charge eliminating apparatus will also be larger.

Further, according to the present exemplary embodiment, when the cumulative image ratio is a prescribed value, in a case where the cumulative print count is a second number of prints that is larger than a first number of prints, the value of an electric current applied to a charge eliminating apparatus is made larger than in a case where the cumulative print count is the first number of prints. Note that, in the case of variably applying a voltage to a charge eliminating apparatus, the voltage is made larger in a case where the cumulative print count is the second number of prints compared to a case where the cumulative print count is the first number of prints. In other words, in a case where the cumulative image ratio is a prescribed value, the amount of light of a charge eliminating apparatus is made larger in a case where the cumulative print count is a second number of prints that is larger than a first number of prints in comparison to a case where the cumulative print count is the first number of prints.

For example, in a case where the cumulative image ratio is 100, the coefficient when the cumulative print count is 100 k prints is 1, and the coefficient when the cumulative print count is 200 k prints is 1.1, and thus the electric current that is applied is larger in the case where the cumulative print count is the larger amount of 200 k prints. Therefore, the amount of light of the charge eliminating apparatus is also larger in the case where the cumulative print count is the larger amount of 200 k prints.

[Specific Example of Light Amount Setting Changing Control]

Next, based on the processing flows illustrated in FIG. 6 to FIG. 9 that are described above, a case will be considered in which, for example, a Job is executed that consists of consecutively forming an image for which the image ratio is (Y/M/C/K)=(0%/100%/100%/0%) (referred to as a "blue solid image") on A4-size recording material. Note that, in the present example it is assumed that the count for each of the cumulative image ratio and the cumulative print count is started from 0.

First, based on the image analysis in S3, it is determined in S41 and S42 in FIG. 7 and FIG. 8 that magenta and cyan images are to be formed, and in S7 the necessary image ratios are acquired. Because the image ratios of magenta and cyan in a blue solid image are each 100%, in S9 the numerical value 1/1000 is cumulatively added to the cumulative image ratio each time a single image is formed. Further, in the present example, the value "1" is cumulatively added to the cumulative print count since the images are formed on A4-size recording material. Both items of data are updated as the Job continues, and the determination processing is executed in S10.

The table in FIG. 10 is referred to for the aforementioned determination processing. For example, in a case where a blue solid image is formed on 100 k prints, for the image forming portion 1M for magenta, the cumulative image ratio D(M)n will be 100 (100 k×1/1000) and the cumulative print count P(M)n will be 100 k. Therefore, the corresponding numerical value of the coefficient in the table illustrated in FIG. 10 is "1", and hence it is determined that contamination of the charge eliminating apparatus 16M has not yet occurred, and the setting for the light amount is not changed and is left at the initial setting.

However, even if the cumulative print count is the same as for the image forming portion 1M for magenta, the cumulative image ratio at the image forming portion 1C for cyan will be 200. That is, because the image forming portion 1C is located on the downstream side of the image forming portion 1M, the sum of the cumulative image ratio D(M)n of the image forming portion 1M and the cumulative image ratio D(C)n of the image forming portion 1C is used for light amount control of the charge eliminating apparatus 16C. Because the cumulative image ratios D(M)n and D(C)n are each 100, the sum is 200. On the other hand, the cumulative print count P(C)n is 100 k. Therefore, the corresponding numerical value for the coefficient in the table of FIG. 10 will be "1.1". This suggests that the charge eliminating apparatus 16C has started to become contaminated, and indicates that the contamination has reached a level at which to perform light amount correction.

The CPU 501 applies an electric current that is a current which is a multiple of 1.1 times the initial value to the charge eliminating apparatus 16C from the high voltage power supply 166C, to thereby increase the amount of light that is irradiated from the light source portion. That is, at the time point that it is determined that it is necessary to change the light amount in S10, the CPU 501 applies a voltage or a current that was corrected by an amount corresponding to the coefficient to the charge eliminating apparatus 16C from the high voltage power supply 166C. By this means, irrespective of the contamination state or the state of changes over time in the charge eliminating apparatus 16C, the light amount irradiated onto the face of the photosensitive drum 11C from the charge eliminating apparatus 16C can be kept approximately constant. That is, by using such a table, in a case where the same number of prints (number of image formations) with images having the same image ratio are formed at each of the image forming portion 1M and the image forming portion 1C, because the percentage change for the charge eliminating apparatus 16C is greater, the amount of light at the charge eliminating apparatus 16C is increased earlier than at the charge eliminating apparatus 16M.

Note that, if no images are formed at image forming portions which are located further upstream than the image forming portion 1C for cyan, the cumulative image ratio for the image forming portion 1C will be 100 and, similarly to the image forming portion 1M for magenta, it will be determined that contamination has not occurred at the charge eliminating apparatus 16C.

In the case of the present exemplary embodiment configured as described above, the influence of charge elimination unevenness on images accompanying image formation can be suppressed. That is, accompanying image formation, in some cases the amount of light of a charge eliminating apparatus decreases due to toner adhering to the charge eliminating apparatus or due to aged deterioration of the charge eliminating apparatus. Therefore, by changing the light amount setting according to the cumulative image ratio and cumulative print count as described above, the amount of light that is irradiated onto a photosensitive drum can be made approximately constant and the occurrence of charge elimination unevenness can be suppressed. As a result, a decrease in image quality due to charge elimination unevenness can be suppressed.

Note that, in the present exemplary embodiment, a red LED having a dominant wavelength $\lambda D=630$ nm as an electro-optic property is adopted as a light emitting device of the respective charge eliminating apparatuses, and variable constant current control is implemented by means of a high voltage power supply.

However, with respect to the dominant wavelength $\lambda D$ of the charge eliminating apparatuses, a yellow LED having a dominant wavelength $\lambda D$ in a range of 500 nm to 610 nm, a red LED having a dominant wavelength $\lambda D$ in a range of 610 nm to 760 nm, or a blue LED having a dominant wavelength $\lambda D$ in a range of 400 nm to 500 nm may also be used. In short, any wavelength band that is capable of eliminating charges with respect to the spectral sensitivity distribution at the photosensitive members can be applied.

Further, although in the present exemplary embodiment the image forming portions are arranged in the order of Y, M, C and K with respect to the order of colors when forming a full-color image, the present invention is not limited thereto, and another order, for example, the order Y, C, M and K, may also be adopted. In this case, the relations in the flowcharts from FIG. 6 to FIG. 9 described in the present exemplary embodiment may be appropriately changed in accordance with the order of the colors.

Second Exemplary Embodiment

A second exemplary embodiment will now be described using FIG. 11 to FIG. 13, while referring to FIG. 1 to FIG. 10. Although in the above-described exemplary embodiment only the table shown in FIG. 10 is used for control of the light amount settings of the respective image forming portions, in the present exemplary embodiment a plurality of tables are used. Since the other configurations and actions are the same as in the above-described first exemplary embodiment, the following description centers on the parts that are different from the first exemplary embodiment.

In the present exemplary embodiment, when changing the light amount setting of a charge eliminating apparatus, the percentage change with respect to the light amount of the charge eliminating apparatus of the image forming portion that uses toner with the highest absorbance with respect to the dominant wavelength of the light of the charge eliminating apparatus among the plurality of image forming portions is made greater than the percentage change in the light amount of the charge eliminating apparatuses of the other image forming portions.

The reason is as follows. Because the dispersion and absorption characteristics of light differ for each color, the percentage change when changing the light amount settings can be varied according to individual conditions. Specifically, a coefficient for light amount setting control may be changed according to a combination between a wavelength of the charge eliminating apparatus and an image forming portion that uses toner that has high absorbance, and making the percentage change with respect to toner that has high absorbance larger increases the effect with respect to the light amount setting control.

For example, in a case where a red LED for which the dominant wavelength $\lambda D$ of irradiated light is in the range of 610 nm$<\lambda D\leq$760 nm is used as the charge eliminating apparatus, a decrease in the amount of light irradiated onto the surface of the photosensitive drum will differ between a case in which the charge eliminating apparatus is contaminated with magenta toner and a case in which the charge eliminating apparatus is contaminated with cyan toner. That is, based on the findings obtained up to now, it is known that even under the same cumulative situation, the amount of light irradiated onto the surface of the photosensitive drum (onto the drum surface) will decrease more in a case where the charge eliminating apparatus is contaminated with cyan toner than in a case where the charge eliminating apparatus is contaminated with magenta toner.

This indicates that the wavelength of a red LED is a wavelength for which absorbance is high with respect to cyan, and that cyan has a high shielding factor with respect to incident light energy with regard to the amount of light that arrives on the drum surface. On the other hand, magenta has low absorbance with respect to the wavelength of a red LED, that is, the reflectivity is high. Therefore, because the energy loss is lower, a difference arises in the amount of light energy that reaches the drum surface.

In contrast, in a case where a blue LED for which the dominant wavelength $\lambda D$ of irradiated light is in the range of 400 nm$<\lambda D\leq$500 nm is used as the charge eliminating apparatus, a decrease in the amount of light on the drum surface will be greater in a case where the charge eliminating apparatus is contaminated with magenta toner than in a case where the charge eliminating apparatus is contaminated with cyan toner.

Therefore, by changing a matrix of the contamination determination criteria based on a combination of the wavelength of the LED of the charge eliminating apparatus and the photosensitive drum of the image forming portion, it is possible to provide a highly precise determination with respect to contamination as well as the optimal light amount condition.

FIG. 11 and FIG. 12 illustrate tables showing an example of criteria for determining contamination of the charge eliminating apparatuses, similarly to FIG. 10. FIG. 13 is a view showing contamination determination criteria that are applied based on combinations between the wavelengths of the LEDs of the charge eliminating apparatuses and the photosensitive drums of the image forming portions. That is, FIG. 13 shows combinations of light amount settings in which the percentage change in the light amount of a charge eliminating apparatus of an image forming portion that uses toner that has the highest absorbance with respect to the dominant wavelength of light of the charge eliminating apparatus is made larger than the percentage change in the light amount of the charge eliminating apparatuses of the other image forming portions.

The words "yellow", "magenta", "cyan" and "black" in FIG. 13 indicate the image forming portions of the respective colors. Further, in the table of FIG. 13, FIG. 10 which is described in the first exemplary embodiment and the aforementioned FIGS. 11 and 12 are described as criteria that are to be applied to the combinations (that is, tables to be used for light amount setting control).

Based on FIG. 13, a case will be considered in which, as the charge eliminating apparatuses, a red LED having a dominant wavelength $\lambda D=630$ nm is applied as a light emitting device, and image formation of a monochromatic magenta image with an image ratio of 100% and a monochromatic cyan image with an image ratio of 100%, respectively, is performed. In this case, the table of FIG. 10 is applied for the image forming portion 1M that uses magenta toner, and the table of FIG. 12 is applied for the image forming portion 1C that uses cyan toner.

By the use of such tables, in a case where the same number of prints (number of image formations) with images having the same image ratio are formed at each of the image forming portions 1M and 1C, because the percentage change is greater for the image forming portion 1C compared to the image forming portion 1M, the light amount at the image forming portion 1C is increased earlier than at the image forming portion 1M.

Thus, in the present exemplary embodiment a plurality of criteria (tables) that are applied for control of the light amount settings are prepared in correspondence with the absorbance with respect to the dominant wavelength of light of the charge eliminating apparatuses. As a result, conditions exist whereby the percentage changes in the light amounts will be different even when the cumulative print counts are the same, and it is thus possible to provide the optimal light amount condition at the image forming portion of each color.

Note that, in the present exemplary embodiment, contamination determination criteria are described that are applied for Y, M, C and K with respect to three kinds of wavelength regions. However, for example, even in a case where special colors (white, gold, silver) or the like are used, the current determination criteria may be used in accordance with the absorption distribution, or separate determination criteria may be added.

Third Exemplary Embodiment

A third exemplary embodiment will now be described using FIG. 14 to FIG. 19 while referring to FIG. 1 to FIG. 4. In the above-described first exemplary embodiment, the light amount settings of the charge eliminating apparatuses are changed based on a cumulative image ratio and a cumulative print count. In contrast, according to the present exemplary embodiment a configuration is adopted so as to change a setting for the charging bias of charging apparatuses based on a cumulative image ratio and a cumulative print count. Since the other configurations and actions are the same as in the above-described first exemplary embodiment, the following description centers on the points that are different from the first exemplary embodiment.

Figure 14:
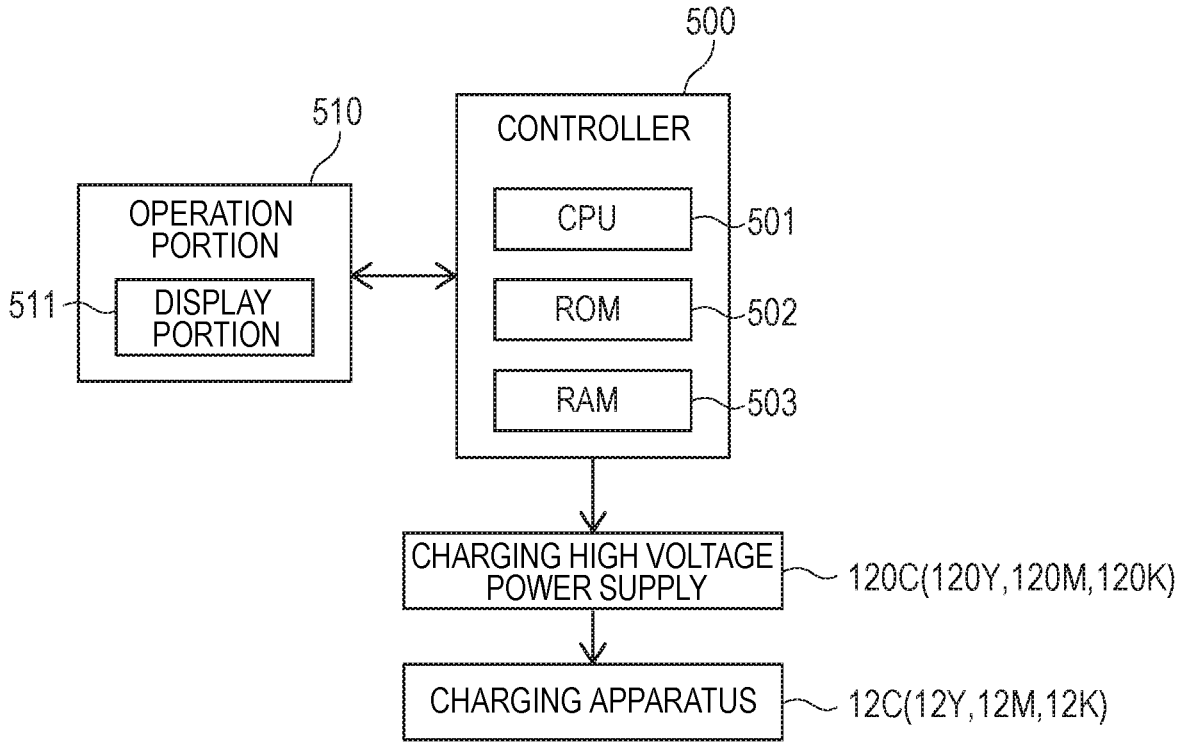
FIG. 14 is a control block diagram of an image forming apparatus according to a third exemplary embodiment.

As described with respect to FIG. 2 of the aforementioned first exemplary embodiment, a charging bias is applied from the charging high-voltage power supply 120C to the charging apparatus 12C. The charging high-voltage power supply 120C has an AC power supply 122 as an alternating current generating portion, and a DC power supply 123 as a direct current generating portion. Further, the charging apparatus 12C charges the surface of the rotating photosensitive drum 11C to a predetermined electric potential of negative polarity by application of an oscillating voltage obtained by superposing an AC voltage on a DC voltage as a charging bias from the charging high-voltage power supply 120C. As illustrated in FIG. 14, with respect to other charging apparatuses 12Y, 12M and 12K also, a charging bias is similarly from charging high-voltage power supplies 120Y, 120M and 120K.

These charging high-voltage power supplies 120Y to 120K are controlled by the controller 500 as a changing unit. The controller 500 is capable of changing the settings of the charging biases of the charging apparatuses 12Y to 12K based on image information relating to a cumulative value and a cumulative print count of image formation print counts.

That is, according to the aforementioned first exemplary embodiment, in a case where the amount of light irradiated onto a photosensitive drum surface from a charge eliminating apparatus decreased due to toner contamination or the like, control is performed so as to change the light amount of the charge eliminating apparatus and thereby suppress the occurrence of charge elimination unevenness. However, charge elimination unevenness can also be reduced by raising the absolute value of the charging bias of the charging apparatus that charges the photosensitive drum surface.

That is, even when charge elimination unevenness (electric potential unevenness) arises on the surface of a photosensitive drum, the charge elimination unevenness is evened out to a certain extent by application of a charging bias by a charging apparatus thereafter. At such time, if the absolute value of the charging bias applied to the charging apparatus is increased, the effect of evening out the charge elimination unevenness on the photosensitive drum surface increases. Accordingly, even if the amount of light irradiated onto a photosensitive drum surface from a charge eliminating apparatus decreased due to toner contamination or the like, and the charge elimination unevenness on the photosensitive drum surface increased, the charge elimination unevenness can be evened out by increasing the charging bias, and the influence of the charge elimination unevenness on the next image can be reduced.

Further, when forming electrostatic latent images by means of an exposure apparatus on a charged photosensitive drum surface, in order to form a toner image of the same density even when the charging bias is changed, the potential of an exposed portion (bright portion potential) is made constant by increasing the exposure amount (laser power or the like). Consequently, in a case where the charging bias is increased, the difference in potential between the charging potential and the bright portion potential increases, and even if charge elimination unevenness remains to a certain extent, it is harder for the charge elimination unevenness to be seen in an image.

According to the present exemplary embodiment, a configuration is adopted so as to obtain an image of a desired density even if the charging bias is changed, by also changing the exposure amount of the exposure apparatus and the developing bias of the developing apparatus accompanying a change in the charging bias. Note that, a primary transfer bias that is applied to the primary transfer roller and a secondary transfer bias that is applied to the secondary transfer portion are appropriately adjusted by, for example, constant current control or constant voltage control. That is, in the case of constant current control, control is performed so that a desired transfer current flows to a transfer portion. Further, in the case of constant voltage control, for example, a transfer voltage is set when starting an image formation job or the like. The control that sets the voltage is for example, ATVC (Active Transfer Voltage Control) that sets a transfer voltage so that, for example, a desired transfer current flows to the primary transfer portion and the secondary transfer portion.

Hereunder, the flow of charging bias setting control of the present exemplary embodiment is described using FIG. 15 to FIG. 18 while referring to FIG. 14.

[Charging Bias Setting of Charging Apparatus for Yellow]

Figure 15:
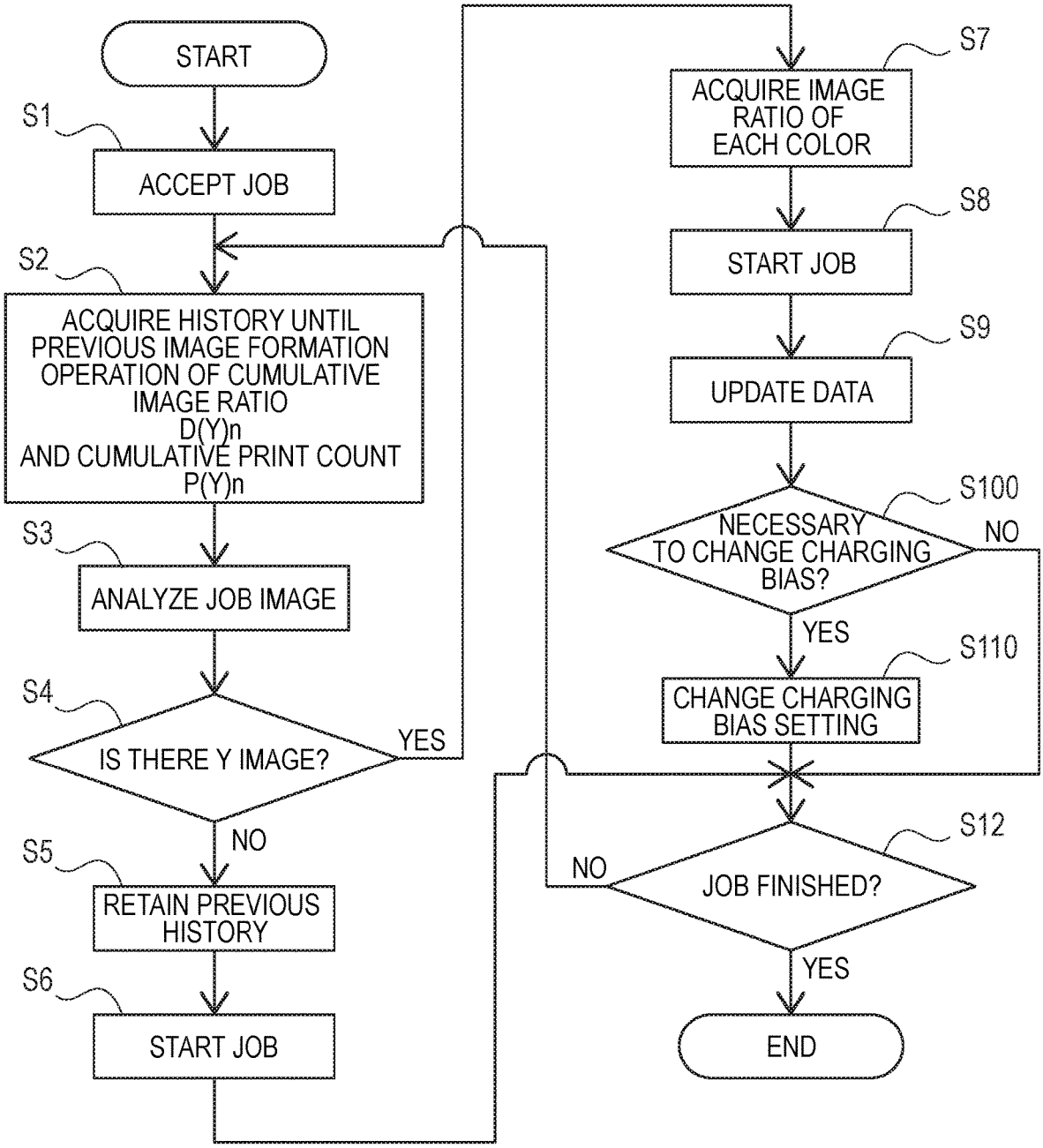
FIG. 15 is a flowchart illustrating control for changing a charging bias setting for yellow (Y) according to the third exemplary embodiment.

FIG. 15 is a view illustrating a flow of control processing at the image forming portion 1Y that forms a yellow toner image. In this case, control is performed to change the charging bias setting of the charging apparatus 12Y for the image forming portion 1Y. Note that, steps other than S100 and S110 in FIG. 15 are fundamentally the same as the steps other than S10 and S11 described in FIG. 6 of the first exemplary embodiment, and therefore the following description centers on the parts that are different from FIG. 6.

In S4, if there is information for a Y image (Yes in S4), the CPU 501 acquires the image ratio of each color (S7), and the CPU 501 starts the Job (S8). Subsequently, the CPU 501 calculates an up-to-date cumulative image ratio and cumulative print count, and updates the data for the cumulative image ratio and the cumulative print count in the RAM 503 (S9).

Next, the CPU 501 acquires the updated cumulative image ratio D(Y)n and cumulative print count P(Y)n, and determines whether or not it is necessary to change the charging bias of the charging apparatus 12Y based on the acquired data (S100). In other words, the CPU 501 determines the contamination state and the state of aged deterioration of the charge eliminating apparatus 16Y based on the cumulative image ratio D(Y)n and the cumulative print count P(Y)n. The determination criteria are described later.

If the CPU 501 determines that it is necessary to change the charging bias of the charging apparatus 12Y (Yes in S100), the CPU 501 changes the charging bias setting (S110). In other words, in a case where the CPU 501 determines based on the contamination state or the state of aged deterioration that the amount of light from the charge eliminating apparatus 16Y that reaches the photosensitive drum 11Y is decreasing, the CPU 501 changes the charging bias setting. The charging bias setting will also be described later. Based on the changed setting value, the CPU 501 changes a charging bias that is applied to the charging apparatus 12Y from the charging high-voltage power supply 120Y.

On the other hand, if the CPU 501 determines in S100 that it is not necessary to change the charging bias of the charging apparatus 12Y (No in S100), the CPU 501 leaves the charging bias of the charging apparatus 12Y at the current setting, and proceeds to S12. The CPU 501 then determines whether or not the Job has finished. If the Job has not ended (No in S12), the CPU 501 returns to S2, while if the Job has finished (Yes in S12), the CPU 501 ends the control.

[Charging Bias Setting of Charging Apparatus for Magenta]

Figure 16:
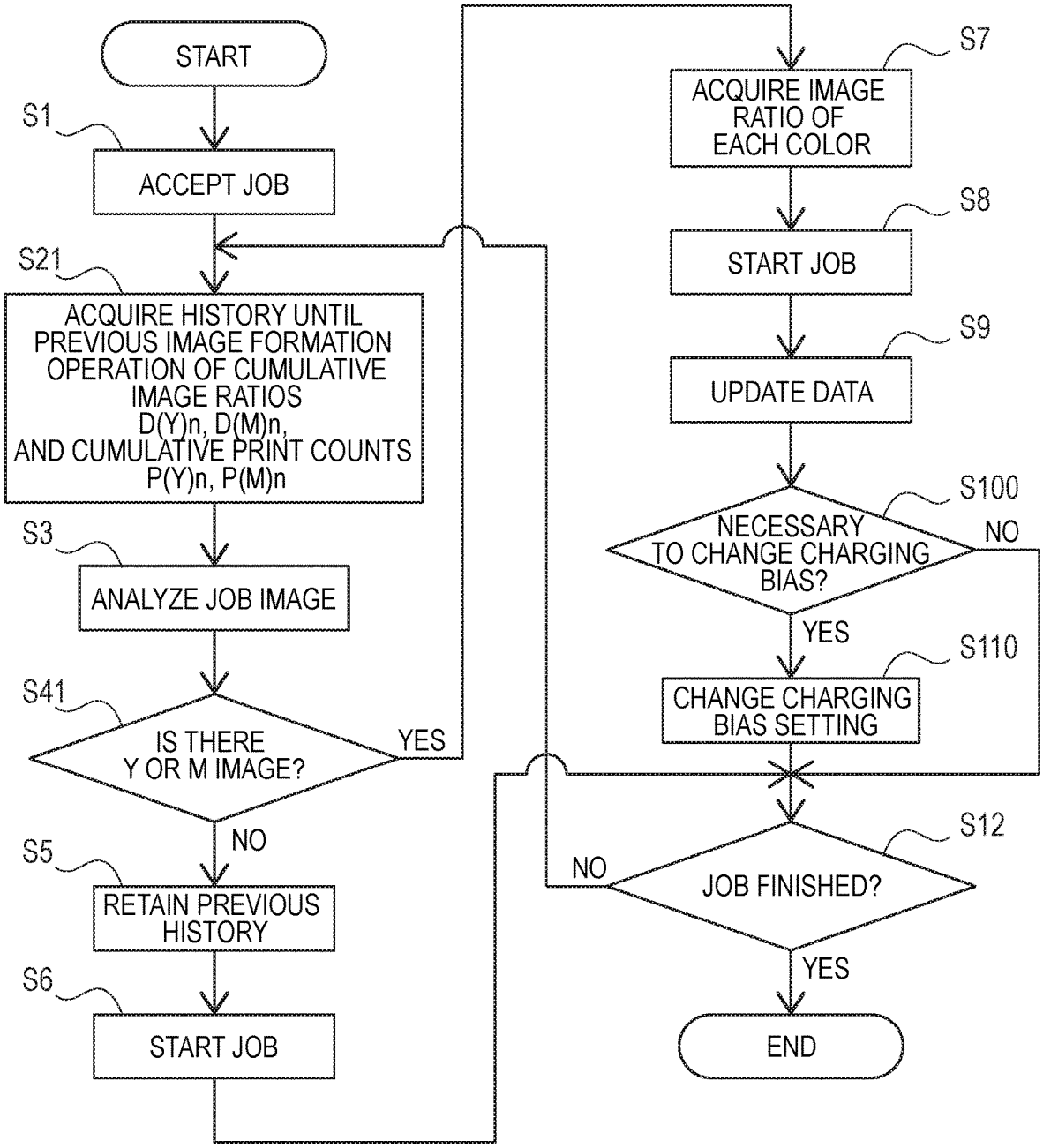
FIG. 16 is a flowchart illustrating control for changing a charging bias setting for magenta (M) according to the third exemplary embodiment.

Next, control to change the charging bias setting of the charging apparatus 12M at the image forming portion 1M that forms a magenta toner image will be described using FIG. 16. Note that, steps other than S21 and S41 in FIG. 16 are fundamentally the same as the steps other than S2 and S4 in FIG. 15. Further, steps other than S100 and S110 in FIG. 16 are fundamentally the same as the steps other than S10 and S11 described in FIG. 7 of the first exemplary embodiment. Therefore, only an outline of control for changing the charging bias setting of the charging apparatus 12M at the image forming portion 1M will be described hereunder.

First, the history until the previous image formation that is acquired in S21 is the cumulative image ratio D(Y)n and a cumulative image ratio D(M)n for magenta toner images as well as the cumulative print count P(Y)n and a cumulative print count P(M)n for prints on which a magenta toner image was output at the time the previous image formation ended.

Further, in S100, the CPU 501 acquires the updated cumulative image ratios D(Y)n and D(M)n and cumulative print counts P(Y)n and P(M)n, and determines whether or not it is necessary to change the charging bias of the charging apparatus 12M based on the acquired data. In other words, the CPU 501 determines the contamination state and the aged deterioration state of the charge eliminating apparatus 16M based on the cumulative image ratios D(Y)n and D(M)n and the cumulative print counts P(Y)n and P(M)n.

In this case, when determining whether or not it is necessary to change the charging bias of the charging apparatus 12M, similarly to the case of the processing in FIG. 7, a value obtained by adding the value of D(M)n to the cumulative image ratio D(Y)n (the sum of D(Y)n and D(M)n) is used for the cumulative image ratio.

If the CPU 501 determines in S100 that it is necessary to change the charging bias of the charging apparatus 12M (Yes in S100), the CPU 501 changes the charging bias setting (S110). Based on the changed setting value, the CPU 501 changes the charging bias that is applied to the charging apparatus 12M from the charging high-voltage power supply 120M.

[Charging Bias Setting of Charging Apparatus for Cyan]

Figure 17:
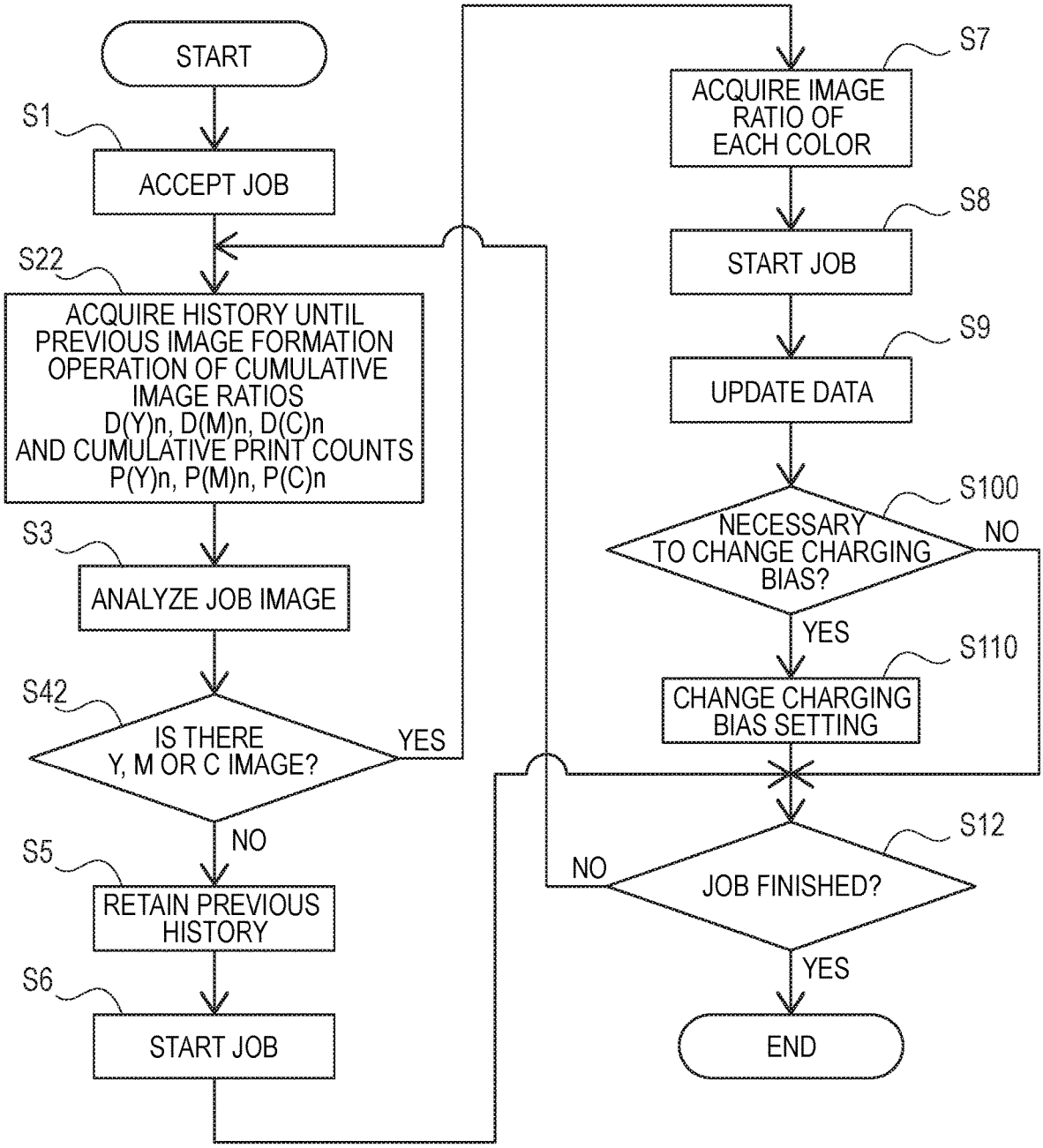
FIG. 17 is a flowchart illustrating control for changing a charging bias setting for cyan (C) according to the third exemplary embodiment.

Next, control to change the charging bias setting of the charging apparatus 12C at the image forming portion 1C that forms a cyan toner image will be described using FIG. 17. Note that, steps other than S22 and S42 in FIG. 17 are fundamentally the same as the steps other than S2 and S4 in FIG. 15. Further, steps other than S100 and S110 in FIG. 17 are fundamentally the same as the steps other than S10 and S11 described in FIG. 8 of the first exemplary embodiment. Therefore, only an outline of control for changing the charging bias setting of the charging apparatus 12C at the image forming portion 1C will be described hereunder.

First, the history until the previous image formation that is acquired in S22 is the cumulative image ratio D(Y)n and D(M)n as well as a cumulative image ratio D(C)n for cyan toner images and the cumulative print counts P(Y)n and P(M)n as well as a cumulative print count P(C)n for prints on which a cyan toner image was output at the time the previous image formation ended.

Further, in S100, the CPU 501 acquires the updated cumulative image ratios D(Y)n, D(M)n and D(C)n and cumulative print counts P(Y)n, P(M)n and P(C)n, and determines whether or not it is necessary to change the charging bias of the charging apparatus 12C based on the acquired data. In other words, the CPU 501 determines the contamination state and the aged deterioration state of the charge eliminating apparatus 16C based on the cumulative image ratios D(Y)n, D(M)n and D(C)n and the cumulative print counts P(Y)n, P(M)n and P(C)n.

In this case, when determining whether or not it is necessary to change the charging bias of the charging apparatus 12C, similarly to the case of the processing in FIG. 8, a value obtained by adding together the cumulative image ratios D(Y)n, D(M)n and D(C)n (the sum of D(Y)n, D(M)n and D(C)n) is used for the cumulative image ratio.

If the CPU 501 determines in S100 that it is necessary to change the charging bias of the charging apparatus 12C (Yes in S100), the CPU 501 changes the charging bias setting (S110). Based on the changed setting value, the CPU 501 changes the charging bias that is applied to the charging apparatus 12C from the charging high-voltage power supply 120C.

[Charging Bias Setting of Charging Apparatus for Black]

Figure 18:
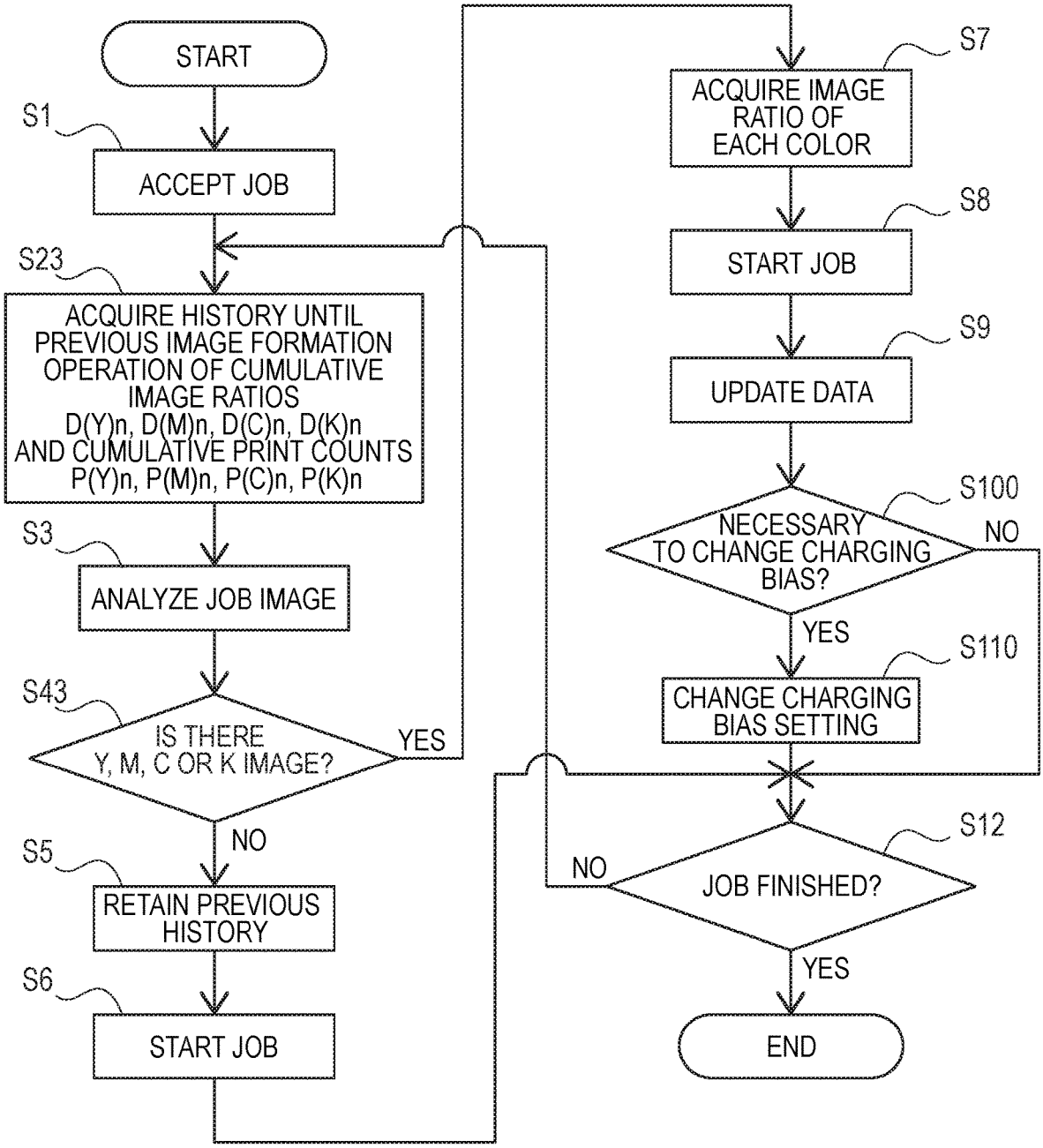
FIG. 18 is a flowchart illustrating control for changing a charging bias setting for black (K) according to the third exemplary embodiment.

Next, control to change the charging bias setting of the charging apparatus 12K at the image forming portion 1K that forms a black toner image will be described using FIG. 18. Note that, steps other than S23 and S43 in FIG. 18 are fundamentally the same as the steps other than S2 and S4 in FIG. 15. Further, steps other than S100 and S110 in FIG. 18 are fundamentally the same as the steps other than S10 and S11 described in FIG. 9 of the first exemplary embodiment. Therefore, only an outline of control for changing the charging bias setting of the charging apparatus 12K at the image forming portion 1K will be described hereunder.

First, the history until the previous image formation that is acquired in S23 is as follows. That is, the cumulative image ratios D(Y)n, D(M)n and D(C)n as well as a cumulative image ratio D(K)n for black toner images and the cumulative print counts P(Y)n, P(M)n and P(C)n as well as a cumulative print count P(K)n for prints on which a black toner image was output at the time the previous image formation ended.

Further, in S100, the CPU 501 acquires the updated cumulative image ratios D(Y)n, D(M)n, D(C)n and D(K)n and cumulative print counts P(Y)n, P(M)n, P(C)n and P(K)n. The CPU 501 then determines whether or not it is necessary to change the charging bias of the charging apparatus 12K based on the acquired data. In other words, the CPU 501 determines the contamination state and the aged deterioration state of the charge eliminating apparatus 16K based on the cumulative image ratios D(Y)n, D(M)n, D(C)n and D(K)n and the cumulative print counts P(Y)n, P(M)n, P(C)n and P(K)n.

In this case, when determining whether or not it is necessary to change the charging bias of the charging apparatus 12K, the processing is similar to the processing illustrated in FIG. 9. That is, a value obtained by adding together all of the cumulative image ratios D(Y)n, D(M)n, D(C)n and D(K)n (the sum of D(Y)n, D(M)n, D(C)n and D(K)n) is used.

If the CPU 501 determines in S100 that it is necessary to change the charging bias of the charging apparatus 12K (Yes in S100), the CPU 501 changes the charging bias setting (S110). Based on the changed setting value, the CPU 501 changes the charging bias that is applied to the charging apparatus 12K from the charging high-voltage power supply 120K.

[Determination Criteria for Charging Bias Setting]

The determination criteria with respect to the charging bias setting described in S100 in FIG. 15 to FIG. 18 that are described above will now be described using FIG. 19. FIG. 19 is a view that shows correction amounts for the charging bias settings with respect to cumulative image ratios and cumulative print counts. That is, FIG. 19 is a table that illustrates an example of criteria for making a determination regarding contamination of the charge eliminating apparatuses. The table shown in FIG. 19 is stored, for example, in the RAM 503, and in S100 the CPU 501 refers to the table shown in FIG. 19 and performs the charging bias setting for the charging apparatus based on the correction amount that corresponds to the cumulative image ratio and cumulative print count that were updated in S9.

Note that, the meanings of the numerical values of the cumulative print count and the cumulative image ratio shown in FIG. 19 are the same as in the aforementioned FIG. 10. Further, the numerical values inside the table in FIG. 19 show correction amounts for the charging bias setting, with "0" indicating the initial state of the charge eliminating apparatus, and having the same meaning as "not contaminated". When the correction amount is "0", a charging bias is applied so that a charging potential (dark portion potential) at a developing position on the photosensitive drum becomes a target potential that is currently set. Note that, in consideration of a decrease in the charging function due to deterioration or the like of the charging roller serving as the charging apparatus, the charging bias is appropriately adjusted by performing control that sets the charging bias, for example, when starting an image formation job or the like.

With regard to the other numerical values, the values indicate making a change to the charging bias of the charging apparatus that is currently set, and in the present exemplary embodiment indicate that the charging potential (dark portion potential) at the developing position on the photosensitive drum is changed by an amount corresponding to a correction amount with respect to the target potential that is currently set. That is, the other values show offset amounts for the charging bias that is currently set.

According to the charging apparatuses 12Y to 12K of the present exemplary embodiment, the charging potentials on the photosensitive drums are changed by variable application of voltages from the charging high-voltage power supplies 120Y to 120K. For example, in the initial state of each charge eliminating apparatus, the charging potential (dark portion potential) on the photosensitive drum is set to be −800 V at a developing position. Therefore, in a case where the correction amount in FIG. 19 is "−25", the charging bias is changed so that the dark portion potential becomes "−825 V" at the developing position.

As is clear from FIG. 19, in the present exemplary embodiment, in a case where the cumulative print count is a predetermined number of prints, the controller 500 makes the absolute value of the charging bias larger in a case where the cumulative image ratio is a second value that is larger than a first value in comparison to a case where the cumulative image ratio is the first value. For example, when the cumulative print count is 50 k prints, the correction amount is 0 in a case where the cumulative image ratio is 50 and the correction amount is −25 in a case where the cumulative image ratio is 150, and thus the absolute value of the charging bias increases in the case where the cumulative image ratio is the larger value of 150.

Further, according to the present exemplary embodiment, when the cumulative image ratio is a prescribed value, in a case where the cumulative print count is a second number of prints that is larger than a first number of prints, the absolute value of the charging bias is made larger than in a case where the cumulative print count is the first number of prints. For example, in a case where the cumulative image ratio is 100, the correction amount when the cumulative print count is 100 k prints is 0, and the correction amount when the cumulative print count is 200 k prints is −25, and thus the absolute value of the charging bias is larger in the case where the cumulative print count is the larger amount of 200 k prints.

[Specific Example of Charging Bias Setting Changing Control]

Next, based on the processing flows illustrated in FIG. 15 to FIG. 18 that are described above, a case will be considered in which, for example, a Job is executed that consists of consecutively forming an image for which the image ratio is (Y/M/C/K)=(0%/100%/100%/0%) (referred to as a "blue solid image") on A4-size recording material. Note that, in the present example it is assumed that the count for each of the cumulative image ratio and the cumulative print count is started from 0.

First, based on the image analysis in S3, it is determined in S41 and S42 in FIG. 16 and FIG. 17 that magenta and cyan images are to be formed, and in S7 the necessary image ratios are acquired. Because the image ratios of magenta and cyan in a blue solid image are each 100%, in S9 the Numerical value 1/1000 is cumulatively added to the cumulative image ratio each time a single image is formed. Further, in the present example, the value "1" is cumulatively added to the cumulative print count since the images are formed on A4-size recording material. Both items of data are updated as the Job continues, and the determination processing in S100 is executed.

The table in FIG. 19 is referred to for the aforementioned determination processing. For example, in a case where a blue solid image is formed on 100 k prints, for the image forming portion 1M for magenta, the cumulative image ratio D(M)n will be 100 (100 k×1/1000) and the cumulative print count P(M)n will be 100 k. Therefore, the correction amount in the table illustrated in FIG. 19 is "0", and hence it is determined that contamination of the charge eliminating apparatus 16M has not yet occurred, and the setting for the charging bias is not changed.

However, even if the cumulative print count is the same as for the image forming portion 1M for magenta, the cumulative image ratio at the image forming portion 1C for cyan will be 200. That is, because the image forming portion 1C is located on the downstream side of the image forming portion 1M, the sum of the cumulative image ratio D(M)n of the image forming portion 1M and the cumulative image ratio D(C)n of the image forming portion 1C are used for controlling the light amount of the charge eliminating apparatus 16C. Because the cumulative image ratios D(M)n and D(C)n are each 100, the sum is 200. On the other hand, the cumulative print count P(C)n is 100 k. Therefore, the correction amount in the table of FIG. 19 is "−25". This suggests that the charge eliminating apparatus 16C has started to become contaminated, and indicates that the contamination has reached a level at which charging bias correction is to be performed.

The CPU 501 causes a charging bias to be applied from the charging high-voltage power supply 120C to the charging apparatus 12C so as to cause the charging potential (dark portion potential) at the developing position on the photosensitive drum to be offset by "−25 V" with respect to the currently set target potential. That is, at the time point at which it is determined that it is necessary to change the charging bias in S100, the CPU 501 causes the charging high-voltage power supply 120C to apply to the charging apparatus 12C a charging bias that causes the dark portion potential at the developing position to become a potential of an amount that is obtained by adding the correction amount to the target potential. By this means, even if the light amount of the charge eliminating apparatus 16C decreases due to contamination or changes with time, charge elimination unevenness that is due to a decrease in the light amount can be evened out.

Note that, if no images are formed at image forming portions which are located further upstream than the image forming portion 1C for cyan, the cumulative image ratio for the image forming portion 1C will be 100 and, similarly to the image forming portion 1M for magenta, it will be determined that contamination has not occurred at the charge eliminating apparatus 16C.

In the case of the present exemplary embodiment configured as described above, the influence of charge elimination unevenness on images accompanying image formation can be suppressed. That is, accompanying image formation, in some cases the amount of light of a charge eliminating apparatus decreases due to toner adhering to the charge eliminating apparatus or due to aged deterioration of the charge eliminating apparatus. Therefore, by changing the charging bias setting according to the cumulative image ratio and cumulative print count as described above, charge elimination unevenness on a photosensitive drum that is caused by a decrease in the light amount can be evened out, and thus a decrease in image quality due to charge elimination unevenness can be suppressed.

Note that, in the present exemplary embodiment, a red LED having a dominant wavelength λD=630 nm as an electro-optic property is adopted as a light emitting device of the respective charge eliminating apparatuses, and variable constant current control is implemented by means of a high voltage power supply.

However, with respect to the dominant wavelength λD of the charge eliminating apparatuses, a yellow LED having a dominant wavelength λD in a range of 500 nm to 610 nm, a red LED having a dominant wavelength λD in a range of 610 nm to 760 nm, or a blue LED having a dominant wavelength λD in a range of 400 nm to 500 nm may also be used. In short, any wavelength band that is capable of eliminating charges with respect to the spectral sensitivity distribution at the photosensitive members can be applied.

Further, although in the present exemplary embodiment the image forming portions are arranged in the order of Y, M, C and K with respect to the order of colors when forming a full-color image, the present invention is not limited thereto, and another order, for example, the order Y, C, M and K, may also be adopted. In this case, the relations in the flowcharts from FIG. 15 to FIG. 18 described in the present exemplary embodiment may be appropriately changed in accordance with the order of the colors.

Fourth Exemplary Embodiment

A fourth exemplary embodiment will now be described using FIG. 20 to FIG. 22, while referring to FIG. 1 to FIG. 4 and FIG. 14 to FIG. 19. Although in the above-described exemplary embodiment only the table shown in FIG. 19 is used for control of the charging bias settings of the respective image forming portions, in the present exemplary embodiment a plurality of tables are used. The other configurations and actions are the same as in the above-described third exemplary embodiment, and the concept of the present exemplary embodiment is the same as that of the above-described second exemplary embodiment. Therefore, an outline of the present exemplary embodiment is described hereunder.

In the present exemplary embodiment, when changing the charging bias settings, the percentage changes at the charging biases are set as follows. That is, the percentage change with respect to the charging bias of the charging apparatus of the image forming portion that uses toner with the highest absorbance with respect to the dominant wavelength of the light of the charge eliminating apparatus among the plurality of image forming portions is set to a higher value than the percentage change with respect to the charging bias of the charging apparatuses of the other image forming portions.

The reason is as follows. Because the dispersion and absorption characteristics of light differ for each color, the percentage change when changing the charging bias setting can be changed according to individual conditions. Specifically, a correction amount for charging bias setting control may be changed according to a combination between a wavelength of the charge eliminating apparatus and an image forming portion that uses toner that has high absorbance, and making the percentage change with respect to toner that has high absorbance larger increases the effect with respect to the charging bias setting control.

For example, in a case where a red LED for which the dominant wavelength $\lambda D$ of irradiated light is in the range of 610 nm$<\lambda D\leq$760 nm is used as a charge eliminating apparatus, a light amount on the surface of the photosensitive drum (on the drum surface) will decrease more in a case where the charge eliminating apparatus is contaminated with cyan toner than in a case where the charge eliminating apparatus is contaminated with magenta toner.

In contrast, in a case where a blue LED for which the dominant wavelength $\lambda D$ of irradiated light is in the range of 400 nm$<\lambda D\leq$500 nm is used as the charge eliminating apparatus, a decrease in the amount of light on the drum surface will be greater in a case where the charge eliminating apparatus is contaminated with magenta toner than in a case where the charge eliminating apparatus is contaminated with cyan toner.

Therefore, by changing a matrix of the contamination determination criteria based on a combination between the wavelength of the LED of the charge eliminating apparatus and the photosensitive drum of the image forming portion, it is possible to provide a highly precise determination with respect to contamination as well as the optimal charging bias conditions.

FIG. 20 and FIG. 21 illustrate tables showing an example of criteria for determining contamination of the charge eliminating apparatuses, similarly to FIG. 19. FIG. 22 is a view showing contamination determination criteria that are applied based on combinations between the wavelengths of the LEDs of the charge eliminating apparatuses and the photosensitive drums of the image forming portions. That is, FIG. 22 shows combinations of charging bias settings in which the percentage change in the charging bias of an image forming portion that uses toner that has the highest absorbance with respect to the dominant wavelength of light of the charge eliminating apparatus is made larger than the percentage change in the charging bias of the other image forming portions.

The words "yellow", "magenta", "cyan" and "black" in FIG. 22 indicate the image forming portions of the respective colors. Further, in the table of FIG. 22, FIG. 19 which is described in the third exemplary embodiment and the aforementioned FIGS. 20 and 21 are described as criteria that are to be applied to the combinations (that is, tables to be used for charging bias setting control).

Based on FIG. 22, a case will be considered in which, as the charge eliminating apparatuses, a red LED having a dominant wavelength $\lambda D$=630 nm is applied as a light emitting device, and image formation of a monochromatic magenta image with an image ratio of 100% and a monochromatic cyan image with an image ratio of 100%, respectively, is performed. In this case, the table of FIG. 19 is applied for the image forming portion 1M that uses magenta toner, and the table of FIG. 21 is applied for the image forming portion 1C that uses cyan toner.

Thus, in the present exemplary embodiment a plurality of criteria (tables) that are applied for control of the charging bias settings are prepared in correspondence with the absorbance with respect to the dominant wavelength of light of the charge eliminating apparatuses. As a result, conditions exist whereby the percentage changes in the charging biases will be different even when the cumulative print counts are the same, and it is thus possible to provide the optimal charging bias condition at the image forming portion of each color.

Note that, in the present exemplary embodiment, contamination determination criteria are described that are applied for Y, M, C and K with respect to three kinds of wavelength regions. However, for example, even in a case where special colors (white, gold, silver) or the like are used, the current determination criteria may be used in accordance with the absorption distribution, or separate determination criteria may be added.

Fifth Exemplary Embodiment

A fifth exemplary embodiment will now be described using FIG. 23 to FIG. 28 while referring to FIG. 1 to FIG. 4. In each of the foregoing exemplary embodiments, the charge-eliminating light amounts or charging biases are changed in accordance with the contamination state or the like of the charge eliminating apparatuses. In contrast, in the present exemplary embodiment, although the point that the contamination state or the like of the charge eliminating apparatuses is similarly ascertained according to the cumulative image ratios and cumulative print counts is common with each of the foregoing exemplary embodiments, in the present exemplary embodiment a configuration is adopted in which information regarding the ascertained state is transmitted to an external server at an external service center or the like. Since the other configurations and actions are the same as in the respective exemplary embodiments described above, the following description centers on points that are different from the respective exemplary embodiments described above.

According to the present exemplary embodiment, a configuration is adopted in which the current contamination state or the like of the relevant charge eliminating apparatus is ascertained based on data regarding the cumulative image ratio and the cumulative print count similarly to the respective exemplary embodiments described above, and the configuration includes a function that notifies the state to an external apparatus. By this means, even without changing a charge-eliminating light amount or a charging bias, a decrease in a light amount that is irradiated onto a photosensitive drum from a charge eliminating apparatus can be suppressed, for example, by a service person performing cleaning of the charge eliminating apparatus. Further, as a result, the frequency of replacing the drum cartridges can also be reduced.

Figure 23:
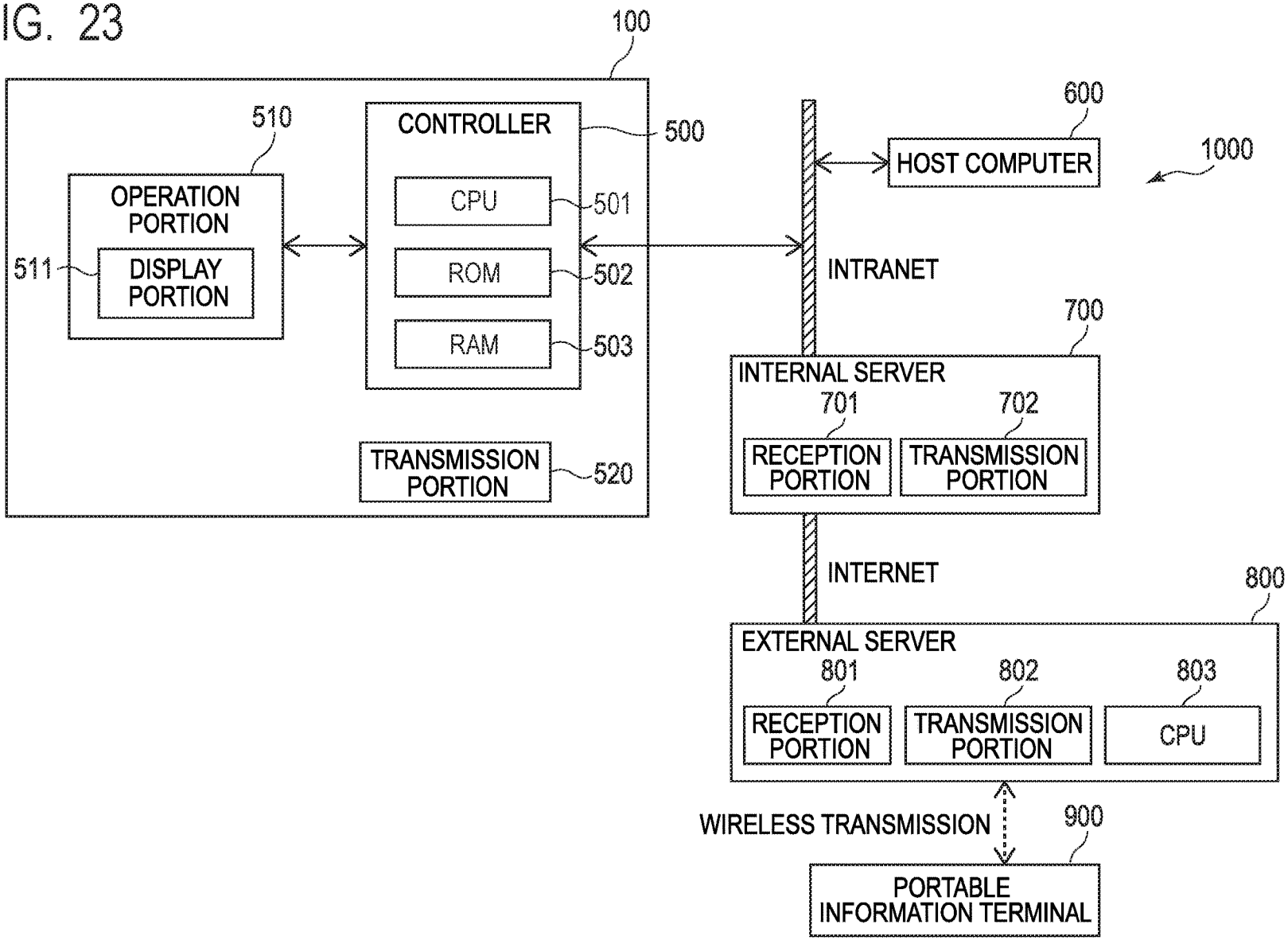
FIG. 23 is a control block diagram of an image forming system according to a fifth exemplary embodiment.

For this purpose, as illustrated in FIG. 23, in the present exemplary embodiment, an image forming system 1000 includes an internal server (information processing apparatus) 700 and an external server (centralized storage apparatus) 800 in addition to the aforementioned image forming apparatus 100. The image forming system 1000 will now be described in detail using FIG. 23.

First, the image forming system 1000 of the present exemplary embodiment is constituted by the image forming apparatus 100, a host computer 600, the internal server 700, the external server 800 and a portable information terminal 900. Similarly to the respective exemplary embodiments described above, the image forming apparatus 100 includes the controller 500 and the operation portion 510.

The host computer 600 and the internal server 700 are provided in a facility on the user side at which the image forming apparatus 100 is installed, and are connected to the controller 500 by, for example, an intranet by means of a wired LAN.

The external server 800, for example, is installed in an external facility such as a service center, and is connected to the internal server 700 by, for example, the Internet by means of a wired LAN. The portable information terminal 900 is, for example, a wireless terminal that a service person or the like at the service center carries with them, and is in a state in which communication with the external server 800 is enabled by means of, for example, a wireless LAN (Wi-Fi), a wireless PAN (Bluetooth (registered trademark)), or infrared communication. Note that, in a case where the service person has gone to the facility on the user side, the portable information terminal 900 is also capable of communicating with the controller 500 of the image forming apparatus 100 by means of, for example, a wireless LAN (Wi-Fi), a wireless PAN (Bluetooth (registered trademark)), or infrared communication.

The image forming apparatus 100 has a transmission portion 520 that is capable of transmitting information processed by the controller 500 or the like to the internal server 700 or the like through an intranet. The host computer 600, for example, transmits image information or the like to the image forming apparatus 100 through an intranet. The internal server 700 has a reception portion 701 and a transmission portion 702. The reception portion 701 is capable of receiving information that was sent through an intranet from the transmission portion 520 or the host computer 600, or information that was sent from outside through the Internet. The transmission portion 702 is capable of sending received information or the like to the external server 800 through the Internet, and of transmitting received information or the like to the image forming apparatus 100 or the host computer 600 through an intranet.

The external server 800 has a reception portion 801, a transmission portion 802 and a CPU 803. The reception portion 801 receives information that was sent from the transmission portion 702 of the internal server 700 through the Internet or information from the portable information terminal 900 that is connected thereto by wireless transmission. The transmission portion 802 transmits information to the reception portion 701 of the internal server 700 or the portable information terminal 900 through the Internet. The CPU 803, for example, processes information received by the reception portion 801.

Note that, although in the above description the image forming apparatus 100 and the external server 800 are connected through the internal server 700, the image forming apparatus 100 and the external server 800 may be connected directly through the Internet, and not indirectly by way of the internal server 700.

In the case of the present exemplary embodiment, the transmission portion 520 as a transmission unit of the image forming apparatus 100 is capable of transmitting information to the effect that a charge eliminating apparatus is contaminated, based on a cumulative image ratio as a cumulative value relating to image information and a cumulative print count of image formation print counts. In the case of the present exemplary embodiment, information from the transmission portion 520 is sent to the external server 800 after first being received by the internal server 700. By information to the effect that a charge eliminating apparatus is contaminated being sent to the external server 800 in this way, a service person or the like can ascertain the state of the charge eliminating apparatus without being present in the location where the image forming apparatus is installed. Further, for example, in a case where the service person determines that it is necessary to clean the charge eliminating apparatus based on the aforementioned information, the service person visits the location where the image forming apparatus is installed and performs cleaning of the charge eliminating apparatus.

Hereunder, the flow of control for determining contamination of the charge eliminating apparatuses of the present exemplary embodiment is described using FIG. 24 to FIG. 27 while referring to FIG. 23.

[Determination of Contamination of Charge Eliminating Apparatus for Yellow]

Figure 24:
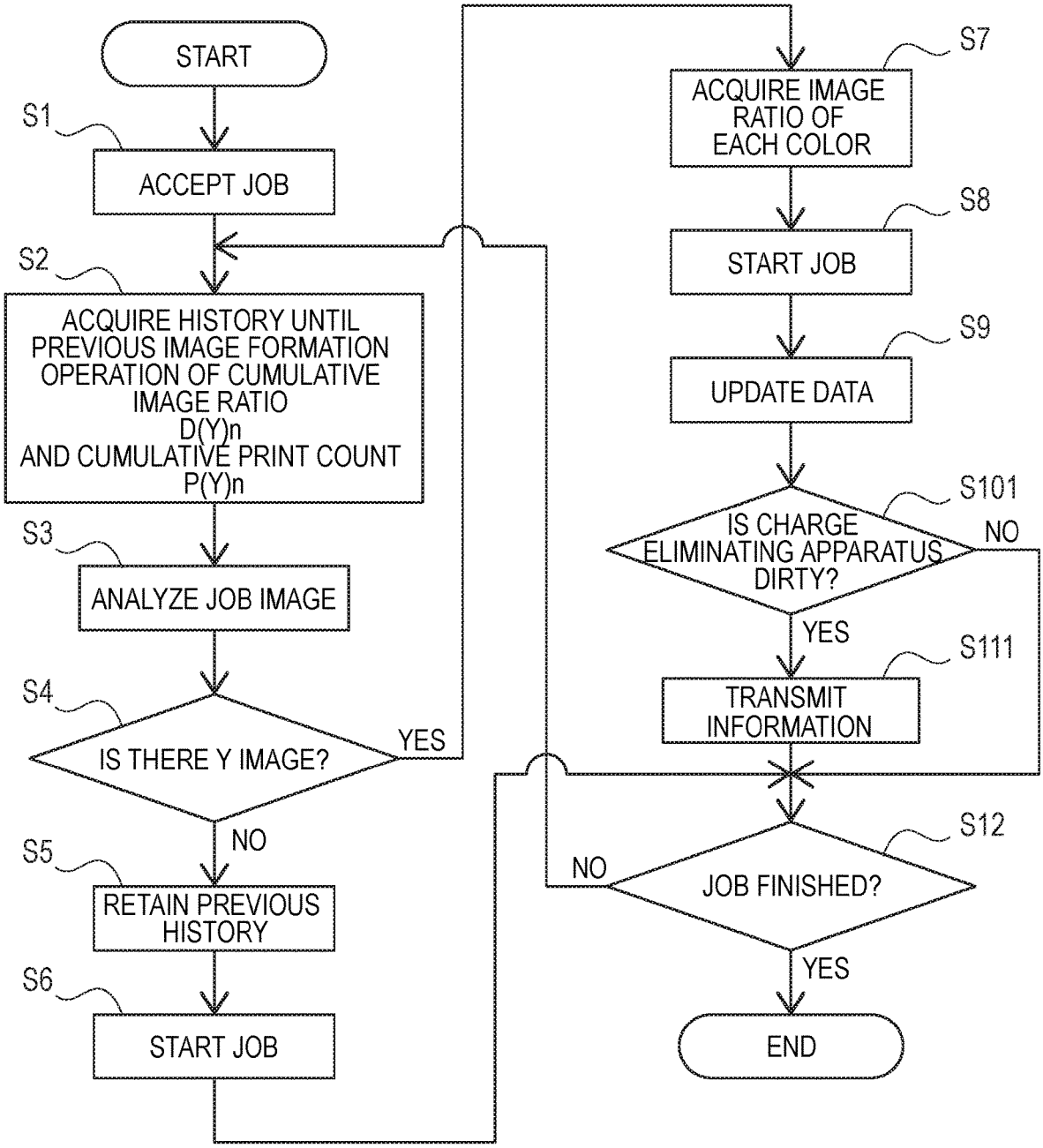
FIG. 24 is a flowchart illustrating information transmission control for yellow (Y) according to the fifth exemplary embodiment.

FIG. 24 is a view illustrating a flow of control processing at the image forming portion 1Y that forms a yellow toner image. In this case, control is performed to determine whether or not the charge eliminating apparatus 16Y of the image forming portion 1Y is contaminated. Note that, steps other than S101 and S111 in FIG. 24 are fundamentally the same as the steps other than S10 and S11 described in FIG. 6 of the first exemplary embodiment, and therefore the following description centers on the parts that are different from FIG. 6.

In S4, if there is information for a Y image (Yes in S4), the CPU 501 acquires the image ratio of each color (S7), and the CPU 501 starts the Job (S8). Subsequently, the CPU 501 calculates an up-to-date cumulative image ratio and cumulative print count, and updates the data for the cumulative image ratio and the cumulative print count in the RAM 503 (S9).

Next, the CPU 501 acquires the updated cumulative image ratio D(Y)n and cumulative print count P(Y)n, and determines whether or not the charge eliminating apparatus 16Y is contaminated based on the acquired data (S101). The determination criteria will be described later. If the CPU 501 determines that the charge eliminating apparatus 16Y is contaminated (Yes in S101), at a predetermined timing the transmission portion 520 transmits information to the effect that the charge eliminating apparatus 16Y is contaminated (S111).

On the other hand, if the CPU 501 determines in S101 that the charge eliminating apparatus 16Y is not contaminated (No in S101), the CPU 501 proceeds to S12 without performing transmission of information. The CPU 501 then determines whether or not the Job is finished, and if the Job is not finished (No in S12) the CPU 501 returns to S2. On the other hand, if the Job is finished (Yes in S12), the CPU 501 ends the control.

[Determination of Contamination of Charge Eliminating Apparatus for Magenta]

Figure 25:
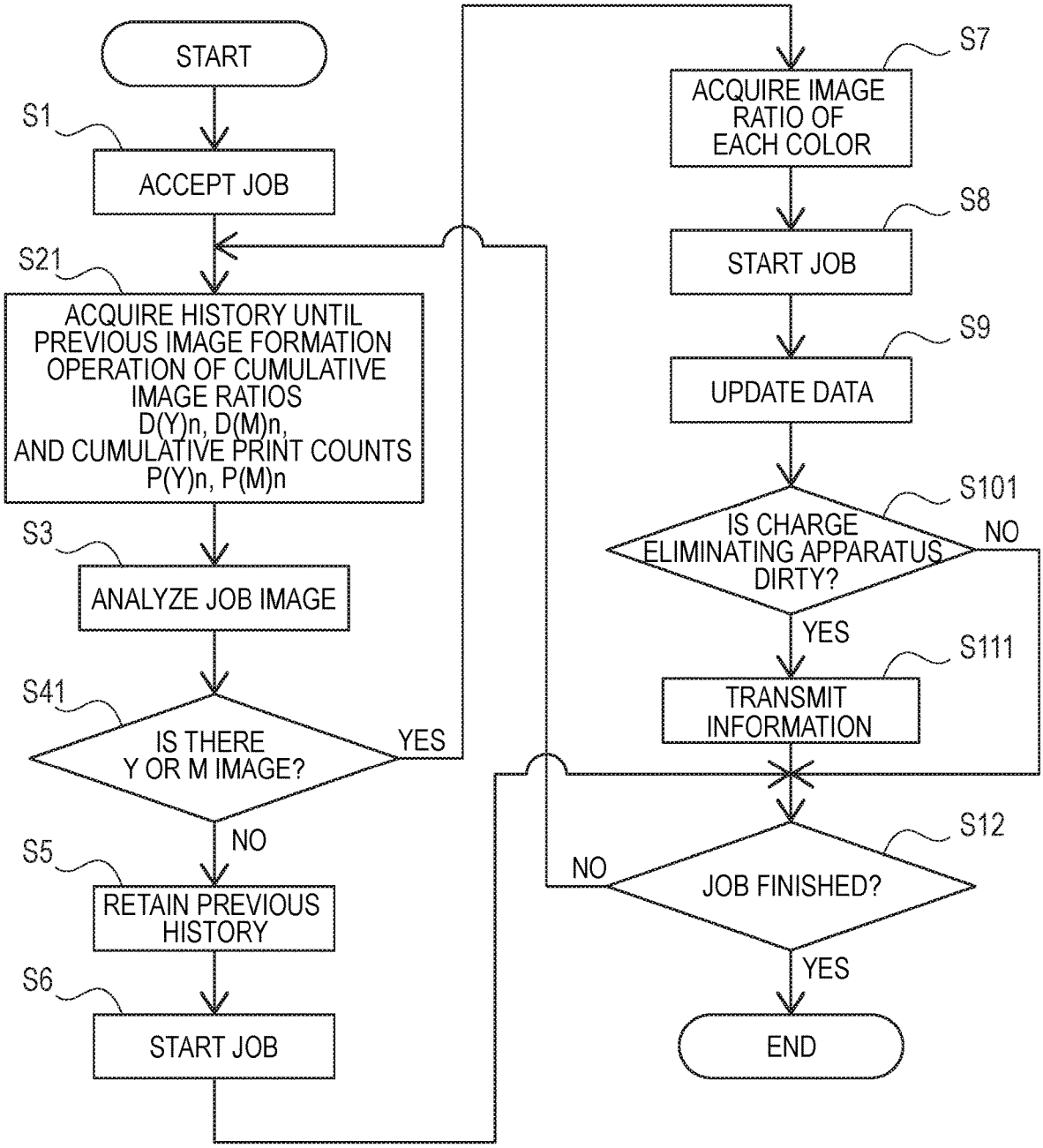
FIG. 25 is a flowchart illustrating information transmission control for magenta (M) according to the fifth exemplary embodiment.

Next, control to determine whether or not the charge eliminating apparatus 16M at the image forming portion 1M that forms a magenta toner image is contaminated will be described using FIG. 25. Note that, steps other than S21 and S41 in FIG. 25 are fundamentally the same as the steps other than S2 and S4 in FIG. 24. Further, steps other than S101 and S111 in FIG. 25 are fundamentally the same as the steps other than S10 and S11 described in FIG. 7 of the first exemplary embodiment. Therefore, only an outline of control for determining whether or not the charge eliminating apparatus 16M at the image forming portion 1M is contaminated will be described hereunder.

First, the history until the previous image formation that is acquired in S21 is the cumulative image ratio D(Y)n and a cumulative image ratio D(M)n for magenta toner images as well as the cumulative print count P(Y)n and a cumulative print count P(M)n for prints on which a magenta toner image was output at the time the previous image formation ended.

Further, in S101, the CPU 501 acquires the updated cumulative image ratios D(Y)n and D(M)n and cumulative print counts P(Y)n and P(M)n, and determines whether or not the charge eliminating apparatus 16M is contaminated based on the acquired data. In this case, when determining whether or not the charge eliminating apparatus 16M is contaminated, similarly to the case of the processing in FIG. 7, a value obtained by adding the value of D(M)n to the cumulative image ratio D(Y)n (the sum of D(Y)n and D(M)n) is used for the cumulative image ratio.

If the CPU 501 determines in S101 that the charge eliminating apparatus 16M is contaminated (Yes in S101), at a predetermined timing the transmission portion 520 transmits information to the effect that the charge eliminating apparatus 16M is contaminated (S111).

[Determination of Contamination of Charge Eliminating Apparatus for Cyan]

Figure 26:
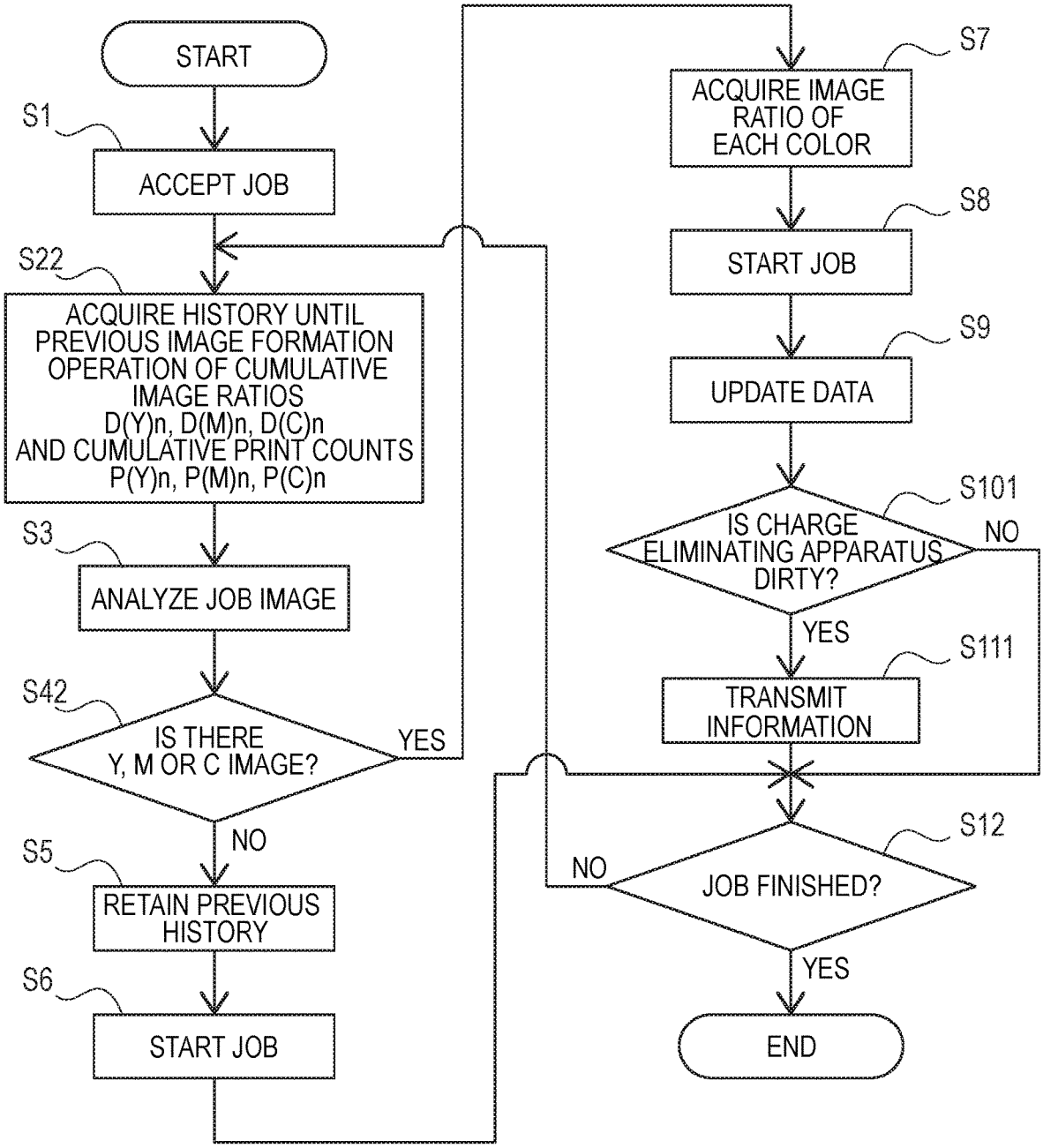
FIG. 26 is a flowchart illustrating information transmission control for cyan (C) according to the fifth exemplary embodiment.

Next, control to determine whether or not the charge eliminating apparatus 16C at the image forming portion 1C that forms a cyan toner image is contaminated will be described using FIG. 26. Note that, steps other than S22 and S42 in FIG. 26 are fundamentally the same as the steps other than S2 and S4 in FIG. 24. Further, steps other than S101 and S111 in FIG. 26 are fundamentally the same as the steps other than S10 and S11 described in FIG. 8 of the first exemplary embodiment. Therefore, only an outline of control for determining whether or not the charge eliminating apparatus 16C at the image forming portion 1C is contaminated will be described hereunder.

First, the history until the previous image formation that is acquired in S22 is the cumulative image ratios D(Y)n and D(M)n as well as a cumulative image ratio D(C)n for cyan toner images and also the cumulative print counts P(Y)n and P(M)n as well as a cumulative print count P(C)n for prints on which a cyan toner image was output at the time the previous image formation ended.

Further, in S101, the CPU 501 acquires the updated cumulative image ratios D(Y)n, D(M)n and D(C)n and cumulative print counts P(Y)n, P(M)n and P(C)n, and determines whether or not the charge eliminating apparatus 16C is contaminated based on the acquired data. In this case, when determining whether or not the charge eliminating apparatus 16C is contaminated, similarly to the case of the processing in FIG. 8, a value obtained by adding together the cumulative image ratios D(Y)n, D(M)n and D(C)n (the sum of D(Y)n, D(M)n and D(C)n) is used for the cumulative image ratio.

If the CPU 501 determines in S101 that the charge eliminating apparatus 16C is contaminated (Yes in S101), at a predetermined timing the transmission portion 520 transmits information to the effect that the charge eliminating apparatus 16C is contaminated (S111).

[Determination of Contamination of Charge Eliminating Apparatus for Black]

Figure 27:
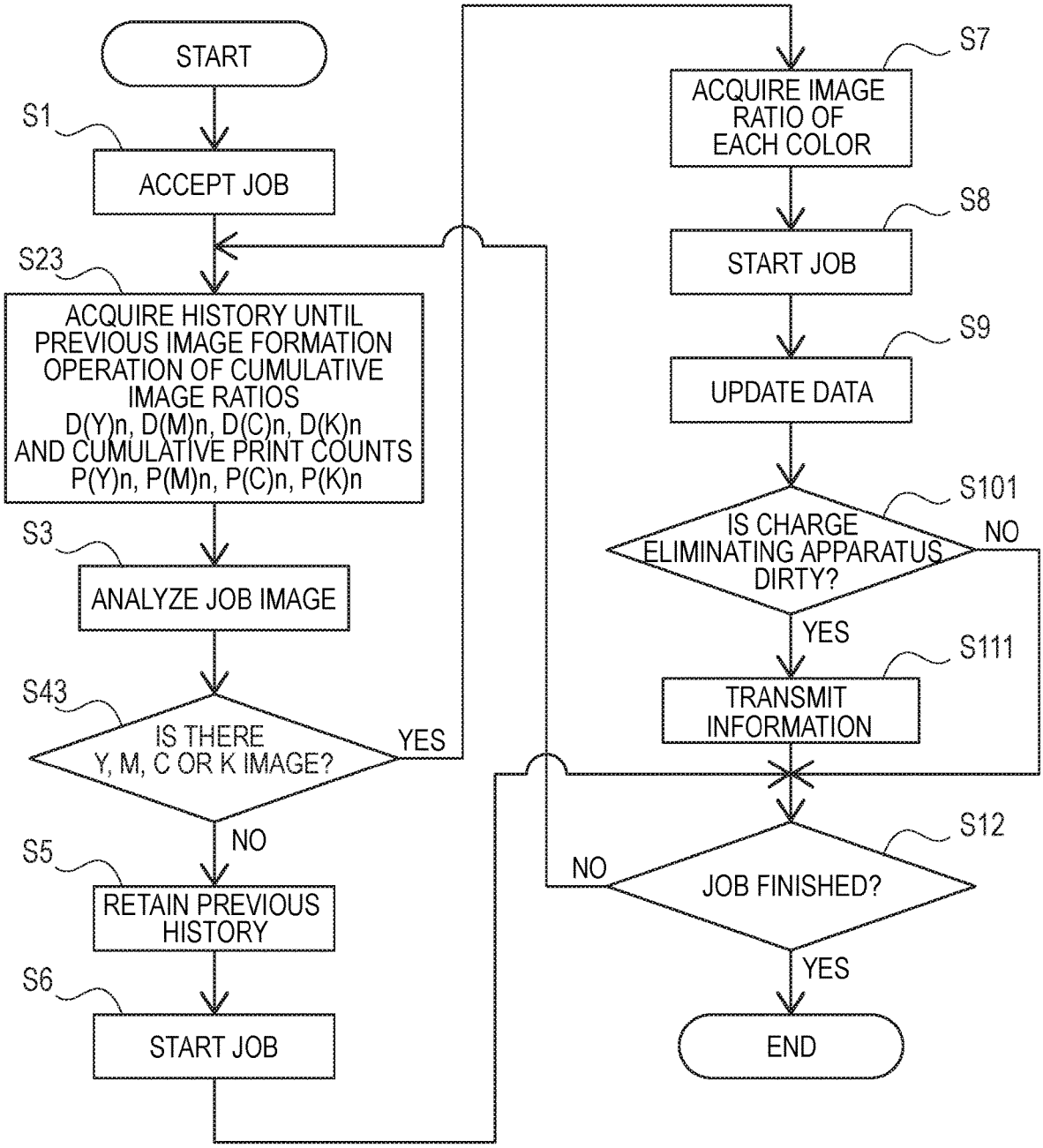
FIG. 27 is a flowchart illustrating information transmission control for black (K) according to the fifth exemplary embodiment.

Next, control to determine whether or not the charge eliminating apparatus 16K at the image forming portion 1K that forms a black toner image is contaminated will be described using FIG. 27. Note that, steps other than S23 and S43 in FIG. 27 are fundamentally the same as the steps other than S2 and S4 in FIG. 24. Further, steps other than S101 and S111 in FIG. 27 are fundamentally the same as the steps other than S10 and S11 described in FIG. 9 of the first exemplary embodiment. Therefore, only an outline of control for determining whether or not the charge eliminating apparatus 16K at the image forming portion 1K is contaminated will be described hereunder.

First, the history until the previous image formation that is acquired in S23 is as follows. That is, the history is the cumulative image ratios D(Y)n, D(M)n and D(C)n as well as a cumulative image ratio D(K)n for black toner images and also the cumulative print counts P(Y)n, P(M)n and P(C)n as well as a cumulative print count P(K)n for prints on which a black toner image was output at the time the previous image formation ended.

Further, in S101, the CPU 501 acquires the updated cumulative image ratios D(Y)n, D(M)n, D(C)n and D(K)n and cumulative print counts P(Y)n, P(M)n, P(C)n and P(K)n, and determines whether or not the charge eliminating apparatus 16K is contaminated based on the acquired data. In this case, when determining whether or not the charge eliminating apparatus 16K is contaminated, a value obtained in a similar manner to the case of the processing in FIG. 9 is used for the cumulative image ratio. That is, a value obtained by adding together all of the cumulative image ratios D(Y)n, D(M)n, D(C)n and D(K)n (the sum of D(Y)n, D(M)n, D(C)n and D(K)n) is used.

If the CPU 501 determines in S101 that the charge eliminating apparatus 16K is contaminated (Yes in S101), at a predetermined timing the transmission portion 520 transmits information to the effect that the charge eliminating apparatus 16K is contaminated (S111).

[Criteria for Determining Contamination of Charge Eliminating Apparatuses]

The criteria for making a determination regarding contamination of the charge eliminating apparatuses that is described in the aforementioned S101 of FIG. 24 to FIG. 27 will now be described using FIG. 28. FIG. 28 is a view illustrating the existence or non-existence of flags for contamination determination with respect to cumulative image ratios and cumulative print counts. That is, FIG. 28 is a table illustrating an example of criteria for making a determination regarding contamination of the charge eliminating apparatuses. The table illustrated in FIG. 28 is stored, for example, in the RAM 503, and in S101 and S111 the transmission portion 520 refers to the table in FIG. 28 and, based on a flag that corresponds to the cumulative image ratio and cumulative print count updated in S9, transmits information to the effect that the relevant charge eliminating apparatus is contaminated.

The meanings of the numerical values of the cumulative print count and the cumulative image ratio in FIG. 28 are the same as in the above described FIG. 10. Further, the numerical values within the table in FIG. 28 indicate the existence or non-existence of a flag, with the value "0" indicating that a flag is not set and information to the effect that the relevant charge eliminating apparatus is contaminated is not transmitted from the transmission portion 520. The value "1" indicates that a flag is set and information to the effect that the relevant charge eliminating apparatus is contaminated is transmitted at a predetermined timing from the transmission portion 520.

Further, the reason that the flags in the column for the cumulative print count of 0 prints in FIG. 28 are set to "1" with respect to cumulative image ratios other than 0 is as follows. The reason is that, for example, in a case where a new charge eliminating apparatus is installed as a result of the drum cartridge being replaced due to contamination of the previous charge eliminating apparatus or the like, the settings are configured so as to set the flag to "1" unless the user performs a reset operation at the operation portion 510. Upon a reset operation being performed, the flags in this column change to "0". Note that, a configuration may be adopted so that regions in which the flags are changed to 0 by a reset operation extend as far as a region that is one place below the place at which the flag values change from 0 to 1 in the neighboring column of the cumulative print count of 50 k prints (predetermined regions). In FIG. 28, a configuration is adopted so that the flags change to 0 until the cumulative image ratio 1450. However, all of the regions in this column may be changed to 0. Further, a configuration may be adopted in which all of the regions or predetermined regions in this column are set to 0 irrespective of a reset operation.

As is clear from FIG. 28, in the present exemplary embodiment, in a case where a cumulative image ratio with respect to a cumulative print count is equal to or greater than a predetermined threshold value, the controller 500 determines that the charge eliminating apparatus is contaminated, and the transmission portion 520 transmits information to that effect. For example, in a case where the cumulative print count is 500 k prints, the flag is 0 in a case where the cumulative image ratio is 900, and the flag is 1 in a case where the cumulative image ratio is 1000. That is, when the cumulative print count is 500 k prints, the flag is 1 in a case where the cumulative image ratio is equal to or greater than 1000 (equal to or greater than a predetermined threshold value), and transmission of information is performed.

[Specific Example of Contamination Determination Control]

Next, based on the processing flows illustrated in FIG. 24 to FIG. 27 that are described above, a case will be considered in which, for example, a Job is executed that consists of consecutively forming an image for which the image ratio is (Y/M/C/K)=(0%/100%/100%/0%) (referred to as a "blue solid image") on A4-size recording material. Note that, in the present example it is assumed that the count for each of the cumulative image ratio and the cumulative print count is started from 0.

First, based on the image analysis in S3, it is determined in S41 and S42 in FIG. 25 and FIG. 26 that magenta and cyan images are to be formed, and in S7 the necessary image ratios are acquired. Because the image ratios of magenta and cyan in a blue solid image are each 100%, in S9 the numerical value 1/1000 is cumulatively added to the cumulative image ratio each time a single image is formed. Further, in the present example, the value "1" is cumulatively added to the cumulative print count since the images are formed on A4-size recording material. Both items of data are updated as the Job continues, and the determination processing in S101 is executed.

The table in FIG. 28 is referred to for the aforementioned determination processing. For example, in a case where a blue solid image is formed on 500 k prints, for the image forming portion 1M for magenta, the cumulative image ratio D(M)n will be 500 (500 k×1/1000) and the cumulative print count P(M)n will be 500 k. Therefore, the flag within the table illustrated in FIG. 28 is "0", and hence it is determined that contamination of the charge eliminating apparatus 16M has not yet occurred, and transmission of information is not performed.

However, even if the cumulative print count is the same as for the image forming portion 1M for magenta, the cumulative image ratio at the image forming portion 1C for cyan will be 1000. That is, because the image forming portion 1C is located on the downstream side of the image forming portion 1M, the sum of the cumulative image ratio D(M)n of the image forming portion 1M and the cumulative image ratio D(C)n of the image forming portion 1C is used for light amount control of the charge eliminating apparatus 16C. Because the cumulative image ratios D(M)n and D(C)n are each 500, the sum will be 1000. On the other hand, the cumulative print count P(C)n is 500 k. Therefore, the flag within the table of FIG. 28 is "1". This suggests that the charge eliminating apparatus 16C has started to become contaminated, and indicates that the contamination has reached a level at which transmission of information is to be performed.

Note that, if no images are formed at image forming portions which are located further upstream than the image forming portion 1C for cyan, the cumulative image ratio for the image forming portion 1C will be 500 and, similarly to the image forming portion 1M for magenta, it will be determined that contamination has not occurred at the charge eliminating apparatus 16C.

As described above, when information to the effect that the charge eliminating apparatus is contaminated is transmitted from the transmission portion 520, the information is sent to the external server 800 via the internal server 700. By this means, for example, it is possible to a service person to receive the information from the portable information terminal 900 that is connected to the external server 800, and the service person can make an appropriate determination without examining the image forming apparatus itself.

Further, for example, by the service person visiting the location where the image forming apparatus is installed and performing cleaning of the charge eliminating apparatus based on the information, the charge eliminating apparatus can be restored to a non-contaminated state from the contamination state, and hence the occurrence of charge elimination unevenness due to a decrease in the light amount can be suppressed. In the case of the present exemplary embodiment configured as described above, by transmitting information to the effect that a charge eliminating apparatus is contaminated to an external apparatus, the influence of charge elimination unevenness on images accompanying image formation can be suppressed.

Note that, in the present exemplary embodiment, a red LED having a dominant wavelength λD=630 nm as an electro-optic property is adopted as a light emitting device of the respective charge eliminating apparatuses, and variable constant current control is implemented by means of a high voltage power supply.

However, with respect to the dominant wavelength λD of the charge eliminating apparatuses, a yellow LED having a dominant wavelength λD in a range of 500 nm to 610 nm, a red LED having a dominant wavelength λD in a range of 610 nm to 760 nm, or a blue LED having a dominant wavelength λD in a range of 400 nm to 500 nm may also be used. In short, any wavelength band that is capable of eliminating charges with respect to the spectral sensitivity distribution at the photosensitive members can be applied.

Further, although in the present exemplary embodiment the image forming portions are arranged in the order of Y, M, C and K with respect to the order of colors when forming a full-color image, the present invention is not limited thereto, and another order, for example, the order Y, C, M and K, may also be adopted. In this case, the relations in the flowcharts from FIG. 24 to FIG. 27 described in the present exemplary embodiment may be appropriately changed in accordance with the order of the colors.

Different Example of Fifth Exemplary Embodiment

According to the foregoing description, the controller 500 of the image forming apparatus 100 determines whether or not the respective charge eliminating apparatuses are contaminated based on a cumulative image ratio and a cumulative print count, and in a case where the relevant charge eliminating apparatus is contaminated, the transmission portion 520 transmits information to that effect. However, a determination regarding whether or not a charge eliminating apparatus is contaminated may be made at the external server 800 of the image forming system 1000.

In such case, the transmission portion 520 of the image forming apparatus 100 transmits information regarding the cumulative image ratio and the cumulative print count to the external server 800 through the internal server 700. The external server 800 receives the information transmitted from the transmission portion 520 by means of the reception portion 801 as a reception unit. Subsequently, for example, the CPU 803 of the external server 800 as a determination unit determines whether or not the charge eliminating apparatus is contaminated based on the cumulative image ratio and cumulative print count received by the reception portion 801. In this case, the table in FIG. 28 is stored in an unshown storage apparatus of the external server 800. Similarly to the above described case, by connecting to the external server 800 by means of the portable information terminal 900, a service person can ascertain the contamination state of the relevant charge eliminating apparatus without examining the image forming apparatus itself.

Sixth Exemplary Embodiment

A sixth exemplary embodiment will now be described using FIG. 29 to FIG. 31, while referring to FIG. 1 to FIG. 4 and FIG. 23 to FIG. 28. Although in the above-described exemplary embodiment only the table shown in FIG. 28 is used for control to determine the contamination states of the respective image forming portions, in the present exemplary embodiment a plurality of tables are used. The other configurations and actions are the same as in the above-described fifth exemplary embodiment and different example of the fifth exemplary embodiment, and the concept of the present exemplary embodiment is the same as that of the above-described second exemplary embodiment. Therefore, an outline of the present exemplary embodiment is described hereunder.

In the present exemplary embodiment, when performing a determination regarding contamination of a charge eliminating apparatus, a predetermined threshold value for performing a contamination determination with respect to an image forming portion that uses toner that has the highest absorbance with respect to the dominant wavelength of light of the charge eliminating apparatus among the plurality of image forming portions is made lower than a predetermined threshold value for the other image forming portions.

The reason is as follows. Because the dispersion and absorption characteristics of light differ for each color, the timing of transmitting information for the contamination determination can be changed according to individual conditions. Specifically, a flag for contamination determination may be changed according to a combination between a wavelength of the charge eliminating apparatus and an image forming portion that uses toner that has high absorbance, and making the timing for transmitting information regarding toner that has high absorbance an earlier timing increases the effect with respect to the contamination determination control.

For example, in a case where a red LED for which the dominant wavelength λD of irradiated light is in the range of 610 nm<λD≤760 nm is used as a charge eliminating apparatus, a light amount on the surface of the photosensitive drum (on the drum surface) will decrease more in a case where the charge eliminating apparatus is contaminated with cyan toner than in a case where the charge eliminating apparatus is contaminated with magenta toner.

In contrast, in a case where a blue LED for which the dominant wavelength λD of irradiated light is in the range of 400 nm<λD≤500 nm is used as the charge eliminating apparatus, a decrease in the amount of light on the drum surface will be greater in a case where the charge eliminating apparatus is contaminated with magenta toner than in a case where the charge eliminating apparatus is contaminated with cyan toner.

Therefore, by changing a matrix of the contamination determination criteria based on a combination between the wavelength of the LED of the charge eliminating apparatus and the photosensitive drum of the image forming portion, it is possible to provide a highly precise determination with respect to contamination as well as the optimal contamination determination conditions.

FIG. 29 and FIG. 30 illustrate tables showing an example of criteria for determining contamination of the charge eliminating apparatuses, similarly to FIG. 28. FIG. 31 is a view showing contamination determination criteria that are applied based on combinations between the wavelengths of the LEDs of the charge eliminating apparatuses and the photosensitive drums of the image forming portions. That is, FIG. 31 shows combinations of contamination determinations in which a predetermined threshold value for a contamination determination with respect to an image forming portion that uses toner that has the highest absorbance with respect to the dominant wavelength of light of the charge eliminating apparatus is made lower than the threshold value for a contamination determination with respect to the other image forming portions.

The words "yellow", "magenta", "cyan" and "black" in FIG. 31 indicate the image forming portions of the respective colors. Further, in the table of FIG. 31, FIG. 28 which is described in the fifth exemplary embodiment and the aforementioned FIGS. 29 and 30 are described as the criteria to be applied to the combinations (that is, tables to be used for determining contamination).

Based on FIG. 31, a case will be considered in which, as the charge eliminating apparatus, a red LED having a dominant wavelength λD=630 nm is applied as a light emitting device, and image formation of a monochromatic magenta image with an image ratio of 100% and a monochromatic cyan image with an image ratio of 100%, respectively, is performed. In this case, the table of FIG. 29 is applied for the image forming portion 1M that uses magenta toner, and the table of FIG. 28 is applied for the image forming portion 1C that uses cyan toner.

Thus, in the present exemplary embodiment a plurality of criteria (tables) that are applied for contamination determination control are prepared in correspondence with the absorbance with respect to the dominant wavelength of the light of the charge eliminating apparatuses. As a result, conditions exist whereby the results of contamination determinations will be different even when the cumulative print counts are the same, and it is thus possible to provide the optimal contamination determination conditions at the image forming portion of each color.

Note that, in the present exemplary embodiment, contamination determination criteria are described that are applied for Y, M, C and K with respect to three kinds of wavelength regions. However, for example, even in a case where special colors (white, gold, silver) or the like are used, the current determination criteria may be used in accordance with the absorption distribution, or separate determination criteria may be added.

Seventh Exemplary Embodiment

Figure 33:
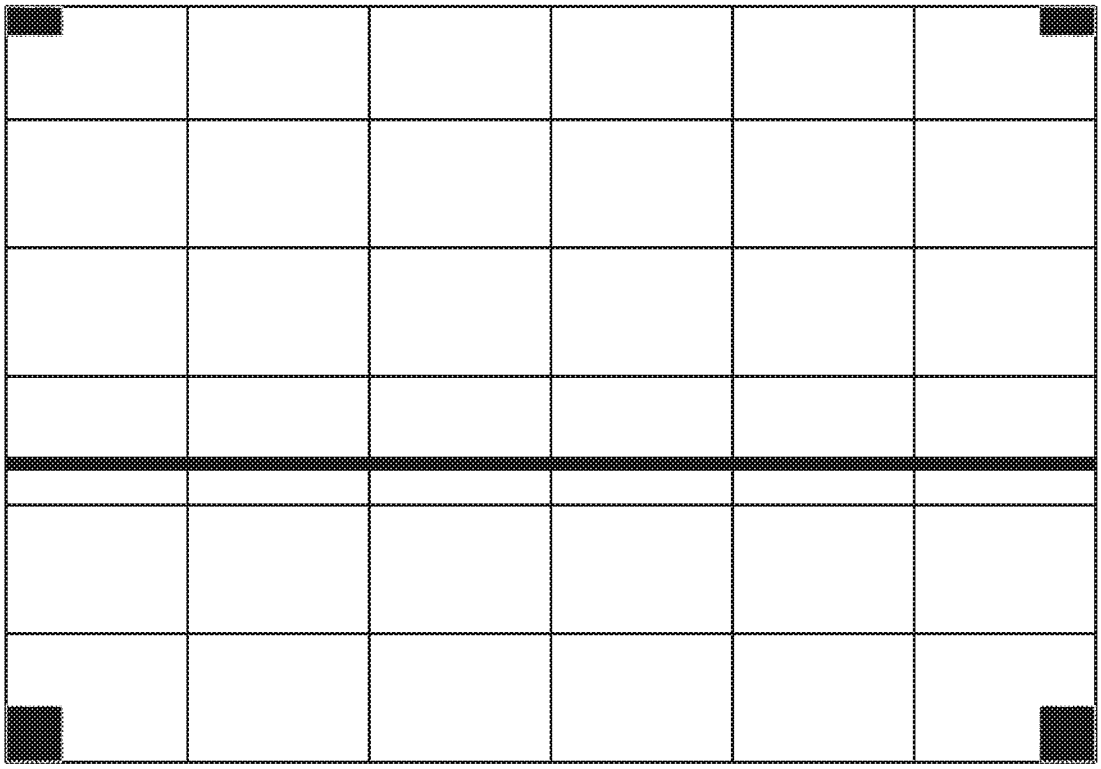
FIG. 33 is a view illustrating an example of an output image according to the seventh exemplary embodiment.

A seventh exemplary embodiment will now be described using FIG. 32 to FIG. 34 while referring to FIG. 1 to FIG. 4. In each of the exemplary embodiments described above, the contamination state of the charge eliminating apparatuses is determined based on a cumulative image ratio of output images and a cumulative print count. In contrast, in the present exemplary embodiment, a configuration is adopted so as to divide an output image into areas in the longitudinal direction and acquire image information for each area. Since the other configurations and actions are the same as in the above-described first exemplary embodiment, the following description centers on the points that are different from the first exemplary embodiment.

In the present exemplary embodiment, a configuration is adopted so that, by dividing an output image into areas in the longitudinal direction, acquiring image information for each area and calculating an image ratio for the respective areas, the precision with respect to determination of a contamination state is increased by enabling the ascertainment of states of localized contamination of the charge eliminating apparatuses.

For this purpose, the controller 500 is capable of acquiring a cumulative image ratio for each region among a plurality of regions into which the photosensitive drum is divided in the longitudinal direction. That is, the controller 500 calculates an image ratio for each region in which an image is created, and cumulatively adds the image ratios similarly to the first exemplary embodiment. Further, the controller 500 is capable of changing a light amount setting of a charge eliminating apparatus based on the cumulative image ratio of a region in which the cumulative image ratio is largest. This is because there is a possibility that the most toner adheres to a charge eliminating apparatus at a region in which the cumulative image ratio is largest, and there is a possibility that the amount of light that reaches the photosensitive drum also decreases in such a region. Further, in a case where a large amount of toner adheres to one portion in the longitudinal direction of a charge eliminating apparatus and the light amount decreases at that portion, charge elimination unevenness in the longitudinal direction will occur on the surface of the photosensitive drum.

Therefore, according to the present exemplary embodiment a configuration is adopted so as to perform the aforementioned light amount setting control of the first exemplary embodiment based on the cumulative image ratio of region in which the cumulative image ratio is largest. That is, even when a value obtained by cumulatively increasing the average values of the image ratios of output images corresponds to, for example, the coefficient "1" in FIG. 10, if a cumulative value of the image ratios of any region among the divided regions corresponds to the coefficient "1.1", the light amount setting is changed based on the coefficient "1.1".

FIG. 32 illustrates an example of regions into which recording materials are divided in the longitudinal direction according to the sizes of the recording materials. In FIG. 32, 11 divided regions in the longitudinal direction are defined. The horizontal column in FIG. 32 shows the number of regions, and the vertical column shows the type of recording material. The columns next to the column showing the type of recording material show the sizes of recording material, with the "conveyance direction" column showing the dimension in the sub-scanning direction, and the "VERTICAL" column showing the dimension in the main scanning direction, that is, the longitudinal direction. Further, the black circles in FIG. 32 show the regions in which image ratios are counted for the respective recording materials. The column for region "6" indicates the center of the recording material. Therefore, for example, in the case of a B5-size recording material, image ratios are counted in each of nine regions from region 2 to region 10, and image ratios are not counted in the regions 1 and 11.

Next, a method for calculating the image ratios when the recording materials are divided into regions in the longitudinal direction as described above will be described. A method for calculating the image ratios when an image shown in FIG. 33 is output will be described as an example. FIG. 33 shows an image that is obtained when a B5-size image is output using black toner, for which the overall image ratio is 5%.

First, the output image is divided into areas at every 0.254 mm in the main scanning direction, and an image ratio is calculated for the respective areas. Then, the image ratios for each of the regions shown in FIG. 32 are determined. FIG. 34 is a view obtained by converting the image shown in FIG. 33 so that the abscissa axis represents the main scanning direction length and the axis of ordinates represents the image ratio.

Figure 34:
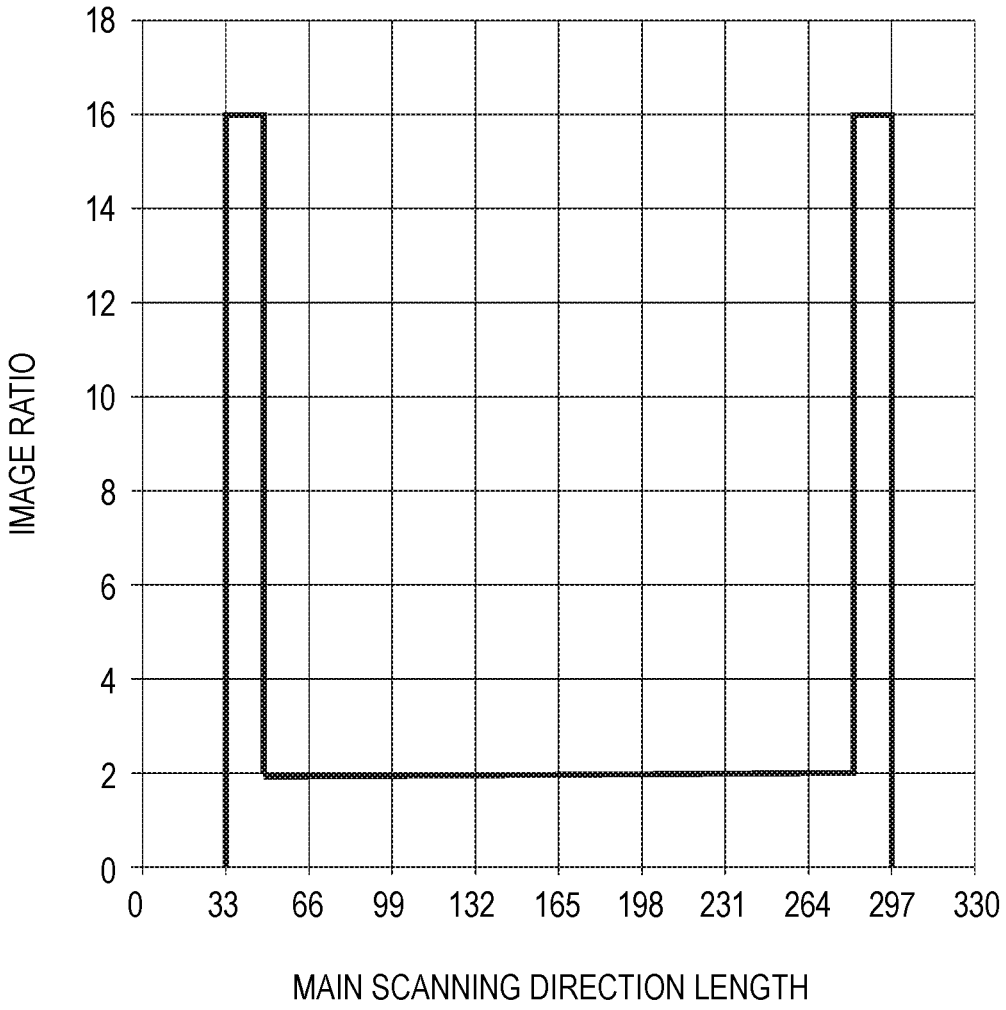
FIG. 34 is a view illustrating an example of image ratios in a longitudinal direction of the output image according to the seventh exemplary embodiment.

Based on FIG. 34 it is found that, with respect to a case where an output image having an overall image ratio of 5% is cumulatively converted, by performing cumulative conversion for each divided region in the main scanning direction, regions that use K toner that corresponds to a highest image ratio of 16% are present in the output image. In the present exemplary embodiment, the largest image ratio for each measure on the abscissae axis in FIG. 34 is defined as the cumulative image ratio that is added up in the relevant region.

By dividing an output image into a plurality of regions in the longitudinal direction in this way, calculating the cumulative image ratio for each of the respective regions, and seeing the largest cumulative image ratio in this way, the contamination state of the charge eliminating apparatus can be accurately ascertained. As a result, light amount setting control of the charge eliminating apparatus can be performed with greater accuracy, and the influence of charge elimination unevenness on images can be accurately suppressed.

Note that, although in the present exemplary embodiment a configuration is adopted in which recording materials are divided into 11 regions in the longitudinal direction, the number of divided regions is not limited to 11, and the recording materials may be divided into a greater number of regions, or the number of divisions may be reduced.

Further, the control of the present exemplary embodiment is also applicable to any of the second to sixth exemplary embodiments, and not only the first exemplary embodiment. For example, in the case of applying the control of the present exemplary embodiment to the third exemplary embodiment, the charging bias setting of the relevant charging apparatus can be changed based on the cumulative image ratio of a region in which the cumulative image ratio is largest. Further, in the case of applying the control of the present exemplary embodiment to the fifth exemplary embodiment, information to the effect that the relevant charge eliminating apparatus is contaminated can be transmitted based on the cumulative image ratio of a region in which the cumulative image ratio is largest.

Other Exemplary Embodiments

In each of the exemplary embodiments described above, a cumulative image ratio is used as image information relating to a cumulative value. However, for example, a video count value may be used as the cumulative value. A video count value is a value acquired by integrating the levels (for example, levels 0 to 255) in one plane of the image for each pixel of image data that is input.

Further, the configurations of the respective exemplary embodiments can be suitably combined and implemented. For example, a configuration may be adopted in which both the light amount setting changing control for the charge eliminating apparatuses of the first and second exemplary embodiments and the charging bias setting change control for the charging apparatuses of the third and fourth exemplary embodiments are performed based on cumulative image ratios and cumulative print counts. Further, at least any one of the first to fourth exemplary embodiments may be combined with the fifth or sixth exemplary embodiment. For example, a configuration may be adopted in which at least either one of control to change a light amount setting of a charge eliminating apparatus and control to change a charging bias setting of a charging apparatus is performed based on a cumulative image ratio and a cumulative print count, and information to the effect that a charge eliminating apparatus is contaminated is also transmitted.

In addition, in each of the exemplary embodiments described above, as an image forming apparatus, an apparatus is described that has a configuration that adopts an intermediate transfer method which transfers a toner image that is formed on a photosensitive drum onto an intermediate transfer belt. However, the present invention is also applicable to a direct transfer method which transfers a toner image directly onto a recording material from a photosensitive drum. In this case, the recording material corresponds to a transfer material.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-231567, filed Dec. 1, 2017, which is hereby incorporated by reference herein in its entirety.

What is claimed is:

1. An image forming apparatus, comprising:

a rotatable intermediate transfer member;

a first image forming portion having a first photosensitive member which rotates, a first developing unit which develops an electrostatic latent image formed on the first photosensitive member using magenta toner, and a first charge eliminating unit which eliminates a charge from the first photosensitive member by exposing the first photosensitive member to light using a laser beam having a dominant wavelength $\lambda D$ in a range of 610 nm$<\lambda D\leq$760 nm after a toner image formed by the first developing unit is transferred onto the intermediate transfer member;

a second image forming portion that is located on a downstream side of the first image forming portion in a rotational direction of the intermediate transfer member, and that has a second photosensitive member which rotates, a second developing unit which develops an electrostatic latent image formed on the second photosensitive member using black toner or cyan toner, and a second charge eliminating unit which eliminates a charge from the second photosensitive member by exposing the second photosensitive member to light using a laser beam having a dominant wavelength $\lambda D$ in a range of 610 nm$<\lambda D\leq$760 nm after a toner image formed by the second developing unit is transferred onto the intermediate transfer member;

a transfer unit that transfers a toner image which is formed on the intermediate transfer member onto a transfer material; and a controller that switches a light amount of the second charge eliminating unit, when a usage amount of the second image forming portion reaches a predetermined amount, to a value that is greater than a light amount of the first charge eliminating unit when a usage amount of the first image forming portion reaches the predetermined amount.

2. The image forming apparatus according to claim 1, wherein the controller switches a light amount of the first charge eliminating unit to a greater value upon the usage amount of the first image forming portion reaching an amount that is greater than the predetermined amount.

3. The image forming apparatus according to claim 1, wherein the predetermined amount is a number of image formations.

4. The image forming apparatus according to claim 3, wherein the predetermined amount is a value that is based on a number of image formations and a cumulative value of image ratios.

5. The image forming apparatus according to claim 1, wherein each of the first charge eliminating unit and the second charge eliminating unit has a light emitting device which emits a beam, and a light guiding body which guides, in a longitudinal direction, the beam from the light emitting device, which is provided at an end portion in the longitudinal direction.

6. The image forming apparatus according to claim 1, wherein each of the first and second image forming portions has a cleaning portion that cleans toner following a transfer, and each of the first and second charge eliminating units is arranged at a position which, with respect to a rotational direction of the photosensitive member, is on an upstream side of the cleaning portion, and is on a downstream side of a transfer portion that transfers the toner image onto the intermediate transfer member.

7. An image forming apparatus, comprising:

a rotatable intermediate transfer member;

a first image forming portion having a first photosensitive member which rotates, a first developing unit which develops an electrostatic latent image formed on the first photosensitive member using magenta toner, and a first charge eliminating unit which eliminates a charge from the first photosensitive member by exposing the first photosensitive member to light using a laser beam having a dominant wavelength $\lambda D$ in a range of 610 nm$<\lambda D\leq$760 nm after a toner image formed by the first developing unit is transferred onto the intermediate transfer member;

a second image forming portion having a second photosensitive member which rotates, a second developing unit which develops an electrostatic latent image formed on the second photosensitive member using black toner or cyan toner, and a second charge eliminating unit which eliminates a charge from the second photosensitive member by exposing the second photosensitive member to light using a laser beam having a dominant wavelength $\lambda D$ in a range of 610 nm$<\lambda D\leq$760 nm after a toner image formed by the second developing unit is transferred onto the intermediate transfer member;

a transfer unit that transfers a toner image which is formed on the intermediate transfer member onto a transfer material; and a controller that switches a light amount of the second charge eliminating unit when the second image forming portion forms images of a predetermined number of image formations at a predetermined image ratio to a value that is greater than a light amount of the first charge eliminating unit when the first image forming portion forms images of the predetermined number of image formations at the predetermined image ratio.

8. The image forming apparatus according to claim 7, wherein when a usage amount of the first image forming portion is taken as a first predetermined amount, the controller switches a light amount of the first charge eliminating unit to a greater value upon the usage amount of the first image forming portion reaching a second predetermined amount that is greater than the first predetermined amount.

9. The image forming apparatus according to claim 7, wherein each of the first charge eliminating unit and the second charge eliminating unit has a light emitting device which emits a beam, and a light guiding body which guides, in a longitudinal direction, the beam from the light emitting device, which is provided at an end portion in the longitudinal direction.

10. The image forming apparatus according to claim 7, wherein each of the first and second image forming portions has a cleaning portion that cleans toner following a transfer, and each of the first and second charge eliminating units is arranged at a position which, with respect to a rotational direction of the photosensitive member, is on an upstream side of the cleaning portion, and is on a downstream side of a transfer portion that transfers the toner image onto the intermediate transfer member.

* * * * *